US005643528A

United States Patent [19]

Le Gras

[11] Patent Number: 5,643,528

[45] Date of Patent: Jul. 1, 1997

[54] CONTROLLED MAGNESIUM MELT PROCESS, SYSTEM AND COMPONENTS THEREFOR

[75] Inventor: Brian W. Le Gras, Strathroy, Canada

[73] Assignee: Musket System Design and Control Inc., Strathroy, Canada

[21] Appl. No.: 467,435

[22] Filed: Jun. 6, 1995

[51] Int. Cl.[6] ..... C21D 11/00

[52] U.S. Cl. ..... 266/88; 266/200; 266/901

[58] Field of Search ..... 266/78, 88, 94, 266/200, 901, 249, 252, 255, 87; 164/457, 4.1

[56] References Cited

U.S. PATENT DOCUMENTS

| | | | |
|---|---|---|---|
| 4,004,138 | 1/1977 | Morooka et al. . | |
| 4,154,433 | 5/1979 | Kato | 266/255 |
| 4,255,133 | 3/1981 | Tanifuji et al. . | |
| 4,373,364 | 2/1983 | Tanimoto et al. . | |
| 4,373,706 | 2/1983 | Elhaus et al. . | |
| 4,469,162 | 9/1984 | Hanas et al. . | |
| 5,197,531 | 3/1993 | Hugo et al. . | |
| 5,359,531 | 10/1994 | Iwamoto et al. . | |
| 5,364,080 | 11/1994 | Kraemer et al. . | |
| 5,407,000 | 4/1995 | Mercer, II et al. | 164/457 |

*Primary Examiner*—Scott Kastler

*Attorney, Agent, or Firm*—Stanley E. Johnson

[57] ABSTRACT

Apparatus for a fully automated magnesium melt system. Raw magnesium ingots are moved through and controllably heated in a preheater chamber before they are introduced into a melt cell. A probe monitors the metal level and a control unit causes ingot charging as determined by a process level set point or temperature overshoot. There are two zones of heating in the melt cell with each zone supplied by its own 3 phase zero cross fired silicon controlled rectifier and firing board which is gated by a gating signal. This controls how much the SCR's are allowed to conduct. The amount of error between the metal bath set point and the actual metal bath temperature automatically determines how much of the 4–20 mA gating signal is required to maintain the set metal bath temperature. Liquid magnesium is transferred from the melt cell to a die cast machine by a siphon transfer tube which has two sets of electrical heating elements. A programmable logic controller, with suitable programming, controls the temperature at all times of the molten magnesium and preheating of the ingots. This PLC and other monitoring or remotely located computers provide complete process control and information.

45 Claims, 35 Drawing Sheets

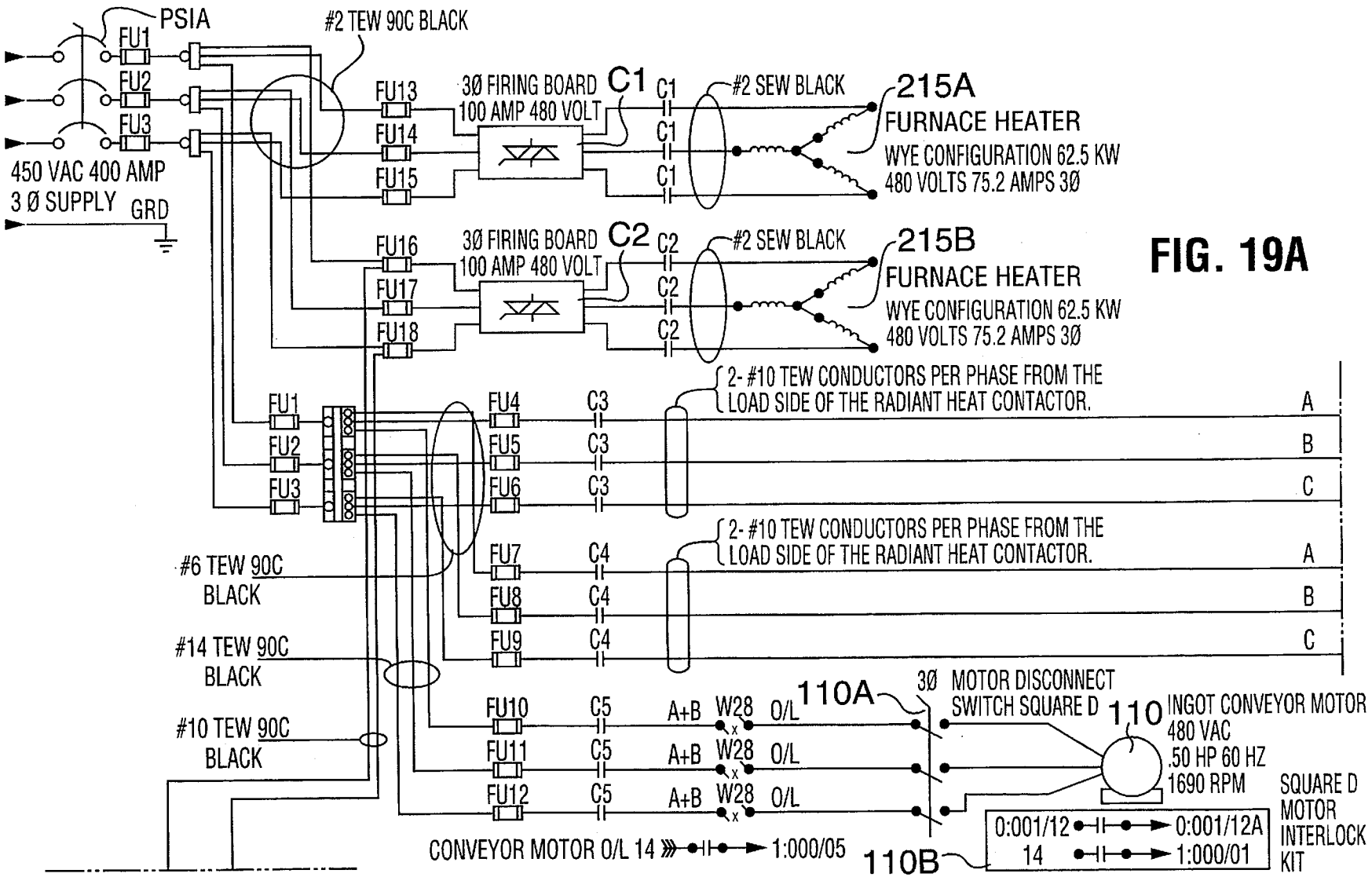
FIG. 19A
215A
FURNACE HEATER
WYE CONFIGURATION 62.5 KW
480 VOLTS 75.2 AMPS 3Ø
215B
FURNACE HEATER
WYE CONFIGURATION 62.5 KW
480 VOLTS 75.2 AMPS 3Ø
#2 SEW BLACK
C1
C2
3Ø FIRING BOARD
100 AMP 480 VOLT
2- #10 TEW CONDUCTORS PER PHASE FROM THE LOAD SIDE OF THE RADIANT HEAT CONTACTOR.
A
B
C
3Ø MOTOR DISCONNECT SWITCH SQUARE D
110A
110B
110
INGOT CONVEYOR MOTOR
480 VAC
.50 HP 60 HZ
1690 RPM
SQUARE D MOTOR INTERLOCK KIT
0:001/12
14
0:001/12A
1:000/01
O/L
W28
A+B
1:000/05
CONVEYOR MOTOR O/L 14
#2 TEW 90C BLACK
FU1
FU2
FU3
FU4
FU5
FU6
FU7
FU8
FU9
FU10
FU11
FU12
FU13
FU14
FU15
FU16
FU17
FU18
C3
C4
C5
PSIA
450 VAC 400 AMP
3 Ø SUPPLY
GRD
#6 TEW 90C BLACK
#14 TEW 90C BLACK
#10 TEW 90C BLACK

566

CLOSED LOOP PID FLOW FLOW CHART WITH PLC PROGRAMING ENHANCEMENT

FIG. 28A

FIG. 28B

FIG. 28

SCREEN 3

INGOT REQUEST

ENABLED

CONV. CYCLE

INDEXING

PUSH ROD ADV.

NOT ADV.PX1

GUILLOTINE RET.

NOT RETD PX4

PUSH ROD RETR.

RETR. TO PX2

GUILLOTINE ADV.

HOME POS PX3

: WHEN THE PLC PROGRAM DETERMINES THAT AN INGOT CHARGE IS REQUIRED, THE FOLLOWING SEQUENCE OF EVENTS WILL OCCUR:

1. CONVEYOR IS CHECKED FOR HOME POSITION.
2. THE PUSH ROD CYLINDER WILL ADVANCE AND CHARGE ONE INGOT IN THE DROP CHUTE, WHICH IS STOPPED BY THE GUILLOTINE BEING IN PLACE.
3. THE GUILLOTINE RETRACTS AFTER TIMER IS DONE, ALLOWING INGOT TO ENTER THE MELT FURNACE. BOTH THE PUSH ROD AND GUILLOTINE RETURN TO THEIR HOME POSITION.
4. AUTO CONVEYOR WILL NOW CYCLE ONE POSITION, TO KEEP MAXIMUM NUMBER OF INGOTS UNDER THE RADIANT HEAT AT ALL TIMES.

POUR REQUEST

NO REQUEST

SIPHON TUNE RAISED LS2

TUBE IS RAISED

SIPHON TUNE LOWERED PX5

TUBE IS LOWERED

SIPHON VALVE LS3

VALVE IS OPEN

: UPON A POUR REQUEST, THE SIPHON TUBE WILL MOVE TO THE DCM POUR HOLE. WHEN PX 5 IS MADE THE SIPHON VALVE WILL OPEN FOR THE PRESET POUR TIME. AT THE END OF THE POUR TIME THE VALVE WILL CLOSE, THE SIPHON DRIP TIMER WILL TIME OUT AND THE TUBE WILL RAISE TO THE RESET POSITION.

MAIN F17 SCREEN

CONTR. F18 SCREEN

FAULT F19 SCREEN

SYSTEM FAULT

FAULT PRESENT

FIG. 31

SCREEN 4

| FURNACE | PREHEAT | METAL LEVEL | SIPHON | TUBE CYC. | INGOT LOAD | CONVEYOR | LADLING |
|---|---|---|---|---|---|---|---|
| HI-LIMIT | HI-LIMIT | HIGH | HI-LIMIT | NORMAL | FAULT | FAULT | FAULT |
| FURNACE TEMP. | PREHEAT TEMP. | METAL LEVEL | SIPHON IN TEMP. | SIPHON OUT TEMP. | PUSH ROD CYLINDER | CONVEYOR MOTOR O/L | MAIN F17 SCREEN |
| HI/LOW | HI/LOW | NORMAL | HI/LOW | NORMAL | NORMAL | O/L OKAY | CONT F18 SCREEN |
| FURNACE DATA | PREHEAT DATA | METAL LEVEL DATA | LEVEL CONTROL | SIPHON DATA | GUILLOT. CYLINDER | WATCHDOG TIMERS | CYC F19 SCREEN |
| INVALID | INVALID | VALID | FAULT | VALID | NORMAL | FAULT | |
| METAL BATH T/C 1 | PREHEAT T/C 2 | PREHEAT T/C 3 | SIPHON IN T/C 6 | SIPHON VALVE | PLC 5/20 RACK | SYSTEM FAULT | |
| FAULT | VALID | VALID | VALID | NORMAL | ACTIVE | FAULT PRESENT | NO ALARMS |
| FURNACE OUTERSHELL | OUTERSHELL T/C 8 | PREHEAT T/C 4 | SIPHON OUT T/C 7 | SIPHON POUR TIME | PLC BATT LOW BIT | RESET | SILENCE |
| NORMAL | VALID | VALID | VALID | FAULT | BATT OK | P.B F7 | QUIET |

FIG. 32

CONTROLLED MAGNESIUM MELT PROCESS, SYSTEM AND COMPONENTS THEREFOR

FIELD OF INVENTION

This invention relates generally to improvements in the art of magnesium die casting and more particularly to a controlled process, system and apparatus for producing liquid magnesium. The invention particularly concerns a process and apparatus for a turn key, computer controlled magnesium melt cell, with operator computer interface.

The invention is directed to a system which is controlled beginning with transporting and preheating raw ingots of magnesium, transferring the ingots to a furnace, melting of the ingots and transfer of the liquid magnesium to the die cast machine shot sleeve pour hole. The invention also particularly concerns a controlled process and components of the system. There is complete control of the physical movement of the raw magnesium ingot through all of the stages necessary to introduce liquid magnesium to the die cast machine shot sleeve pour hole. There is controlled preheating of the ingot, control and monitoring of the level of the liquid magnesium in the furnace melt pot. The melting process is controlled by maintaining suitable temperatures as well as the quality of liquid magnesium sent to the die cast machine.

This invention also relates to interactive communication to the die cast machine relating to the necessary signals required for a fully automated casting operation, as well as diagnostic messages relevant to the above.

This invention also relates to melt cell interaction with the cell operator for introducing process set points, displaying all cell temperatures, set points, cell cycle displays of each facet of the cell operation, security access to limit operation of the cell to those with the proper authorization code and diagnostic screens to aid in problem solving, relating to the melt cell as well as fault indications coming from the die cast machine.

BACKGROUND OF INVENTION

Magnesium die cast components, because of their weight advantage and other characteristics, are used in automobiles and other mobile equipment. Obviously there are numerous other uses for die cast magnesium parts and pieces i.e. computer housings and chain saw housing only to mention a few.

One of the major drawbacks with known magnesium die casting is extensive wastage because of flaws that result when using existing processes and equipment.

Temperatures and minimum temperature variations are critical as well as other process variable parameters such as metal level in the molten bath and consistent metal pour to meet the unique properties of a magnesium melt operation.

Some considerations for making a quality magnesium casting are as follows:

(1) The ingot (15 lbs. or 25 lbs.) should be suitably conditioned (i.e. pre-heated) before being placed into the furnace metal bath. For example should moisture be left in or on the ingot that moisture will become super heated steam in the furnace which can cause an explosion to occur in the metal bath.

One method of preheating used in the prior art is to lay the ingots on top of the furnace and when the operator felt they were ready then place them by hand in the molten bath. Another method, when using gas fired furnace, was to use the heat radiated from the furnace, as well as ducting arrangement of the vented heat to be channelled into an enclosure where this heat was used to preheat the ingots. A further method was using an electric duct heater in a preheat chamber with little or no heat control and with no regard to or determination or measurement of the ingot temperature. All of the above methods are extremely dangerous as they do not meet the various ingot supplier warning of never introducing a magnesium ingot into the metal bath until it is above 150° C. (300° F.). An ingot below the noted temperature also creates temperature gradients in the metal bath which produce dross and sludge. There also is the risk of explosion. The end result is scrap production parts, down time and possible injury to personnel and equipment.

(2) Temperature variations are critical. For example the metal bath (furnace) should stay within a selected temperature range when an ingot has been charged. The metal bath should not deviate above or below a preselected temperature. If it does dross build up can occur which filters down through the metal bath allowing impurities to become part of the casting. Castings with imperfections become costly scrap.

(3) The metal bath level should remain at as constant a level as possible to ensure each metal pour is the same amount, and to be able to realize the same amount of head pressure for each pour. In one prior art method the machine operator would, after making a certain number of parts, go to the furnace and add ingots to bring the metal level to where he wanted it. In another method after making a certain number of parts, a counter in the die cast machine would turn on a lamp to indicate ingots needed to be added to the metal bath. The operator would then add ingots by hand to bring the level to the desired level. These methods rely totally on the operator who may or may not be conscientious to the need of a constant metal level for operating in process control. The operator is also at risk, if the ingots being added are below a safe temperature to do so.

(4) Transfer of the metal from the furnace through the siphon tube should be done as quickly as possible due to the rapid loss of heat from the magnesium when contact with the atmosphere as well as the burning that occurs, which contaminates the metal pour.

In the prior art melting of magnesium one method used is gas fired furnaces, normally with two combustion blower units. This is an effective method for melting the magnesium but by its characteristics alone makes an extremely poor choice for magnesium due to the following:

(a) magnesium dust is extremely flammable and should never be in an environment with an open flame; and (b) due to the extremely large swing in the temperature above and below the set point (typically ±25° C.), there is no chance to keep the metal bath temperature within the extremely tight metal bath requirements. The metal bath temperature desirably should be ±8° C., in relation to the metal bath set point.

Another method used is an electric furnace with power contactor relays where the amount of power is selected by a selector switch and the overall metal bath controller is used to control the on/off operation. This furnace is in actual fact a holding furnace used to maintain temperature. It would normally be filled with liquid metal from a smelter. Also, since it is not interactive to a preheater control structure, or a die cast machine, it has no ability to anticipate the ingot being introduced to the metal bath or to what the die cast machine mode of operation is.

The following are a few of the prior art systems of transferring liquid magnesium from a furnace metal bath to a die cast machine shot sleeve:

(1) Operator uses hand held ladle to ladle magnesium to the die cast machine pour hole. This method is time consuming and may only be used for small parts, i.e. one to two pounds. The operator must also ensure sulphur powder is constantly introduced to the metal bath surface to prevent burning of the liquid magnesium that is in contact with the atmosphere;

(2) Another method is the use of mechanical pumps which are operated by air and function as a piston style pump device. These units are prone to breakdown due to the high metal temperatures and are also prone to metal freeze up in the delivery pipe and pump itself if not kept in constant operation. Should there be metal freeze up the pump must be pulled out of operation and flushed out with sulphuric acid to clear obstructions. This method and the above other methods are very poor in relation to a constant quality of the desired amount of liquid magnesium being sent repeatedly time after time to the shot sleeve pour hole;

(3) Another method is the use of inert gas displacement and pressure transfer. This method uses inert gas to pressurize a crucible area. The inert gas tube goes into the crucible area and the delivery tube to the shot sleeve leaves and goes to the shot sleeve pour hole. This is a costly method as it involves electrically heating the transfer tube as well as the cost of the inert gas and pressurizing. This method also is inadequate in relation to process control due to the amount of liquid magnesium introduced to the shot sleeve. It varies greatly from one pour to the next.

Both items (2) and (3) introduce extra ancillary equipment that are unnecessary.

The foregoing are a few of the problems consistent with die casting magnesium but the major problem is the fact that a totally integrated process has never been developed before now to include all the process requirements from raw ingot to pour of the metal into the shot sleeve hole.

SUMMARY OF INVENTION

A principal object of the present invention is to provide a controlled melt system and components therefor to ensure optimum process parameters required for working with magnesium to obtain quality castings.

A further principle object is to provide a fully automated magnesium melt cell and melt system.

In accordance with the present invention there is complete control of the total process in a magnesium melt system starting with the raw ingot of magnesium in its initial state through to transfer of the liquid magnesium to the die cast machine shot sleeve.

The system of the present invention may be provided as a total package turn key operation which may communicate through dry contact closure e.g. relays or from the melt cell processor to a compatible industrial processor as well as remotely located processors and monitoring systems. Individual components are also provided in accordance with various aspects of the present invention.

All system process values and the entire metal process have been engineered to meet the unique properties of the magnesium melt operation and include:

(a) maintaining the metal bath selected temperature preferably within a range of ±5 degrees C;

(b) providing consistency in the amount of metal transferred. Each part poured in a DCM has a biscuit which is the metal in the pour sleeve. The size of biscuit is predetermined. The siphon tube transfer of metal accuracy provided by the present invention permits obtaining an accuracy of about ±0.250" on a 2" diameter biscuit. The transfer is relatively constant due to a constant metal level head pressure;

(c) as an example the metal level is controlled preferably to about ±1% where 1.6" equals 10% of the linear measurement of the level probe which is 16" in length. This relates to a crucible with about 4,500 lbs. of molten magnesium. The melt rate is approximately 1800 lbs. of magnesium/hr. and the surface variation of the molten metal is less than 1/16 inch;

(d) the metal temperature in the tube of the siphon tube transfer device is kept preferably within approximately 5 degrees C. of the selected temperature by constantly monitoring and updating the thermocouples used for the siphon inlet end and the siphon outlet end of the tube and using this information in the program to control the siphon-in heat contactor and the siphon-out heat contactor.

In the apparatus the furnace has two separate zones of heating elements. Each zone is controlled by 3 phase, zero cross fired 4 to 20 mA gated SCR's, controlled by a OFE2 module of the PLC. The SCR's are zero cross fired to prevent RFI (Radio Frequency Noise) and gated to allow only the amount of power required to keep the metal bath at the desired set point. The 4 to 20 mA signal is sent to the individual firing boards for the SCRs via an intelligent analog output module i.e. the OFE2 module of the PLC. The control for these signals is done in the industrial processor using a closed loop interactive P.I.D. (Proportional Integral Derivative) function block suitably modified to use all of the information available in the program. The processor is programmed as desired to ensure extremely accurate metal bath control. Factors used with P.I.D. function include.

(a) die cast machine running in semi-auto or auto;

(b) outer shell temperature of the furnace;

(c) anticipation of ingot being charged to initiate a feed forward value to the P.I.D. block;

(d) temperature of ingot about to be charged to the metal bath. This information comes from an infra-red ingot sensor or direct contact thermocouple;

(e) the amount of time between die cast machine cycles; and (f) the metal level.

There are also furnace routines that run automatically when the DCM has not cycled for more than 10 minutes;

To allow for a quick start up of the furnace;

To allow for additional heat to offset an ingot charge of a cooler ingot;

Weekend routine for gradual start up of furnace to melt bath temperature desired.

The present invention responds to a direct need of the magnesium casting industries by providing a fully automatic magnesium melt system that performs operations relating to the process parameters. The invention meets their needs regarding the ability to be a turn key operation which requires minimal integration to function with any of the various manufacturers of die casting machines while at the same time have the ability to provide process information at the melt cell as well as being able to network with other computers that are being used to record and log process information for their customers, and also to have the ability to interface the melt cell computer with the die cast machine computer for quality and production enhancement of the casting operation.

A control scheme and the required apparatus is provided which is user friendly and provides all aid possible for maximum uptime. The system is able to interact to change automatically to compensate for many variables present in an operation. There is an ability to anticipate temperature change and react before hand to ensure that the process control set points stay within the process window. Casting using the present apparatus permits making parts weighing anywhere for example from approximately 3 lbs. to 59 lbs. with minimization of scrap considered essential in regards to a profitable casting operation.

Some features provided by the present invention include:

(1) preheated magnesium ingots. (Preferred temperature range 150° C. to 250° C.);

(2) infra-red sensor or direct contact thermocouple sensor to ensure ingot temperature suitable for transfer of ingot to the furnace;

(3) Metal level bath kept to process desired level within ±1%;

(4) Metal bath temperature kept within ±8° C. of metal bath set point;

(5) Metal in transfer siphon tube kept to within ±8° C.;

(6) Metal pour time to shot sleeve equal to the time selected by operator;

(7) Two distinct modes of furnace operation:

(a) run mode (operational);

(b) idle mode (weekend or down time cost savings);

*NOTE* in the run mode there are also features that allow for:

(a) quick heat up (when furnace first is started or when the die cast machine is first put into auto);

(b) feed forward (used to off set the ingot being introduced into the metal bath);

*NOTE, these two items are time based and must meet program considerations.

(8) Interactive and anticipative programming to allow metal bath temperature kept well within the ±8° C. process window.

In keeping with the foregoing there is provided in accordance with the present invention a metal melt system comprising: (a) an electric furnace with a crucible therein for holding a supply of molten metal and including molten metal level and temperature sensors on said furnace that provide output signals representative of the temperature and level of the molten metal in the crucible; (b) an electrically heated preheater for heating metal ingots to a preselected temperature and including a temperature sensor on the preheater providing an output signal representative of the temperature in the preheater; (c) an ingot transfer means for transferring a selected ingot from said preheater into said furnace including actuators for effecting the transfer and sensors providing output signals representative of the state of operation of said actuators and functions performed; (d) means for withdrawing molten metal from said crucible; and (e) programmable logic controller (PLC) means receiving signals from said sensors and in response thereto, in comparison with preselected values, controlling power to the preheater and furnace to maintain within selected limits pre-selected temperatures therefor and controlling feeding of ingots to said furnace as required to maintain the molten metal in the furnace within a selected range of a predetermined level.

There is also provided in accordance with the present invention a metal melt furnace comprising: (a) metal, high temperature insulated, walls surrounding a selected area and base means extending across said selected area and including means supporting said walls; (b) an insulated top wall supported by said side walls and having an opening therein; (c) a crucible suspended from said top wall through said opening and extending downwardly terminating at a bottom end above said base means; (d) a lid on said crucible and electric elements on each of said insulated walls comprising a first upper heating zone extending around said crucible and a second lower heating zone independent of said first zone and also extending around said crucible.

Also provided in accordance with the present invention there is illustrated an ingot preheater and transfer apparatus for a metal melt system comprising an enclosure having an inlet end and a discharge end resistance heating elements in said enclosure arranged in a first heating zone adjacent said inlet end and a second zone extending therefrom toward said discharge end, an endless conveyor means for moving a plurality of ingots in sequence into said enclosure through said inlet means and through said enclosure to said discharge end, an ingot transfer device at said discharge end including means to transfer an ingot from said discharge end into a drop chute, gate means in said drop chute to respectively in a gate closed and gate open position retain and release an ingot in said chute and means to move said gate from one to the other of said positions.

BRIEF DESCRIPTION OF THE DRAWINGS

The invention is illustrated, by way of example, in the accompanying drawings wherein:

FIG. 31 is the cycle screen to display ingot charge cycle and pour request siphon tube metal pour cycle also description text outlining the cycles; and FIG. 32 is the fault screen used to indicate status of all devices to address cross reference.

DESCRIPTION OF PREFERRED EMBODIMENT SYSTEM OVERVIEW

Figure 1:
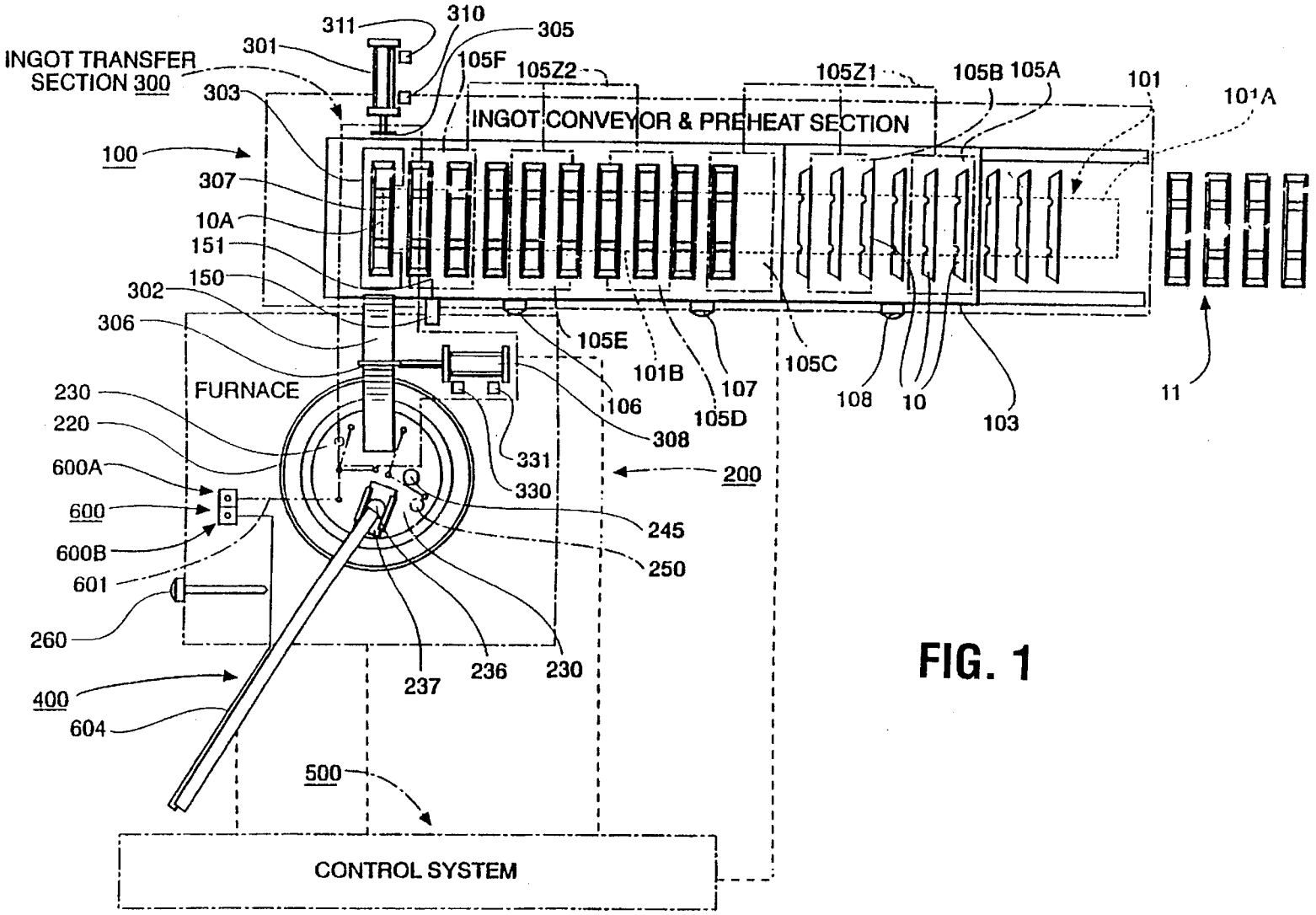
FIG. 1 is a diagrammatic top plan view of the overall system.

Applicant's preferred system, described in more detail hereinafter, includes an ingot conveyor and preheater section 100; a crucible type, resistor heated melt furnace 200; an ingot transfer section 300; a siphon tube, liquid magnesium discharge and feed to die cast machine (DCM) section 400; and a control system 500. The control system via a PLC, modules associated with the PLC, an operator's panel view, sensors and actuators inter-relates and integrates the operation of components 100, 200, 300 and 400.

To operate the system at a specific site an electric power supply is required as well as an air pressure system and a gas mixture supply. In the system to be described in more detail hereinafter the electric power supply requirement is 480 VAC, 400 A, 3 phase with ground. A 7.5 KVA transformer is required having a 480 VAC primary and a 240 VAC/120 VAC secondary. The transformer is preferably totally enclosed. The air pressure supply preferably provides 90 psi and the gas mixture supply comprises $CO_2SF6$ mixed as protection gas for the furnace pot lid and siphon tube outlet end.

The components 100, 200, 300 and 500 are of applicant's own original design and they may be selectively provided individually or in combination or sub-combinations for integration into existing magnesium metal melt operations or other metal melt operations as may be obvious to those skilled in the art.

The electric power supply, air pressure supply and gas mixture supply are normally provided on site and accordingly it is to be understood such items, or the equivalent thereof, will be provided for suitable operation of the complete system at a selected site.

Referring to FIG. 1 there is illustrated in block form, (broken line) the ingot conveyor and preheater section 100, the furnace 200, the ingot transfer section 300 and the control system 500 that inter-relates, integrates and controls operation of components 100, 200, 300 and the siphon tube liquid magnesium transfer section 400 shown in solid line. FIG. 1 also shows generally the gas mixture supply and distribution designated 600.

Ingots 10 are loaded from a suitable supply 11 onto the infeed end of a conveyor 101 that passes through chamber 102 of the preheater 100. The ingot transfer section 300 is at the discharge end of the conveyor.

The ingot transfer section 300 includes a pneumatic ingot pusher 301 that moves a preheated ingot into an inclined enclosed drop chute 302. A guillotine type gate 306 holds an ingot 10B (see FIG. 5) in the inclined chute ready for discharge into the furnace and upon command from the control unit 500 releases the ingot for free fall into the mass of molten metal 201 in a crucible 202 within the furnace 200.

The siphon tube 400, known per se in the trade, transfers molten magnesium from the molten metal bath 201 in the furnace to the shot sleeve hole SH of the die cast machine (DCM). Temperatures are critical as is also maintenance of predetermined constant level of the molten metal in the furnace.

Ingot Conveyor and Preheater

Referring now to the ingot conveyor and preheater section 100 there is a metal enclosure 103 suitably supported in an elevated position by support members generally designated 104. The preheat chamber 102 is located within the metal enclosure and is suitably insulated with "plyo-block" insulation. Metal ingots within the chamber are preheated to a desired set point of for example 150° C. to a maximum of approximately 250° C. The preferred range is 200° C. to 225° C.

Heat for the chamber is provided by six banks of electric resistance elements 105 with each element bank, by way of example, being 10.6 KW providing total radiant heat of 63.6 KW, 460 VAC single phase.

The six banks of resistance heating elements designated 105 A to F are divided into two zones designated in FIG. 1 as zone 1 (105Z1) and zone 2 (105Z2) with banks 105A, 105B and 105C being in zone 1 and banks 105D, 105E and 105F in zone 2.

The preheater chamber is used to heat the ingots to the desired set point. The preheat temperature range is 150° C. to 250° C. and preferably 200° C. to 225° C. The two zones of radiant heat are independent of each other and the zones are monitored by K type grounded thermocouples 106, 107 and 108. The values of the thermocouples are averaged to give zone temperature as well as the overall ambient preheater chamber temperature.

Ingots are conveyed to and in the preheater by the endless (continuous) conveyor 101 that has a first inclined section 101A extending from the ground level GND to the elevated preheat chamber and a horizontal section 101B located in the preheater chamber. The conveyor is a pair of parallel chains running on suitable shafts and sprockets and is driven by a motor 110 through a 50 to 1 reduction unit 111 and a conveyor chain and sprocket drive 112 and slip clutch not shown. Pairs of paddles 113 are in series equally spaced on the conveyor chains and they provide support for a number of magnesium metal ingots 10.

The magnesium ingots may be 15 or 25 pounds each and the preheater chamber 102 has a capacity for 25 ingots. The paddles on the conveyor are at each ingot placement and they keep the ingots located properly for preheat operation and for positive discharge displacement at the discharge end of the preheater.

Mounted on the preheater is an air cylinder push-rod unit 150 that carries a thermocouple 151 into and out of contact with an ingot prior to being moved by the conveyor to the transfer push rod cylinder unit 301 described hereinafter. The T/C is a spring loaded probe that makes direct contact and gives a true skin temperature reading. An infra red sensor non-contact type can be used but it is less accurate because of background heat influences i.e. ambient.

Mounted under the conveyor is a conveyor index limit switch 115.

Figure 2:
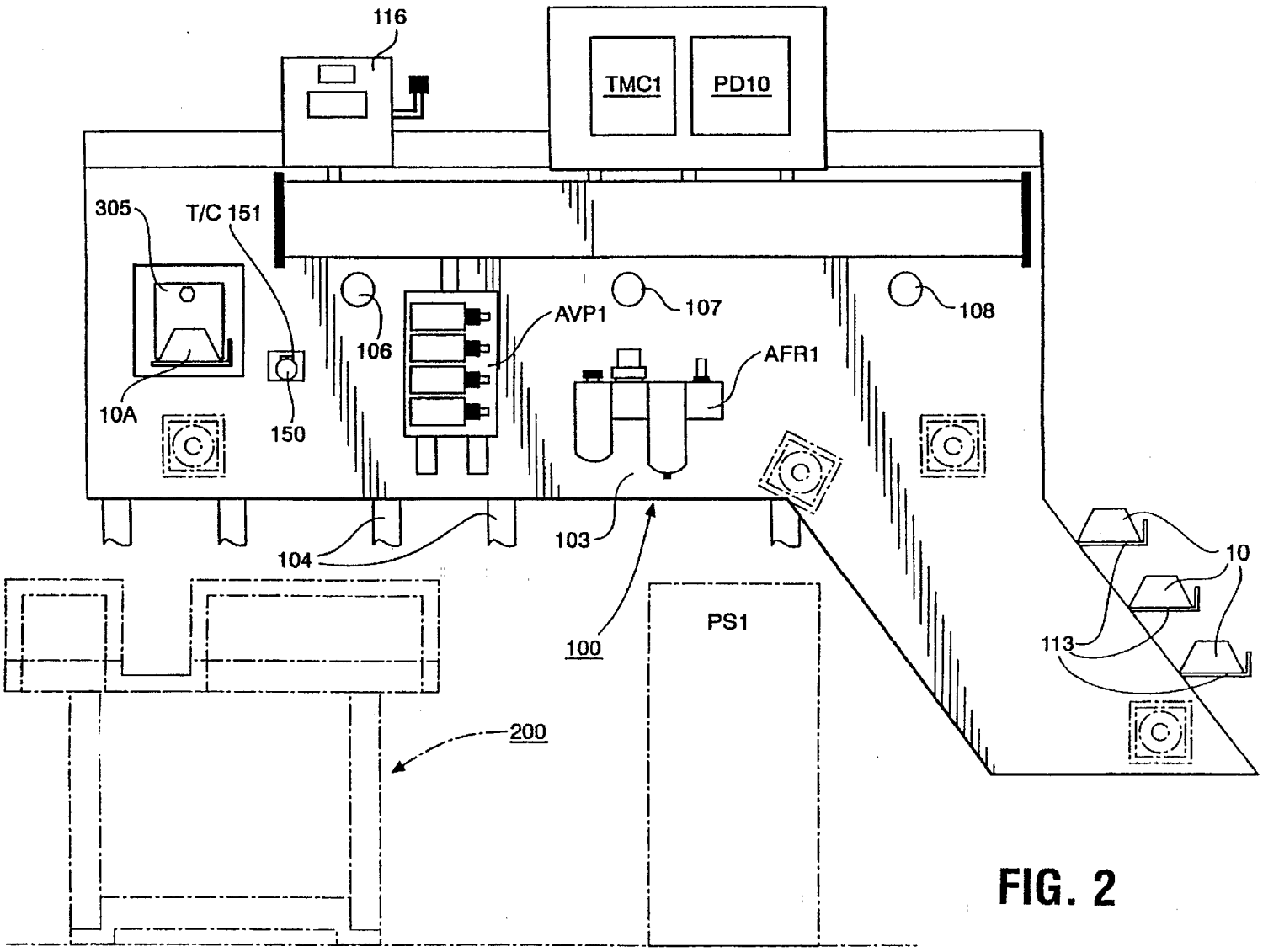
FIG. 2 is a diagrammatic side elevational view.
Figure 2A:
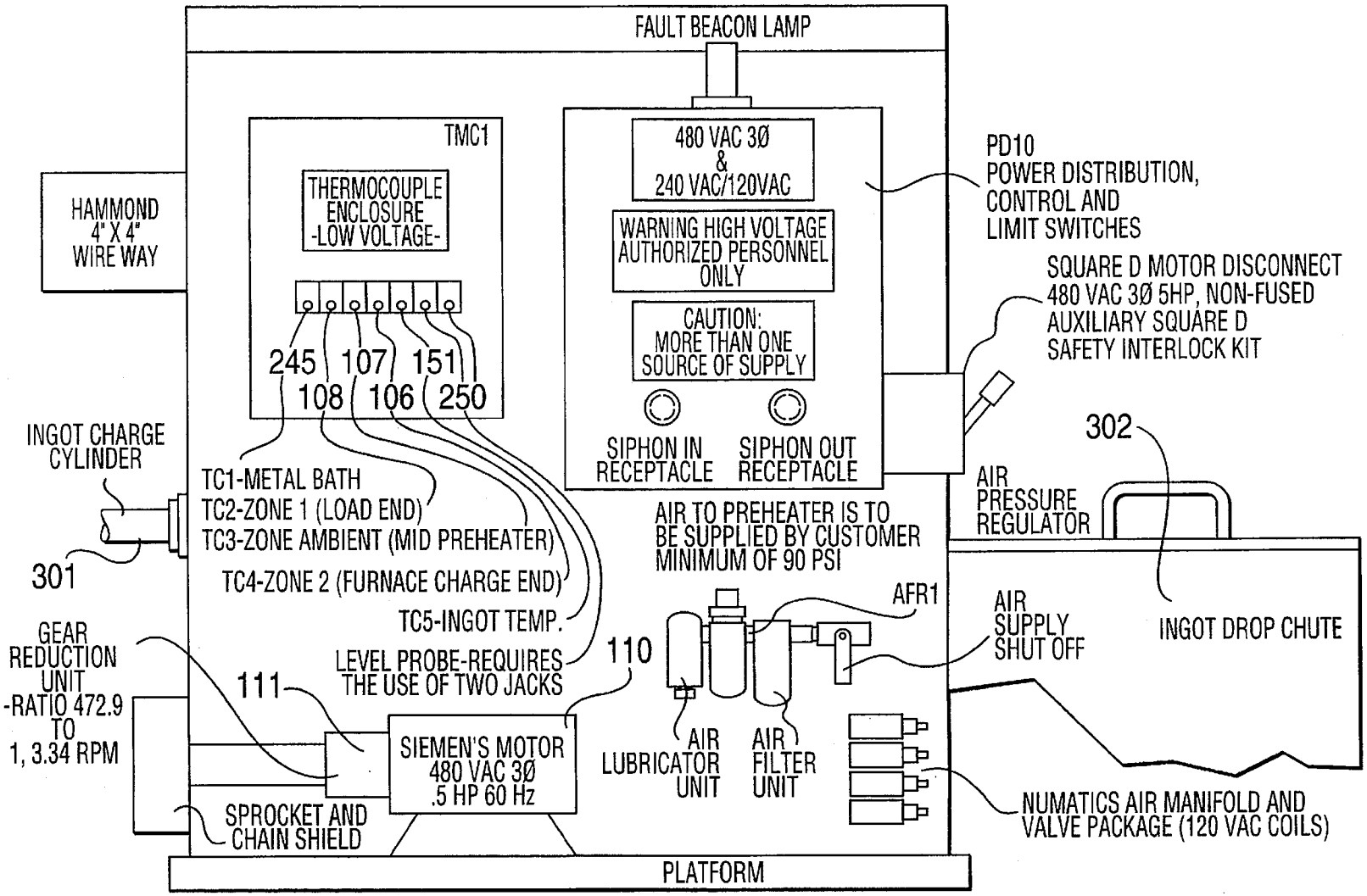
FIG. 2A is a left hand and elevational view of the preheater shown in FIG. 2 but with thermocouple enclosure and power distribution box differently positioned.
Figure 3:
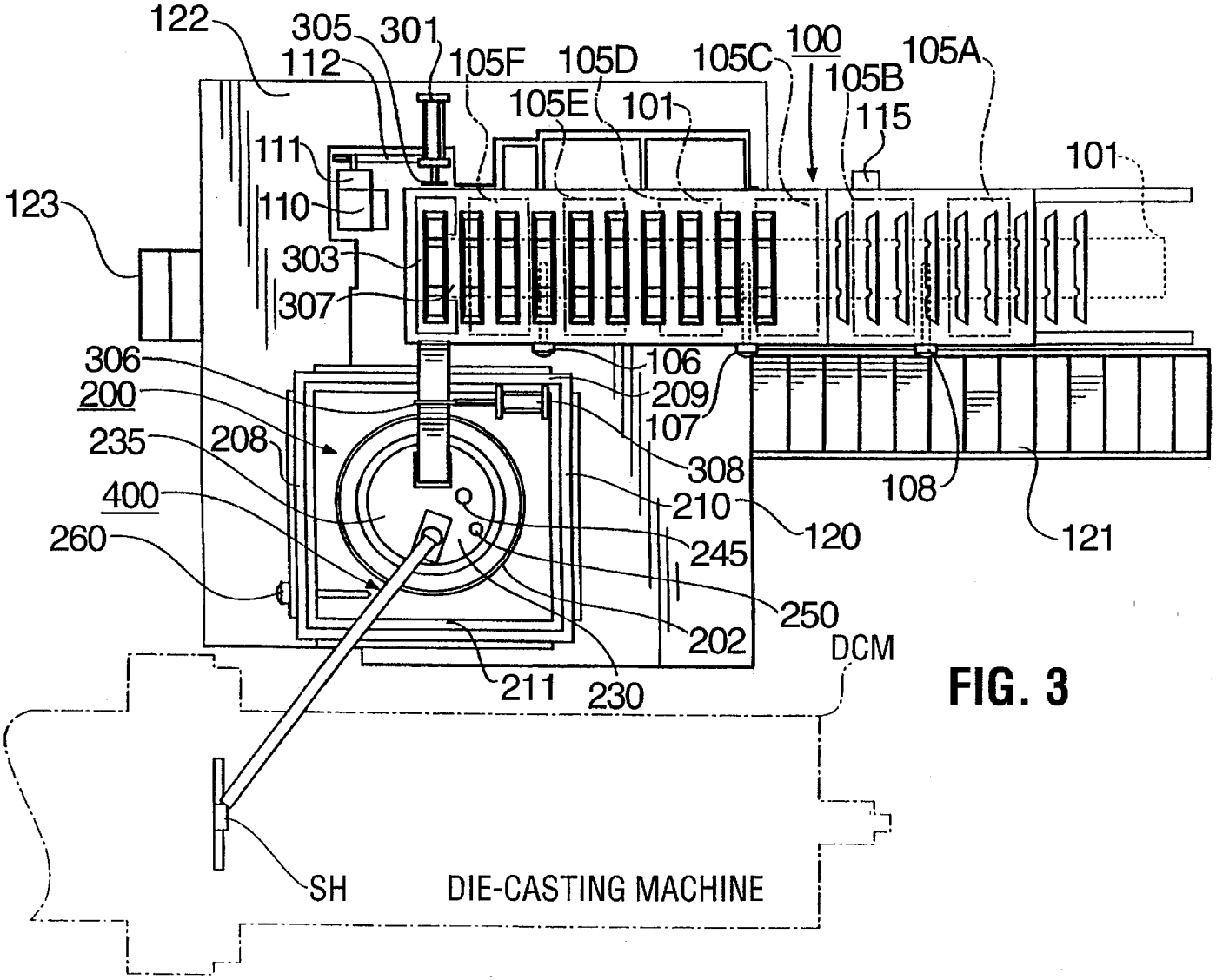
FIGS. 3 and 4 are similar to FIG. 1 but containing further details of the system.
Figure 4:
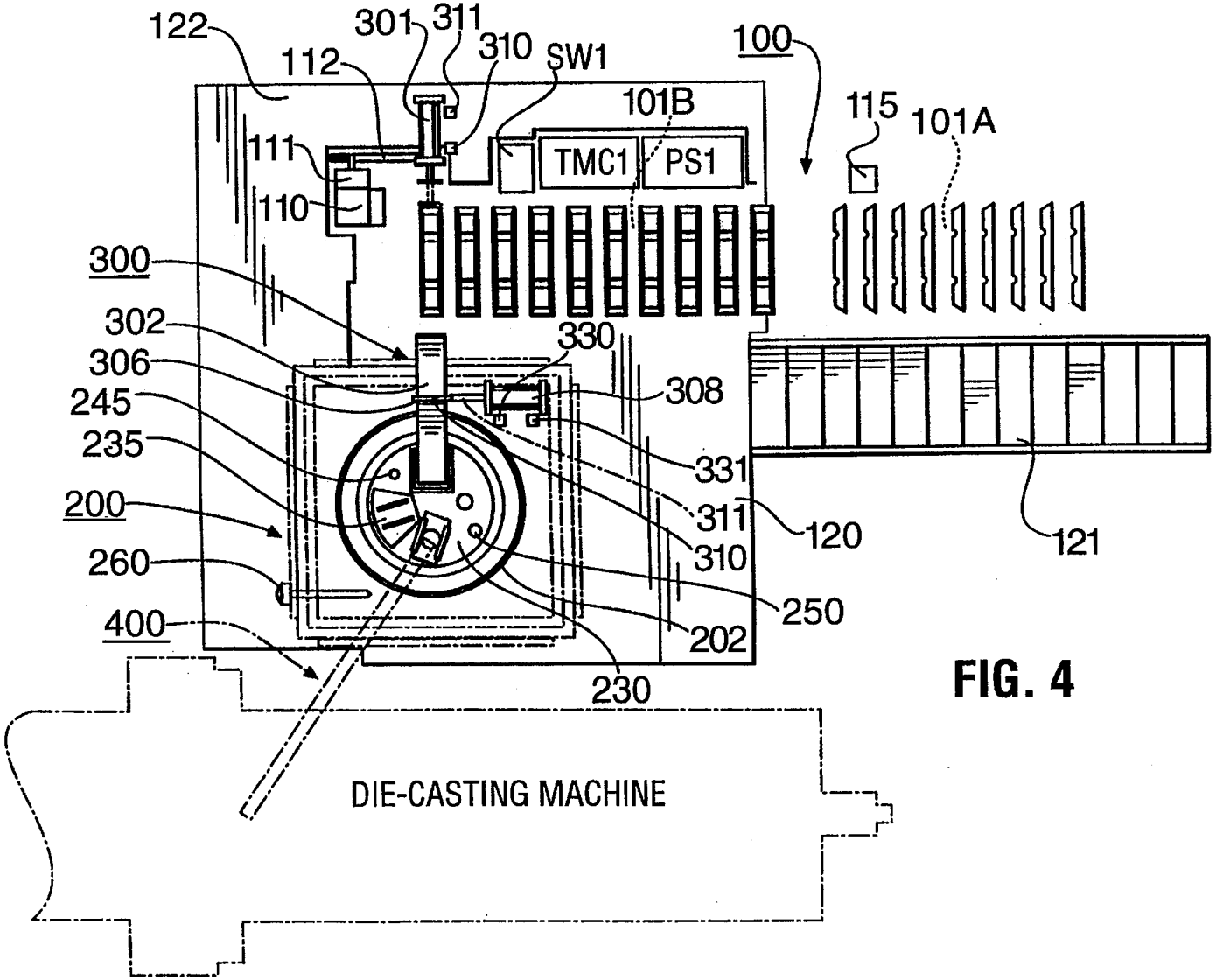

A separate free standing enclosure PS1 is provided for the power supply or it may be mounted on the preheater (see FIG. 4). In this enclosure there is a thermocouple enclosure TMC1, a motor safety disconnect switch 116 (see FIG. 4). Also as seen from FIG. 2 there is mounted on the enclosure an air filter regulator and lubricator assembly AFR1, an air valve pack (120 volt AC) AVP1. An air pressure safety switch (not shown) connected to shut the system down and provide an alarm if the pressure drops below a selected amount e.g. 80 PSI.

There is a first upper observation and service platform 120 with stairs 121 leading up to the same and a second observation and service platform 132 accessed by a ladder 123.

A limit switch (not shown) is located in the preheater enclosure for activation should an ingot drop from the conveyor or become displaced. This limit switch can be connected to cause a system shut down.

Ingot Transfer Unit

The ingot transfer unit 300 is located at the discharge end of the preheater and includes the push rod of air cylinder 301 and the gated inclined drop chute 302. At the end of the push rod there is a pusher plate 305 that engages an ingot 10A disposed in position on a support plate 306 for discharge into the inclined drop chute. The plate 305 passes over the ingot conveyor unload plate 306. The plate 306 has a suitably located cut out 307 therein for the conveyor paddles to pass therethrough leaving the ingot to be charged at an at rest position on the plate. The conveyor is indexed after an ingot charge cycle has been completed. It can readily be programmed to first index and then the charge takes place. The ingot 10A to be charged is pushed by the pusher plate 305 into the incline chute 302 in which there is the guillotine type gate 306 that is controllably moved by the push rod of a pneumatic cylinder unit 308.

In FIG. 1 the guillotine gate 306 and cylinder 308 are shown in their home position in which the piston is fully advanced. After the push rod cylinder 301 has discharged an ingot into the incline chute 302 there is a timer controlled one second delay and then the cylinder rod will retract to the rear proximity sensor 331 thereby opening the gate and allowing the ingot to fall by gravity into the metal bath. After a 1.5 second delay in the retracted position the guillotine will return to the home (advanced) position activating proximity sensor 330. This helps to prevent the loss of mixed $CO_2SF6$ protection gas from the metal bath pot.

Figure 5:
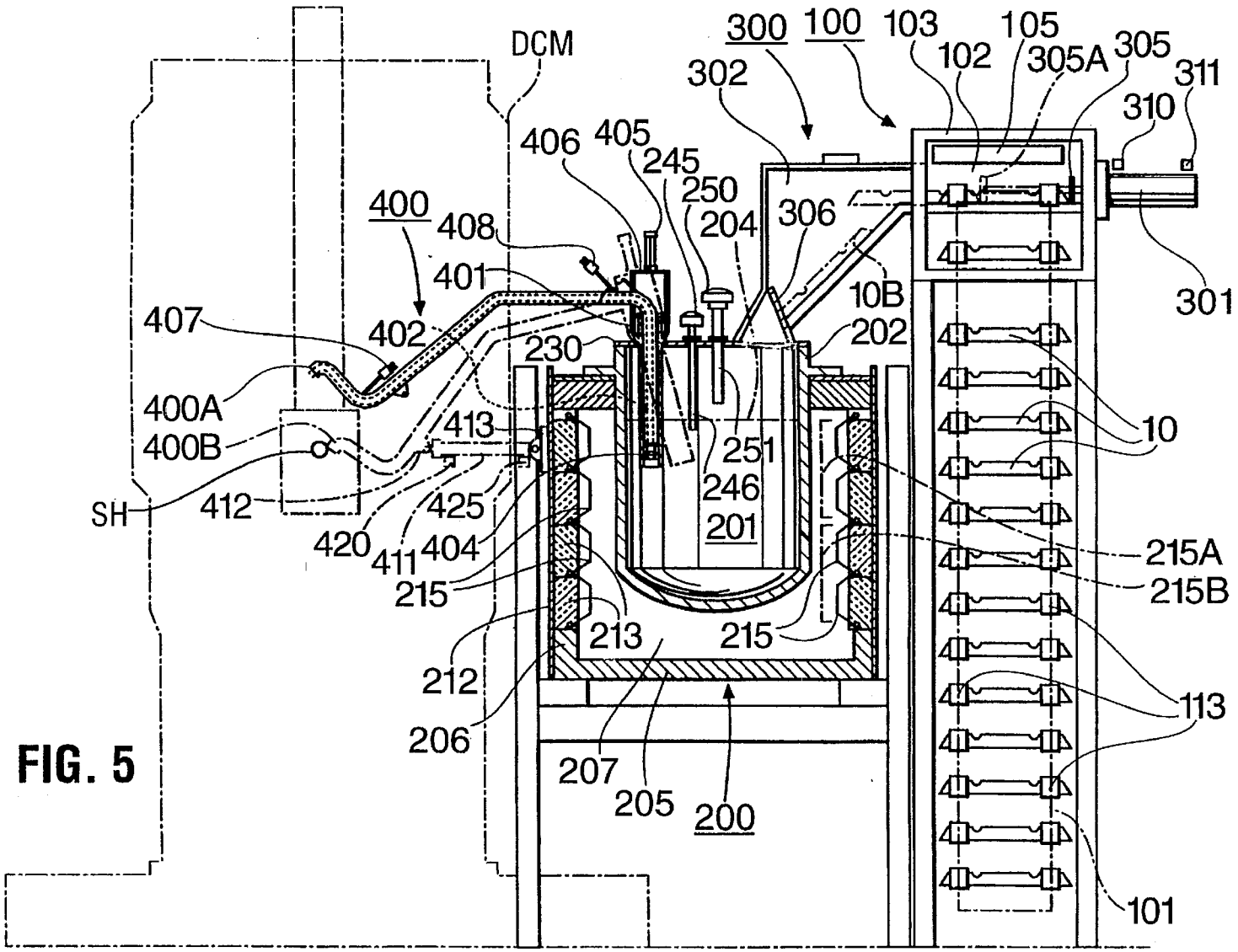
FIG. 5 is a diagrammatic elevational view of the melt system and further illustrates a die cast machine that receives molten metal from the siphon tube.
Figure 7:
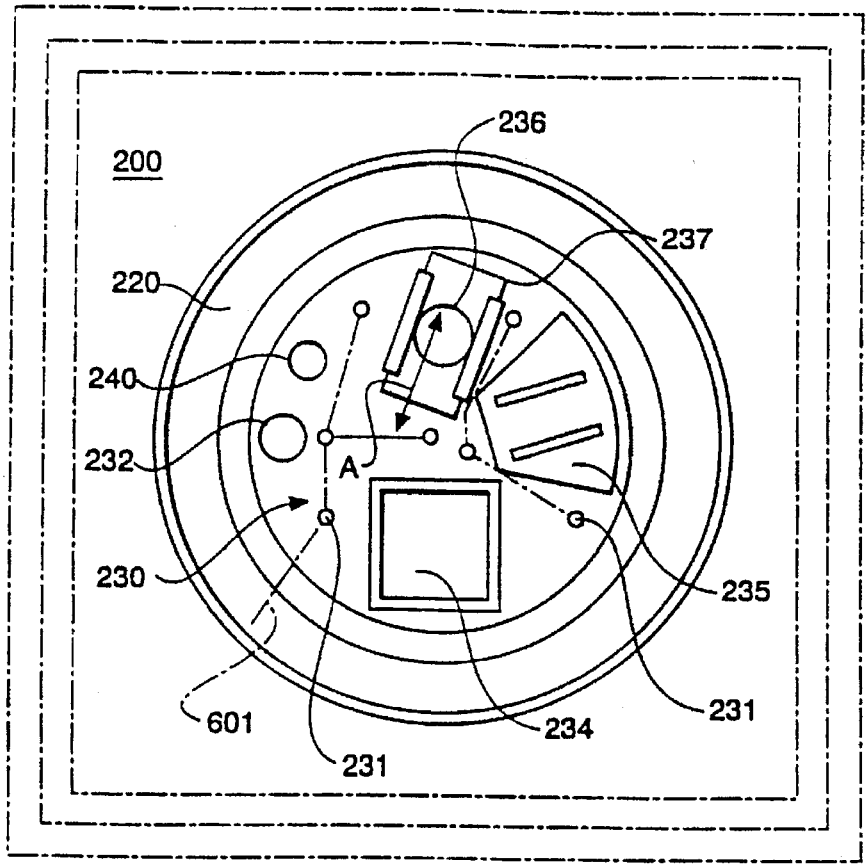
FIG. 7 is a top plan view of FIG. 6 and both include an optional upper service platform.

In FIG. 5 the gate, i.e. plate 306 is shown holding an ingot 10B (previously at the location of ingot 10A) prior to discharge into the molten bath in the furnace. The normally closed gate 306 prevents the gas mixture from escaping from the furnace.

The pneumatic cylinder unit 301 has a push rod advance proximity sensor 310 and a push rod retracted proximity sensor 311 and pneumatic cylinder 308 has advance and retract respective sensors 330 and 331.

Furnace

The furnace 200 is an insulated enclosure having a suitable crucible 202 therein for holding a molten bath 201 of magnesium. Normally there would be about 4,500 lbs. of the molten metal in the crucible. The molten metal has a surface level designated 204.

The furnace has a 6 inch thick castable floor 205 of high temperature resistant material with a 9 inch high, 6 inch wide castable curb 206 extending upwardly from the perimeter of the floor. This provides a containment area 207 for metal.

Figure 16:
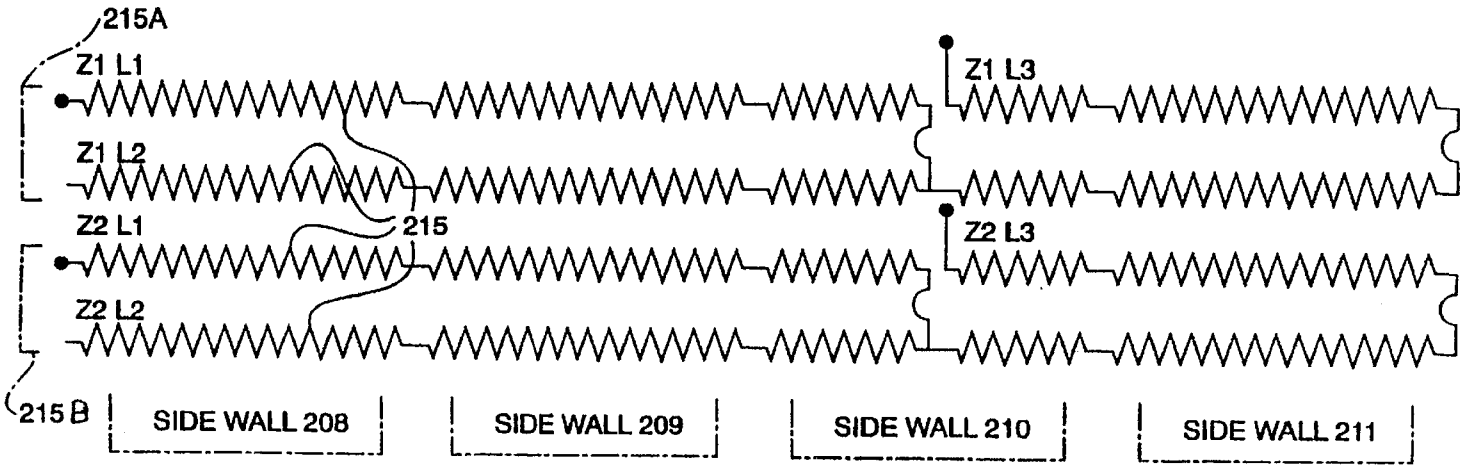

The four walls of the furnace, designated 208, 209, 210 and 211 in FIG. 16, have an outer shell 212 of 3/16th inch steel with the outside corners reinforced by 4 inch angle iron. Inside the steel shell is a 6 inch lining 213 of insulation referred to as "plyo-block" walls.

Figure 8:
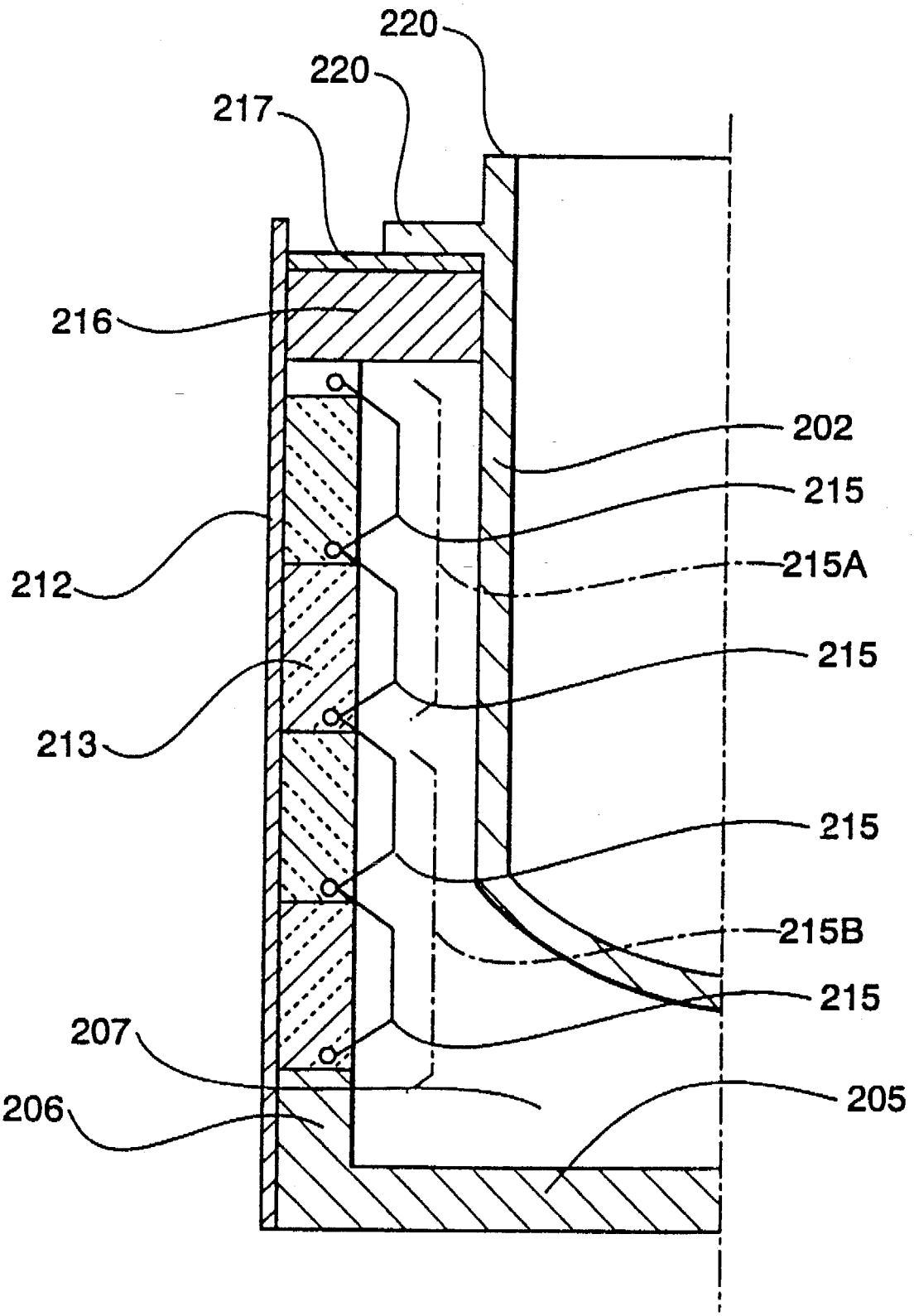
FIG. 8 is a vertical partial sectional view of a portion of the furnace.
Figure 9:
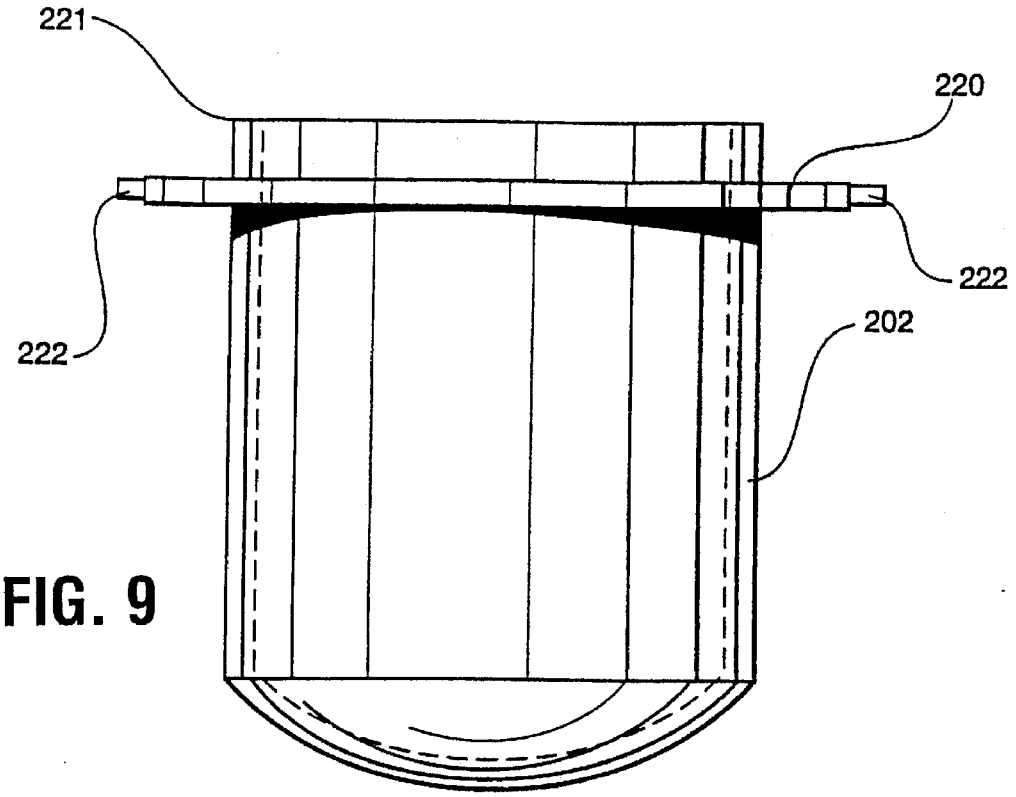
FIG. 9 is an elevational view of the melt pot also referred to as a crucible.
Figure 10:
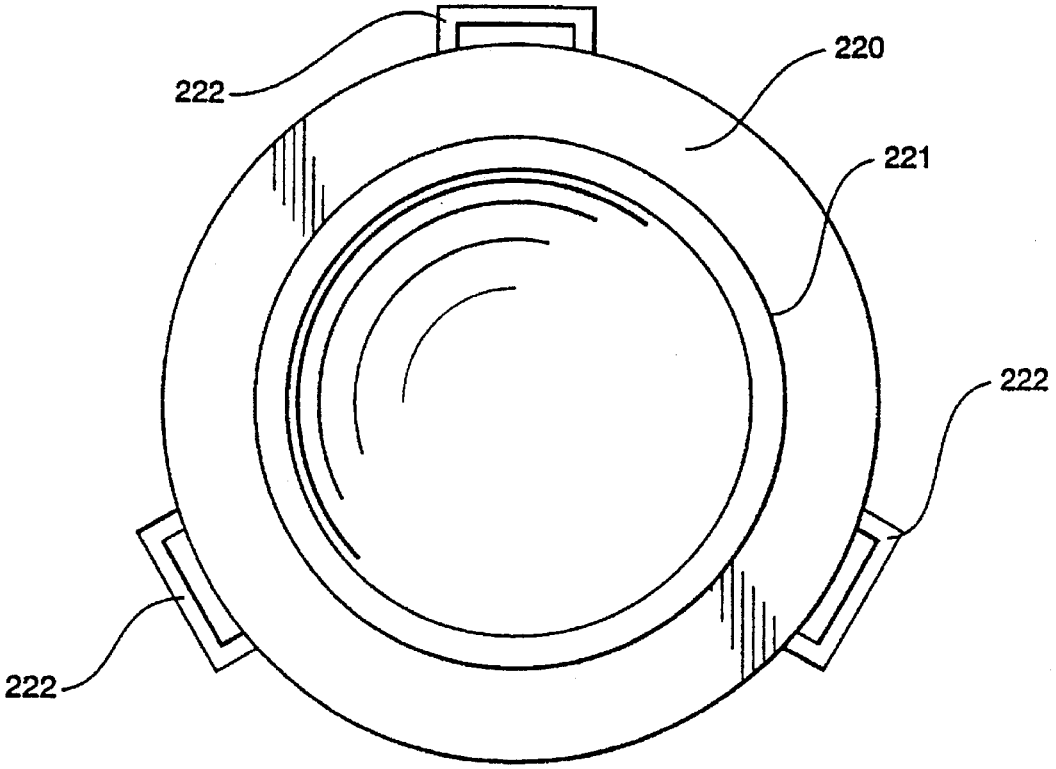
FIG. 10 is a top plan view of FIG. 9.

Each of the four walls has resistor heating elements 215 arranged to provide an upper heating zone 1 designated 215A (see FIGS. 8 and 16) and a lower heating zone 2 designated 215B. The heating elements found suitable are overbend 70% nickel, 30% chromel available from Thermal Ceramics of Augusta, Ga. There are SCRs described hereinafter with reference to the electric schematics providing individual control for the respective zones.

The furnace has a base support and leg structure 216 to keep the furnace off the floor to allow for easy clean up of magnesium dust and fine chips. This also allows access below the furnace in case of magnesium spill from the DCM.

The top of the furnace has a 5 inch thick castable ceiling 216 on which there is a ¼ inch steel top plate 217. Depending from this into the cavity of the furnace is the pot or crucible 202 which has an outwardly directed flange 220 spaced downwardly a selected distance from the upper edge 221 of the crucible. The crucible by way of example has an inside diameter of 33½ inches, an outside diameter of 36½ inches and a total depth of 43 inches with the wall thickness being 11/4 inches. Three crucible lugs 222 are provided which are spaced apart 120° from one another on the flange 220.

Mounted on top of the crucible or pot is a pot lid 230 in which there are a plurality of drilled and tapped holes 231 for ⅜ inch NPT pipe fittings. These drilled openings 231 provide gas line connections for supplying $CO_2SF6$ via piping 601 to the furnace from a suitable supply 600A. There is an opening 232 in the lid for a liquid level probe 250. There is an opening 234 in the lid for the discharge end of the inclined gated chute 302 and a lid and opening 235 for dross removal by the operator. There is an opening 236 for the siphon tube in an adjustment plate 237 mounted on the lid for movement back and forth in the direction of the double headed arrow A for adjusting the location of the siphon tube. There is an opening 240 in the lid for a metal bath thermocouple 245.

Figure 6:
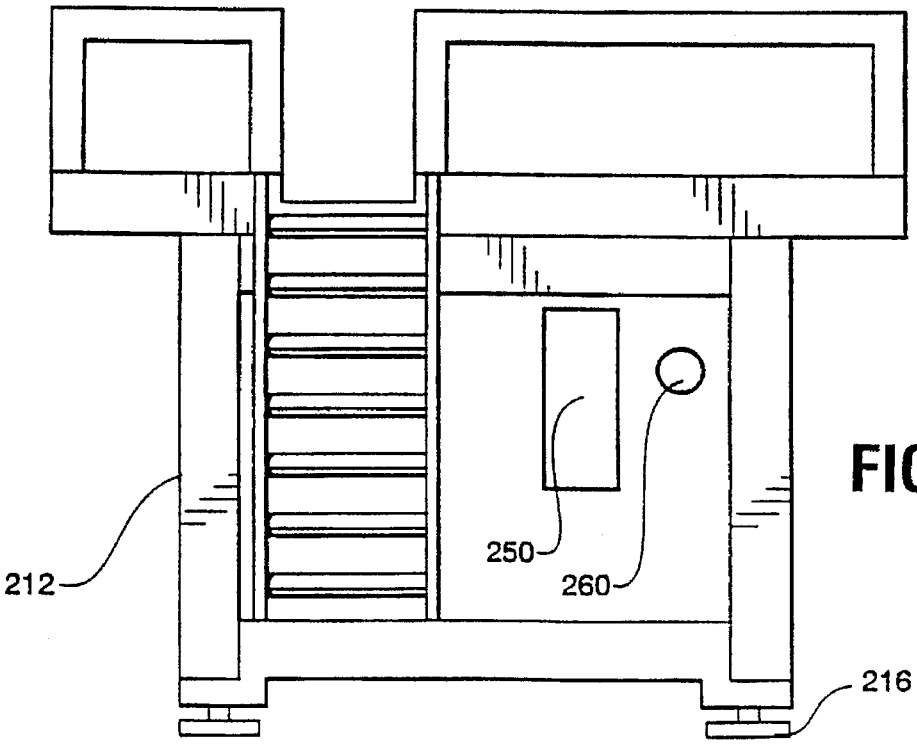
FIG. 6 is a diagrammatic elevational view of the furnace illustrating certain features thereof.

Shown in FIG. 6 is an electrical connection enclosure 250 as being one of two connection enclosures for feeds from zone 1 and zone 2 SCR firing boards C1 and C2.

The furnace has the above mentioned thermocouple 245 for monitoring the metal bath temperature and a second thermocouple 260 on the outer shell which measures the outer shell temperature.

Mounted in the opening 240 in the lid is the thermocouple 245 which has a probe 246 that projects the open metal bath.

A metal level probe detector 250, mounted in the lid opening 232, has a probe 251 that projects into the molten metal in the crucible. A state of the art proven metal level probe is used in the present system which is available from Carli Electro Automation GmbH. The probe measures the metal level with accuracy of about two decimal points. The metal level value is used as part of the closed loop PID calculation for metal bath temperature and determining the optimum temperature for the preheater ambient temperature. The metal level is monitored by the machine program for a process control information and for function.

Figure 11:
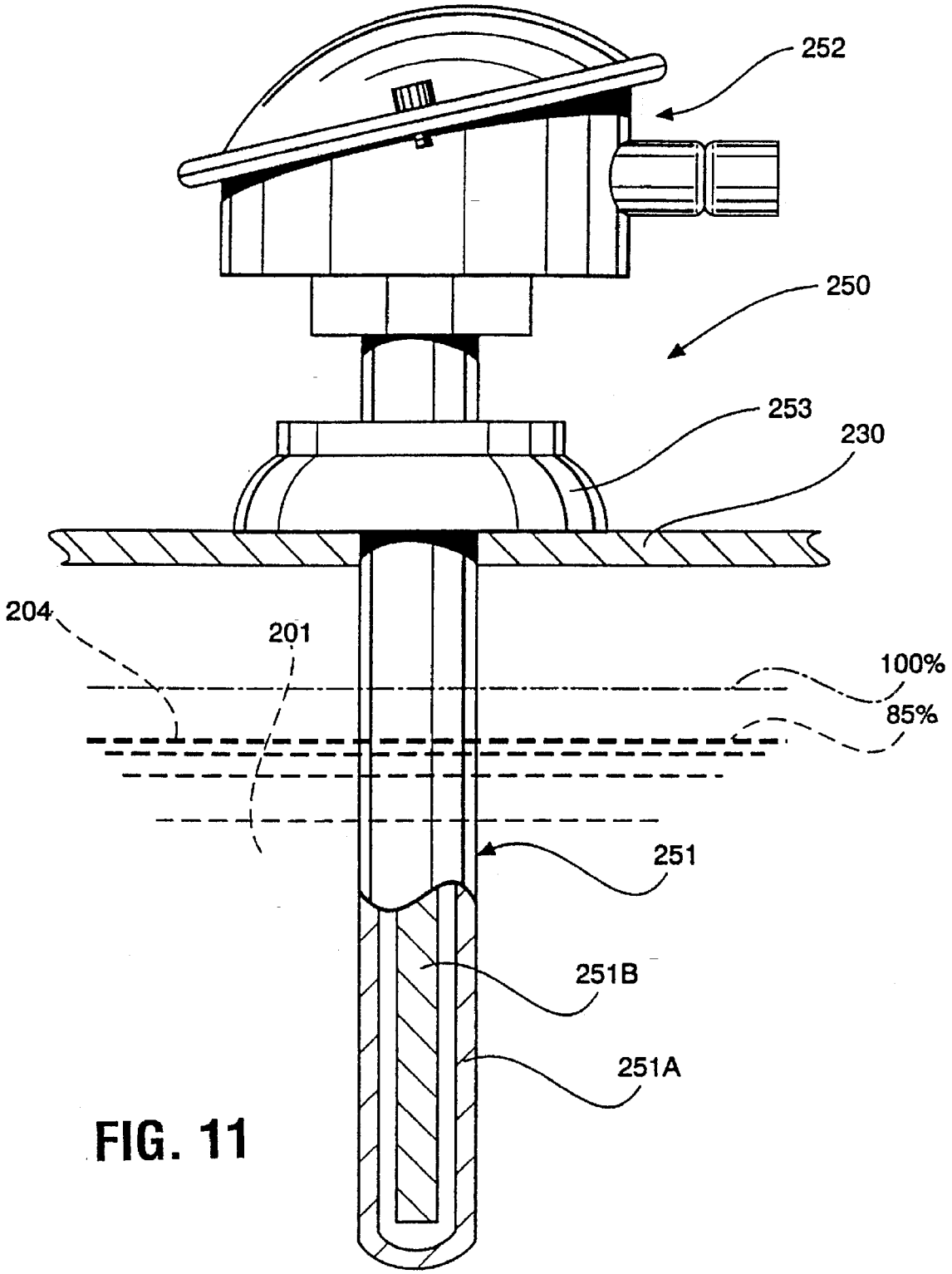
FIG. 11 is an enlarged elevational view of the metal level probe that projects into the furnace.
Figure 12:
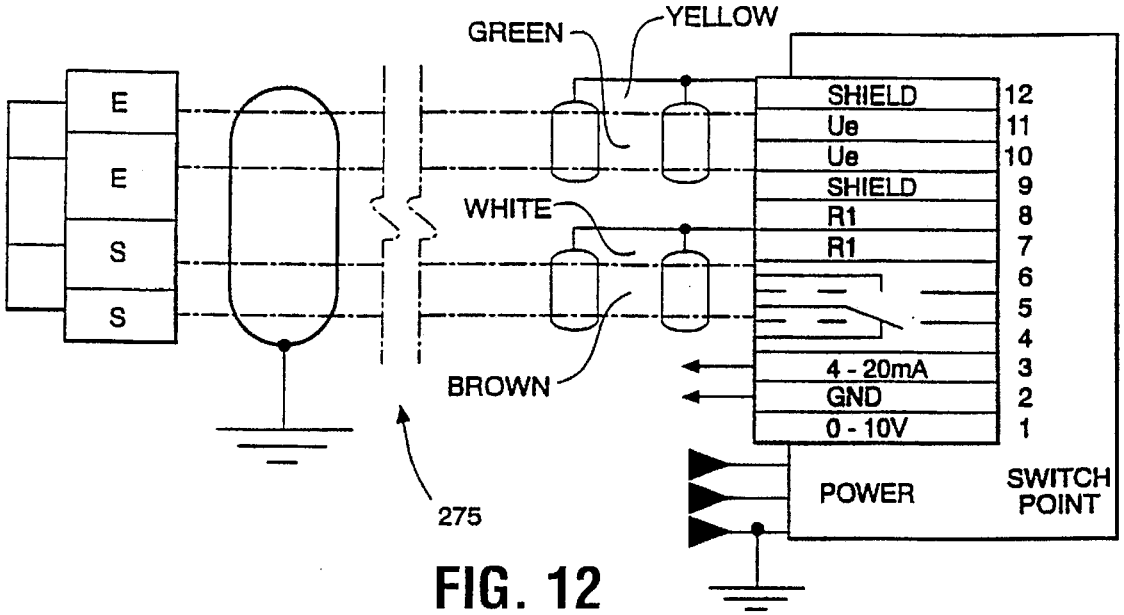
FIG. 12 is an electric schematic for the probe.
Figure 13:
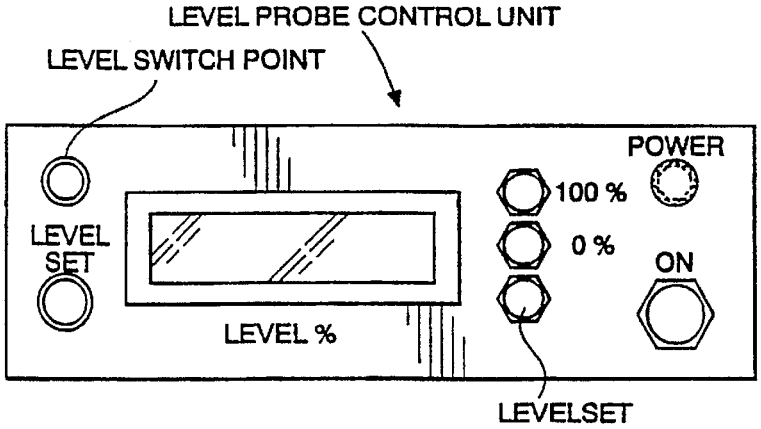
FIG. 13 is a face portion of the level probe control unit.
Figure 15:
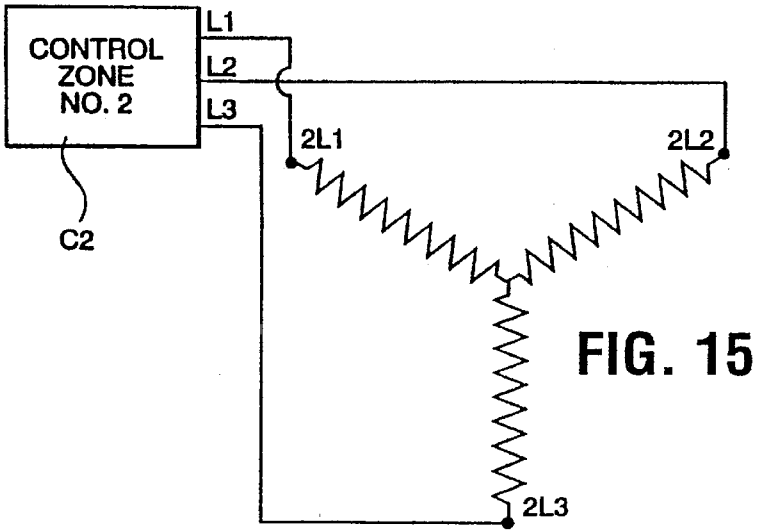
FIGS. 14, 15 and 16 are electrical schematics of the electrical system of the furnace.
Figure 14:
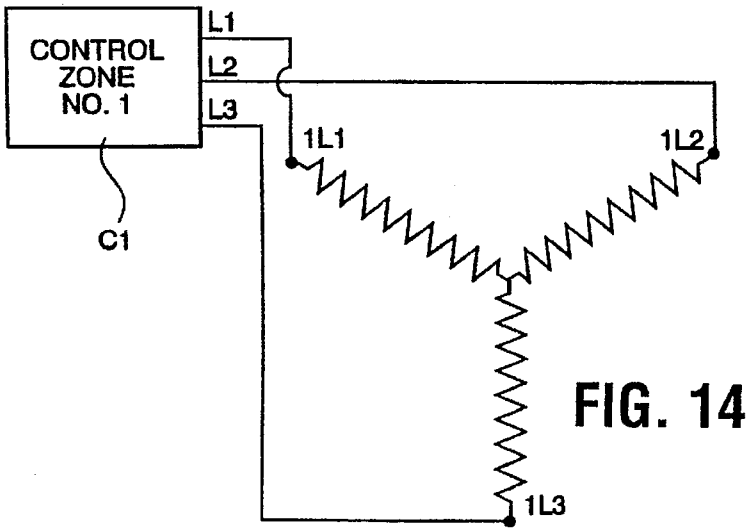

The metal level measuring probe is shown in FIG. 11 with the electrical connections therefor shown in FIG. 12.

Referring to FIG. 11 the metal level probe 250 has the probe 251 that projects into the molten metal within the furnace, a probe head 252 external to the furnace and a collar 253 for mounting the probe on the pot lid 230. The probe 251 has an outer stainless steel protective tube 251A and an inner measuring probe 251B protected by the outer tube against direct contact with the liquid metal. The inner probe 251B has two sets of windings one being of transmitter winding and the other a receiver winding surrounding a ceramic tube.

The probe must be mounted so as to be completely vertical, relative to the liquid metal free surface level. By way of example the probe length from the terminal head to the free end of the probe in the metal is approximately 31 inches and the lower 16 inches of this is where the actual values that are being used come from. For operation the probe is set for 100% at the 16 inch from the tip and 0% at the tip. The metal level 204 normally is about 85%.

A special cable 275 (see FIG. 12) is used to connect the probe sensor terminal head to a control unit 250A in the thermocouple enclosure. The control unit requires 110 VAC 1 phase supply. The unit transmits a signal to the probe which is altered by the amount of liquid magnesium it senses through heat transfer. This signal, after being received is converted to a valve in the 4 to 20 mA range which is then taken to the analog input module 580 of the PLC 574.

Positioning and calibration of the probe is important and further details of this can be obtained if need be from the supplier of the probe. Prior to the first start up of the apparatus the dry probe is set for 0% and the wet probe for 100% and the adjustment for the switch point is made according to specifications obtainable from the manufacturer. In the measuring range, i.e. the indication of 0 to 100% provides a linear signal output to a control box which in turn provides an output signal current 4 to 20 milli amps to the PLC (1FE module), (output voltage 0 to 10V DC). Adjustment prior to use is by trimming potentiometers and thereafter during operation the level is about 85.5 with 100% being about 3 inches higher.

Siphon Tube

The siphon tube, known per se, designated 400 is mounted on the metal pot lid 230 via the mounting plate 237. The siphon tube (see FIG. 18) basically has a head portion 401 mounted on the furnace lid, a suction tube portion 402 that projects into the molten bath in the furnace and a delivery tube portion 403 for delivery of molten magnesium to the shot hole SH of the die casting machine (DCM). On the lower end of the suction tube 402 there is a tube check valve 404 and in the head there is a siphon valve open cylinder 405. In the head 401 there is also a siphon valve open limit switch 406. On the siphon tube near the head 401 there is a siphon inlet thermocouple 407 and near the outlet end is a second or siphon outlet thermocouple 408.

The ball valve 404 includes a valve seat that is movable away from and toward the ball 404 by the cylinder 405 respectively to close and open the valve. The ball check valve serves two purposes the first being to permit magnesium liquid flow to the DCM and the second to prevent the standing liquid magnesium in the tube from draining back into the metal bath when the siphon tube is in the raised or home position.

The siphon tube is moved from a raised position 400A to a lower or pour position 400B by a pneumatic cylinder 411 connected at one end thereof to the siphon tube by a swivel joint 412 and at the other end by a swivel joint to a slide adjustment plate 413. The slide adjustment plate 413 is mounted on the outer face of one of the furnace walls. There is, operational with respect to the air cylinder position, a tube raised proximity sensor 420 and a tube lowered proximity sensor 425.

Figure 18:
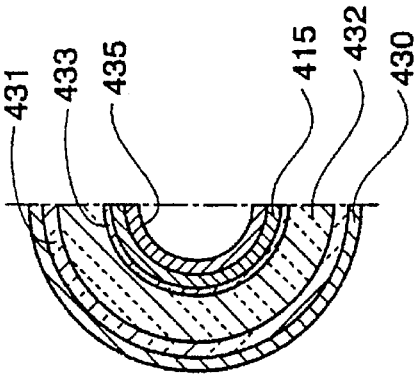
FIG. 18 is a sectional view essentially along line 18—18 of FIG. 17.
Figure 17:
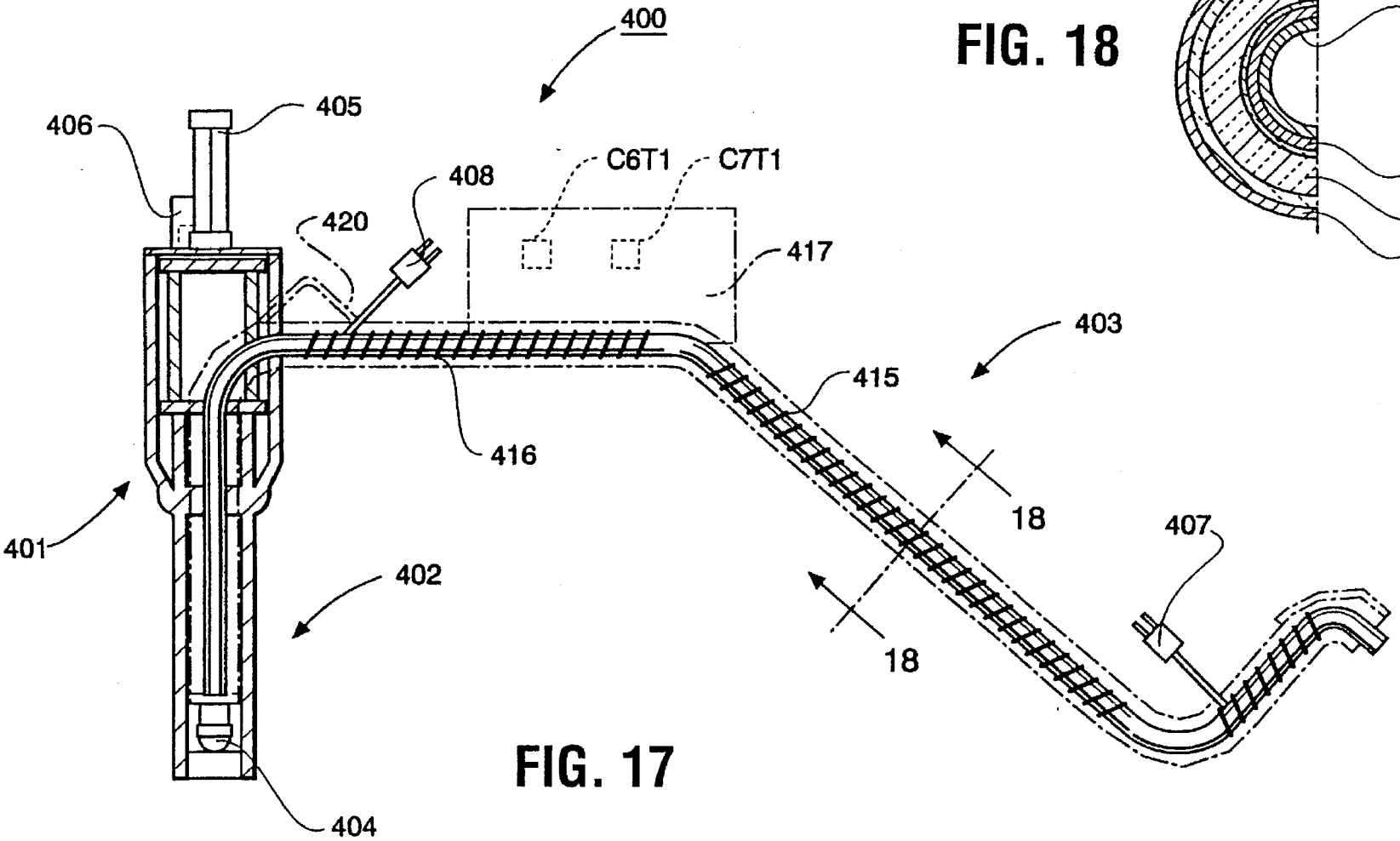
FIG. 17 is an elevational view of the siphon tube.
Figure 19:
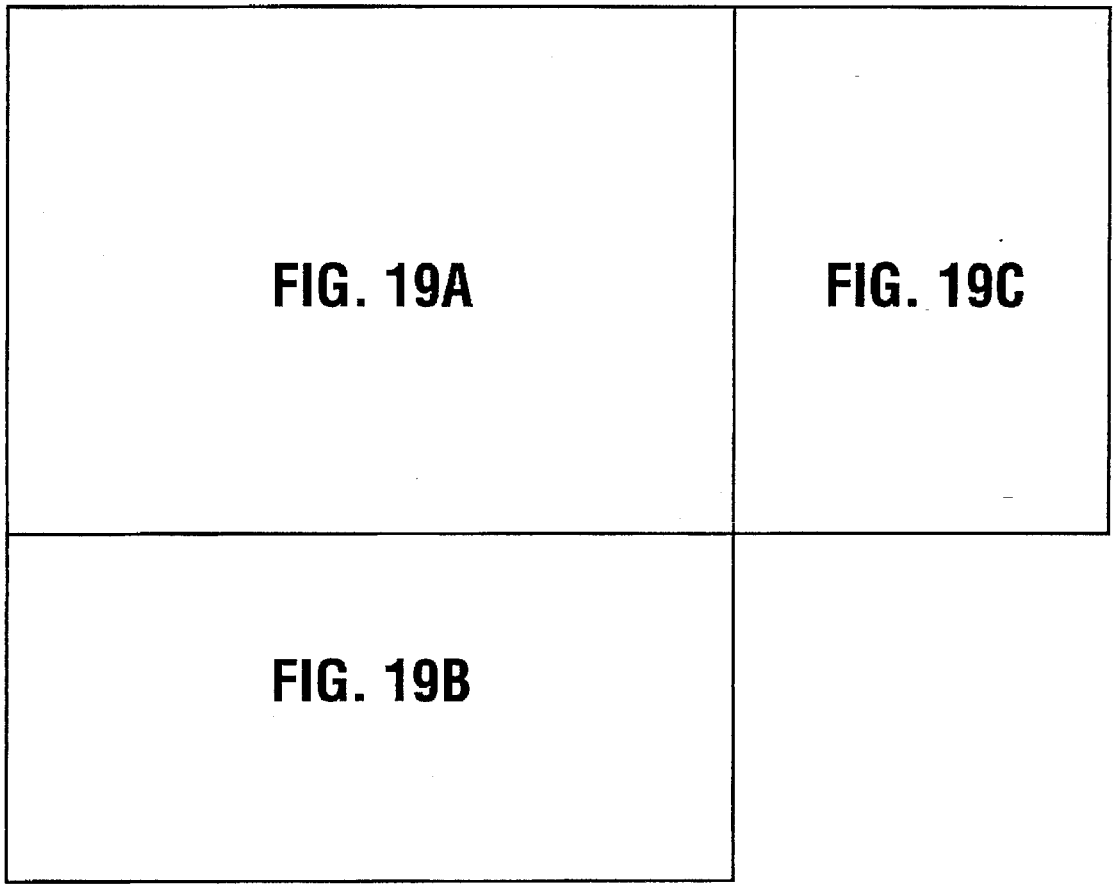
FIG. 19 is an electrical schematic for the apparatus.
Figure 19B:
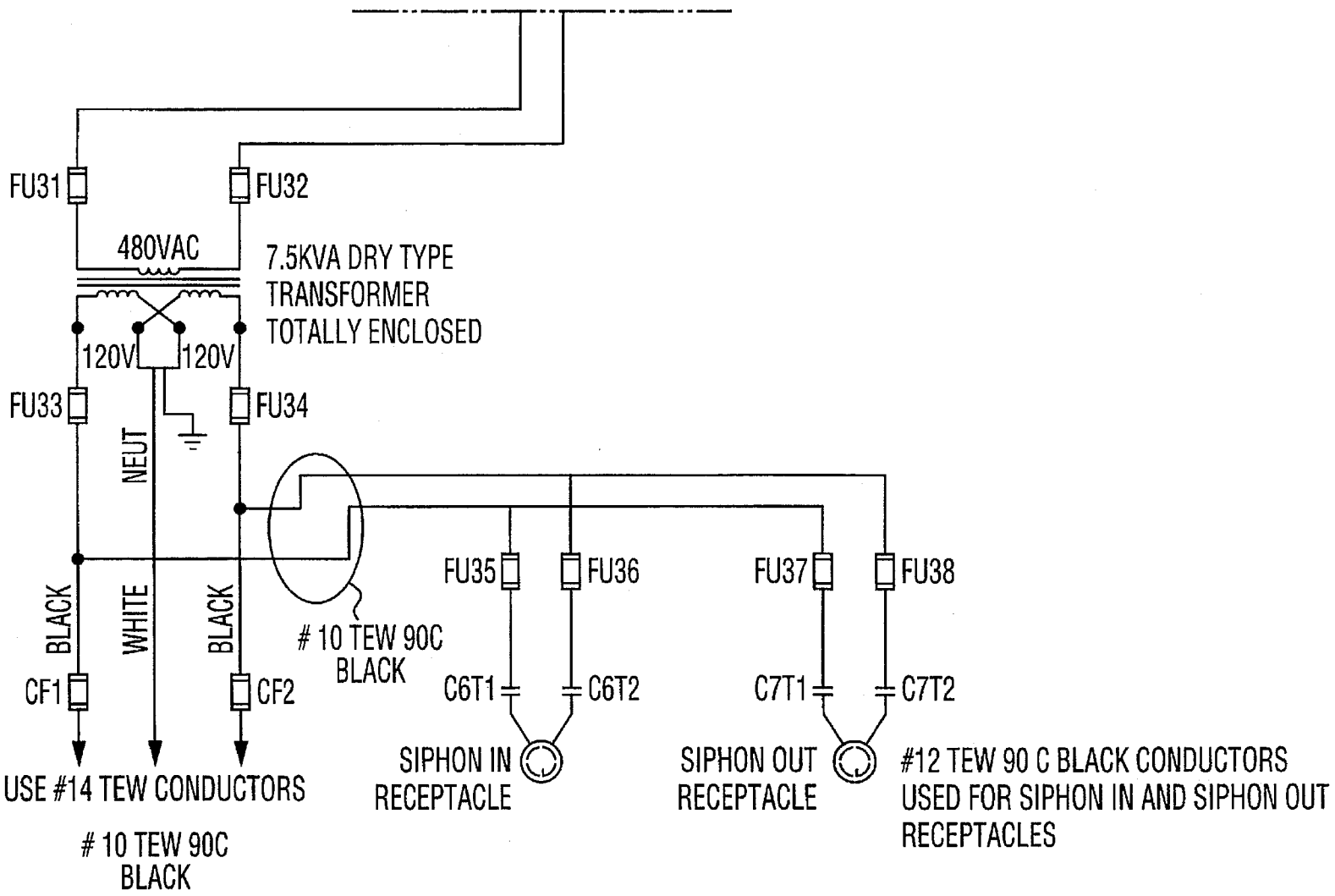
Figure 19C:
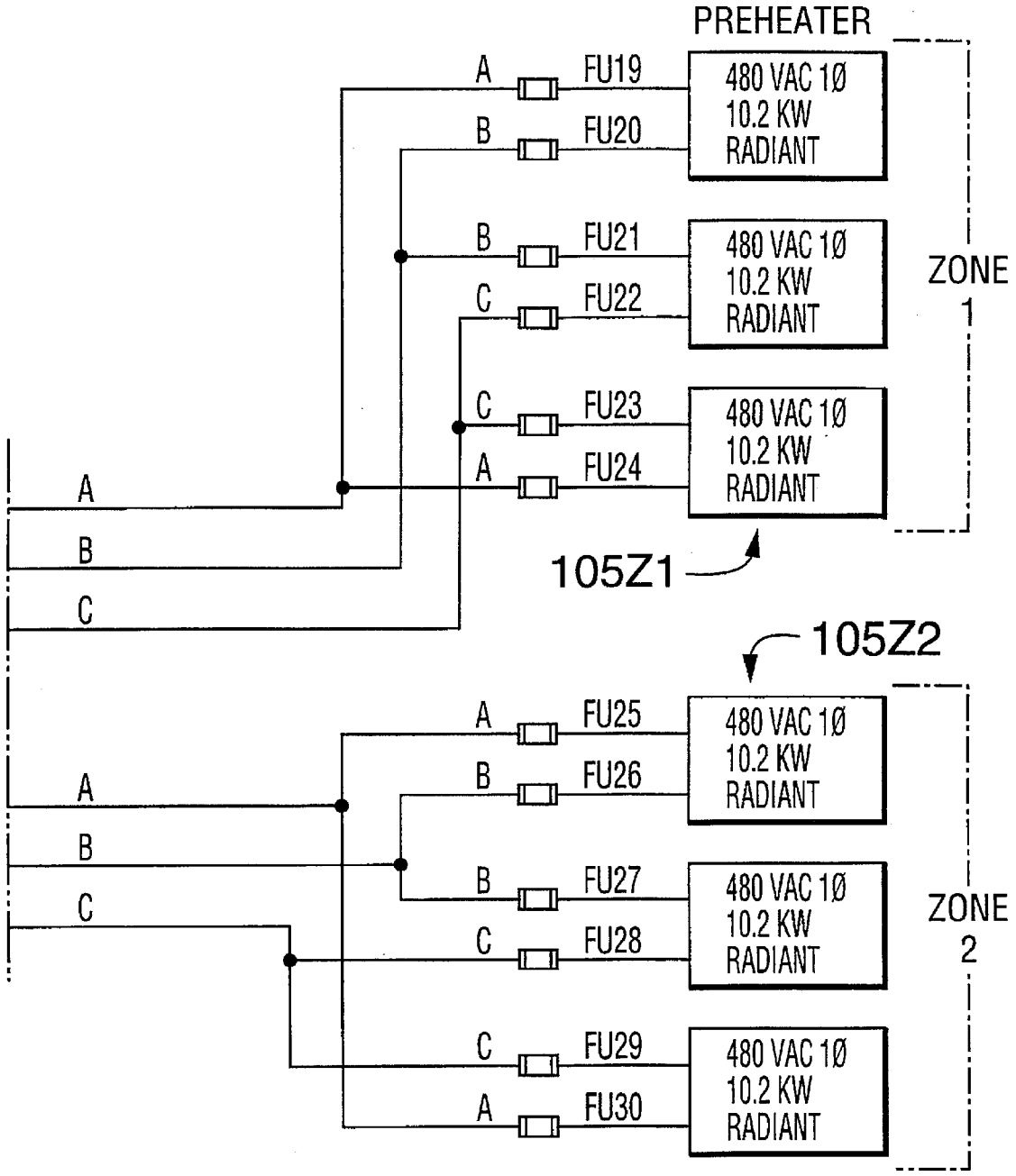

The siphon tube 400 is shown in greater detail in FIGS. 18 and 19 and in FIG. 5 there is diagrammatically illustrated the siphon tube on the furnace in each of two different positions one being a raised at rest home position and the other a lower charge position for charging the shot sleeve of the die cast machine.

The siphon tube has an outer (discharge) end heating element 415 and an inlet end heating element 416. Each of these heating elements are 220 VAC, 3,840 watts and are connected by way of heater element high temperature pyratamic cable set in a connection box 417.

The thermocouples 407 (inlet end) and 408 (outlet end) are K-type thermocouples. Thermocouples 407 and 408 monitor the temperature of the magnesium by conduction through the siphon inner tube. Temperature value from 408 and 407 are used in the PLC program to control power to the siphon inlet and outlet elements. The temperatures are also monitored in relation to the process as well as being monitored for fault condition. The respective temperatures are displayed on the operator computer interface (Panelview) to be described hereinafter. The siphon inlet and outlet temperature preset is entered via the operator interface. For handling the unit there is provided a lifting lug 420.

A section through the siphon tube is illustrated in FIG. 19 and consists of an outer tube 430 with a ⅛ inch thick paper insulation layer 431 on the inside, a glass or ceramic insulation 432, a paper layer insulation 433, a heating element 415 and an inner tube 435.

The siphon valve open limit switch 406 is used to give two individual signals to the PLC program:

(a) the siphon valve is closed;

(b) the siphon valve is open.

This limit switch is monitored for fault and cycle conditions. Relevant safeties involving safety timers in the PLC program monitor this limit switch at all times.

Gas Distribution and Supply

The gas distribution and supply 600 includes a $CO_2SF6$ mixed gas balancing unit. There are two separate control assemblies and distribution designated respectively 600A and 600B (FIG. 1) one being used to control the mixed gas to the metal bath via conduit distribution means 601 to ensure that atmosphere in the melt bath pot is free of oxygen and the other unit is used to supply and control the mixed gas to the outlet end of tube via distribution conduit 604 to prevent the magnesium at the outlet end from starting to burn.

System Operation

Preheater (100) and Ingot Charge (300)

In the auto mode the following is a brief description of the system ingot charge:

(1) Metal level in pot is low enough to require an ingot charge which is requested by the metal level probe 250 and the PLC logic controller of the control system 500;

(2) Loaded ingot conveyor indexes one position through the preheat chamber 102 and the ingot conveyor control resets to home position;

(3) Ingot 10A that is in the charge position (and has been heated to temperature preset by the preheater—max. 250° C.) is advanced by push rod cylinder 301 with there being verification of ingot temperature by an infra-red sensor or contact thermocouple 151 and the ingot drops into chute 302. The ingot (then designated 10B in FIG. 5) is held by the gate 306. Push rod cylinder 301 as it advances it activates proximity sensor 310;

(4) After a delay (about 1.5 secs. after push rod cylinder 301 makes proximity sensor 310), the gate 306 will open allowing the preheated ingot to drop into the molten metal in the pot. The gate is opened by retracting cylinder 308 which activates sensor 311. There is a dwell period controlled by a dwell timer (PLC Programmer) of about 1 second in the gate open position;

(5) The gate will close by advance of cylinder 308 which activates sensor 310;

(6) After the gate has closed, the pusher 301 will retract (proximity sensors 310 and 311 activated by push rod cylinder 301 and proximity sensors 330 and 331 by pneumatic cylinder 308);

(7) Preheat conveyor sees that it is clear to advance ingots one position, will then advance the one position;

(8) If the Die Cast Machine is requesting a metal pour, the above sequence is kept in a hold mode to allow the siphon tube to cycle and complete the metal pour. An ingot cannot be charged while the siphon tube is in cycle with DCM. Upon siphon cycle complete the ingot charge will continue if called for.

Figure 20:
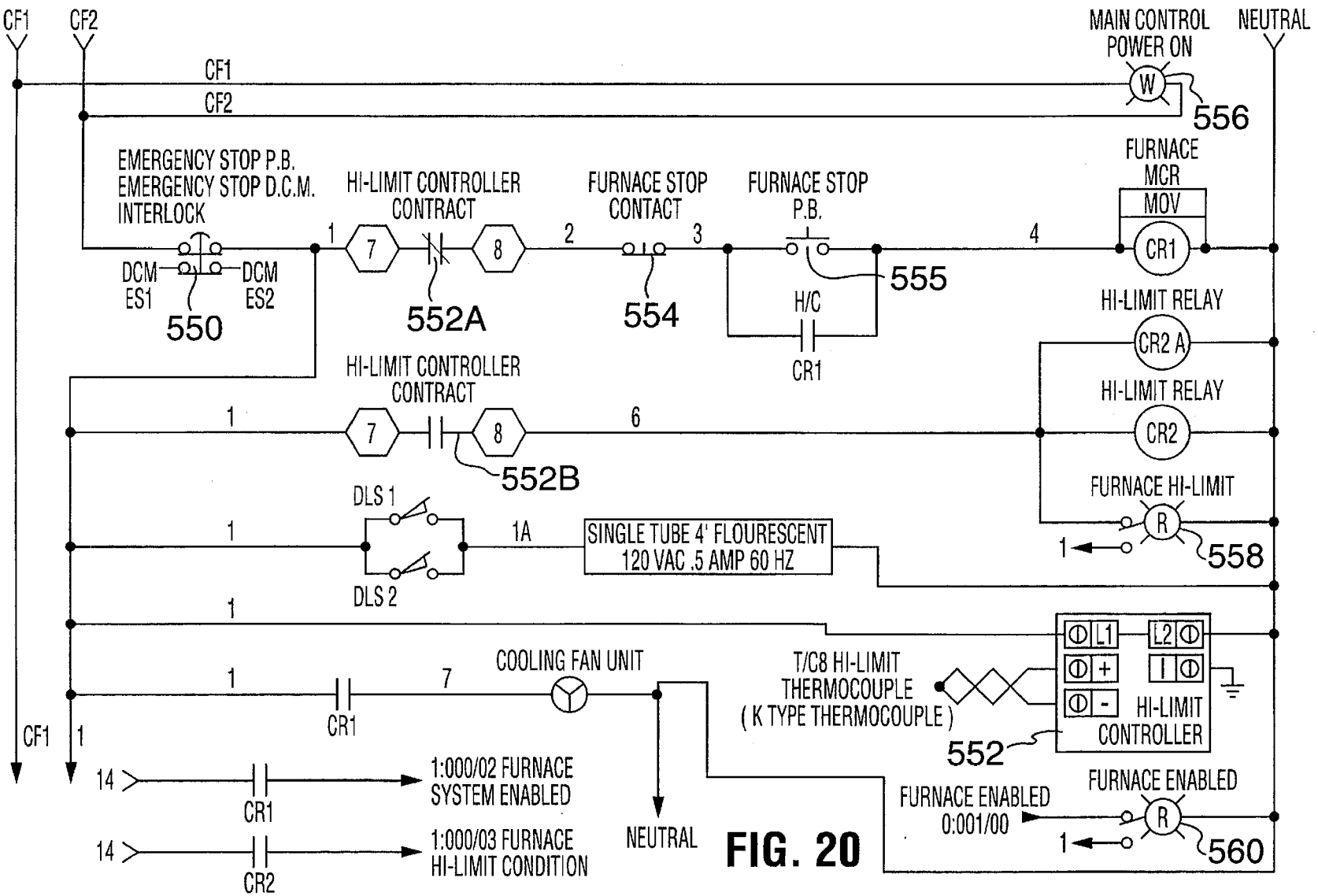
FIG. 20 is a continuation of the schematic of FIG. 19.
Figure 21:
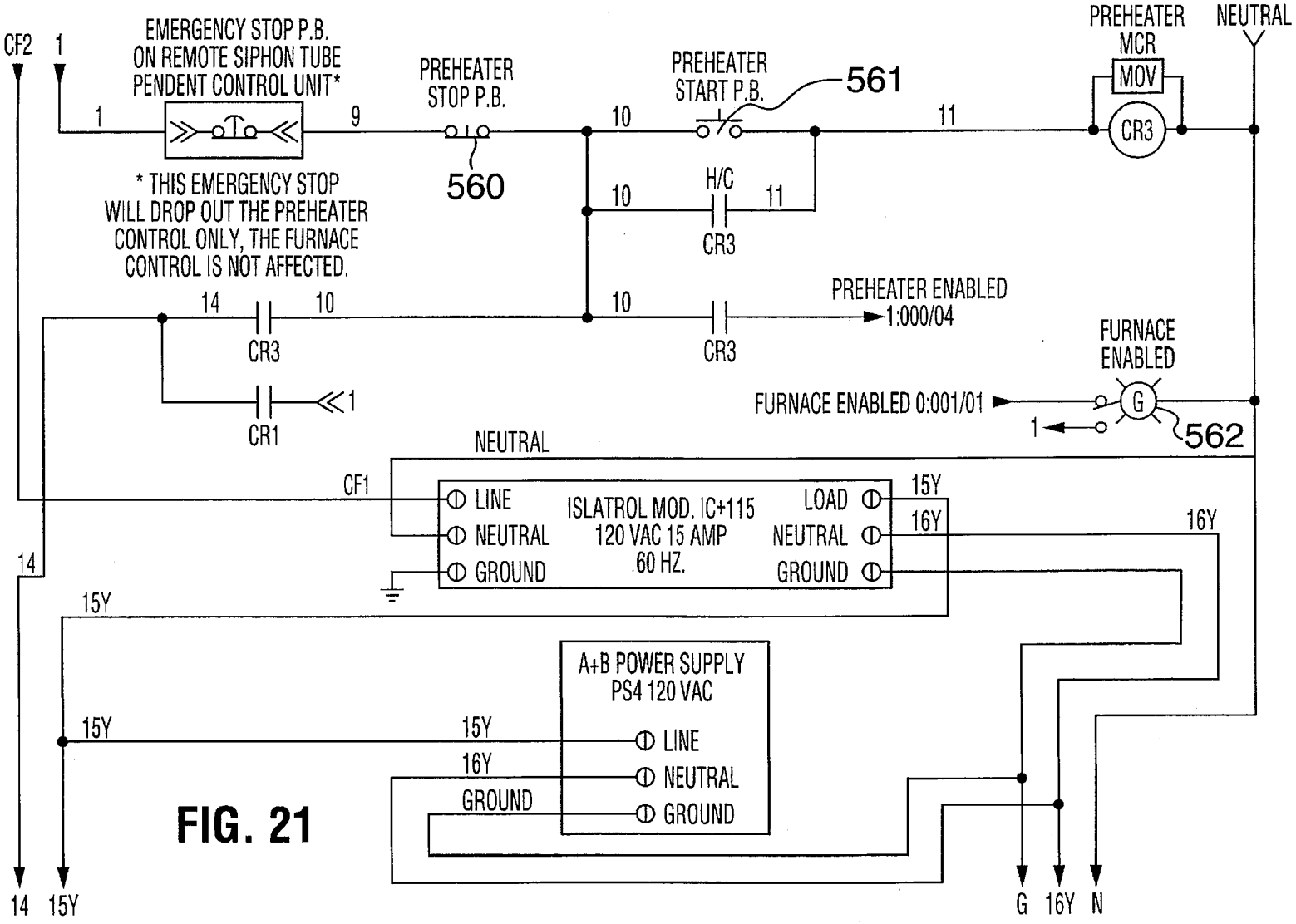
FIG. 21 is a continuation of the schematic of FIG. 20.
Figure 30:
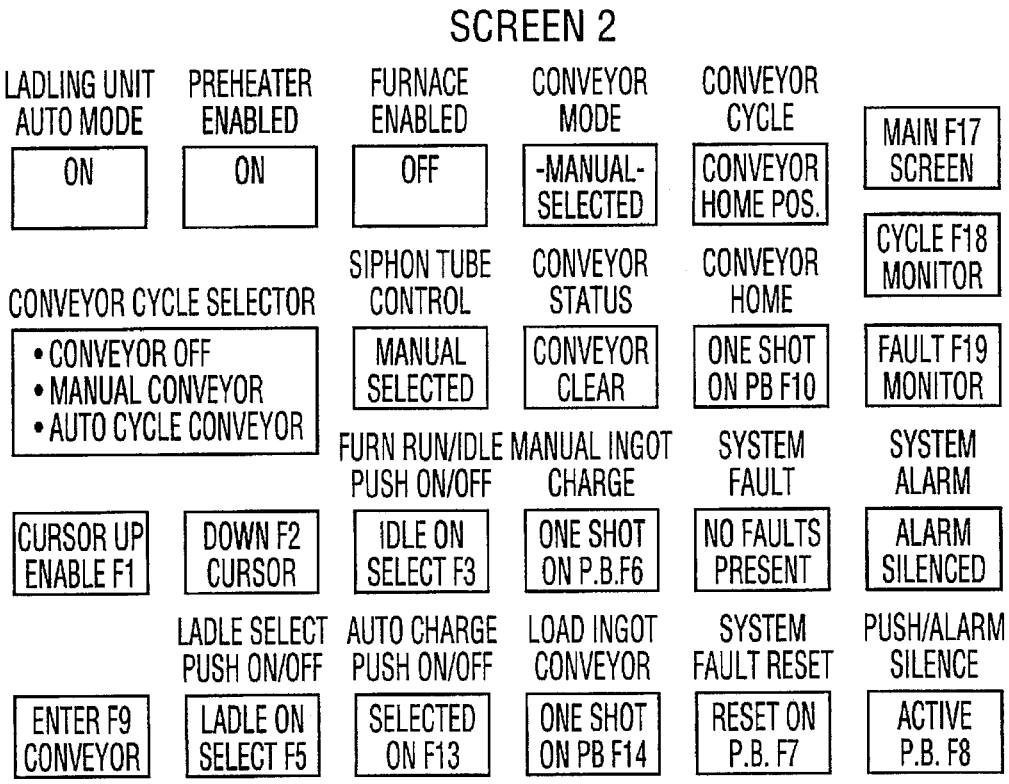
FIG. 30 is the control device screen used for selection of all control devices, i.e. conveyor off, conveyor manual and conveyor auto.

In the event of furnace temperature overshoot there is an auto ingot charge routine the conditions being as follows:

(1) Preheater and furnace control power both on (respective switches 555—FIG. 20 and 561 FIG. 21);

(2) Ingot charge enable selected on (operator panel view 511) (F13 FIG. 30);

(3) Metal level in metal bath pot must be below 90% max;

(4) The preheater control must have been on for at least 5 minutes (initial start up safety);

(5) The preheater, preheat chamber must be over a preselected temperature for minimum of two minutes e.g. 150° C.

(6) No faults or invalid data conditions relating to the cell may be active. If active they must be rectified and then the fault reset function key on the panel view must be operated to clear the fault or invalid program latches before the program will recognize a clear condition;

(7) Metal bath temperature must be greater than a preselected desired temperature for example 630° C.;

(8) Air pressure safety switch must be reading over 80 PSI (nominal reading should be approximately 90 PSI);

(9) Motor safety disconnect 110A (and the auxiliary contacts used for the PLC program) must be on.

Manual ingot charge can occur as follows:

(1) Ingot conveyor manual mode;

(2) Ingot conveyor loaded;

(3) Charge enable selected on;

(4) Press manual ingot charge function key;

(5) Ingot conveyor will index one paddle position;

(6) Ingots index one position through preheat chamber;

(7) Ingot conveyor back to reset position;

(8) 1.5 second dwell, then push rod cylinder 301 advances to proximity sensor 310 with preheated ingot;

(9) Preheated ingot drops into ingot chute, stopped by guillotine gate 306;

(10) 1.5 seconds after push rod cylinder 301 made forward proximity 310, a 1 second dwell takes place, when timer is done, the guillotine gate cylinder 308 retracts and activates proximity 331;

(11) When the guillotine cylinder 308 is fully retracted to activate proximity sensor 331, a 1.5 second dwell timer begins to time;

(12) Preheated ingot enters metal bath;

(13) When the guillotine dwell timer is done, the guillotine gate advances fully forward to proximity sensor 330, at the same time the push rod cylinder 301 retracts fully to the rear to make proximity sensor 311;

(14) Manual cycle complete/to cycle over, press manual ingot charge function key (F6 FIG. 30).

The same safety considerations as those that apply for an auto ingot charge apply to the manual ingot charge, with one major exception, that being the preheat chamber being over a preselected desired temperature (e.g. 200° C.) for at least 2 minutes. The machine operator is made aware of this and is cautioned only to use this function in an extreme case.

There is a manual ingot load function to facilitate loading the conveyor. Paddle positions can be located for convenience of loading. The steps for this are:

(1) Ingot conveyor selected manual mode (panel view F14 FIG. 30);

(2) Charge enable selected off (F13 panel view);

(3) Press manual load conveyor function button (F14 panel view);

(4) Conveyor will index one paddle position;

(5) Conveyor stops at index reset position;

(6) Load ingots is required;

(7) Repeat step 4 to continue.

(In this mode no charge sequence takes place).

If for some reason the conveyor does not make it to the index reset position, fault indication is given and the following sequence may be used:

(1) The conveyor may be homed with the conveyor mode auto selected, or the conveyor mode manual selected;

(2) Select charge enable off (F13 Panel View);

(3) Press the conveyor home function key (F10 Panel View), conveyor will move to the index reset position;

(4) Press the fault function reset key (F7 Panel View) to clear the latched fault in the PLC program.

PREHEATER OPERATION

To monitor preheater temperatures zone 1, zone 2, and ambient the operator enters a valid temperature preset using the panel view 511 operator terminal. Available presets are 0° C. to 260° C. If all safety conditions are met in the program, zone 1 contactor comes on, 1 second delay then zone 2 contactor comes on. There are three thermocouples used to monitor and control the preheater temperature. The three thermocouples (T/C) are load zone 108, MI preheater 107 and charge zone 106.

T/C 108 temperature plus T/C 107 temperature divided by 2 equals zone 1 ambient temperature, this value controls the on/off status of the zone 1 electrical contactor.

T/C 107 temperature plus T/C 106 temperature divided by 2 equals zone 2 ambient temperature, this value controls the on/off status of the zone 2 electrical contactor.

T/C 108, 107, 106 temperatures divided by 3 equals the preheater ambient. This value is used to ensure the preheater has reached equilibrium in relation to the ambient temperature, required for ingot heat up to set point, also used to drop out both zone 1 and zone 2 contactors if the upper ambient temperature deadband is exceeded.

An ingot in the precharge position (Plate 306) or the ingot next to be moved to the load plate 306 is monitored by an infra-red sensor, (emulates a K type thermocouple) to ensure ingot is equal to or above the ingot preset temperature for charging to the metal bath. A suitable infra-red thermocouple is available from Exergen Corporation of Newton Mass. under the Trade-Mark IR t/c. Instead of an infra-red sensor applicant prefers a direct contact T/C as there is more accuracy in the measured temperature. This is previously described as T/C 151 movable into and out of contact with the ingot by air cylinder 150. T/C 151 may be a spring loaded T/C N sensor type available from Ogden Manufacturing Company, Arlington Heights, Ill.

A known format is used to calculate the Kw'S required for the ingot preheater.

To monitor preheater temperature zones and ambient

| | | | |
|---|---|---|---|
| 108 | 107 | 106 | checked for open T/C |
| 108 | 107 | 106 | checked for invalid data |
| 108 | 107 | 106 | checked for hi-limit |
| Zone 1 | | | checked for hi-limit |
| Zone 2 | | | checked for hi-limit |
| Ambient | | | checked for hi-limit |
| Zone 1, Zone 2 Upper Deadband | | | 7° C. above set point |
| Zone 1, Zone 2 Lower Deadband | | | 7° C. below set point |

Ambient Temperature maximum heat preset 260° C.

Siphon Tube (400) Operation

The siphon tube moves the liquid magnesium from the furnace metal bath pot to the die cast machine shot sleeve pour hole. The cycle of the siphon tube is as follows:

(a) The die cast machine sends a signal to the melt cell (furnace) processor requesting a metal pour. As long as all safety considerations and temperature limits are met in the melt cell processor, the siphon tube is given the signal to cycle;

(b) Upon receiving the signal the siphon tube lower valve is energized and the siphon tube cylinder retracts lowering the tube to the pour position;

(c) When the tube is lowered proximity sensor 425 is activated causing the siphon valve cylinder to be energized and thus advancing the valve seat allowing the magnesium to flow through the siphon tube for the amount of time selected (F4) by the operator, via the operator computer interface (Panview 511). Pour times are preselected dependent upon need and normally not less than 1 second for safety and maximum dependent on part size;

(d) Upon time out of the metal pour timer, the valve seat retracts to the check valve ball. At this point the siphon valve closed limit switch 406 is made, the siphon tube will begin to raise, the siphon tube drip timer times out at this point, the signal is sent to the die cast machine that the siphon pour is complete, the siphon tube will continue to raise to the home (upright) position;

(e) This completes one full cycle for the siphon tube pour function. To begin another cycle the die cast machine must open and proceed with the recycle of the die cast machine. This is done as a safety to ensure the siphon tube may pour only once during the die cast machine cycle. A pour is aborted at any time should there be a fuel safe condition from the DCM.

Melt Furnace (200) Heating Operation

SCR's and their Firing Boards controlled by a DFE intelligent moclate 581 of the processor 574 are used to control power to the furnace elements 215. Some features of this control are:

(i) 3 phase zero cross fired;

(ii) 4 to 20 mA input signal to the SCR firing control boards;

(iii) gated SCR's used for proportional control;

(iv) closed loop control;

(v) no mechanical moving parts.

This type of system allows for:

(i) much longer element life;

(ii) less power consumption; and (iii) interactive to the machine control program, providing much better control over metal bath temperature than can be achieved using contactors or selector type selection of power.

The metal bath temperature is kept extremely close to preset by using closed loop PID formula acting with anticipative program development which checks many variables relative to the metal bath temperature. A preset temperature may for example be 680° C. (1260° F.). As previously discussed a system can be designed to operate with a variation of ±8° C.

With respect to the metal bath level it is measured accurately by the level probe previously described and that level is measured to two decimal points. A level can be maintained accurately and for best process results the metal temperature measurement and draw of metal are taken at the same level. The level is used as part of a closed loop PID calculation for metal bath temperature and determining the optimal temperature for the preheater ambient temperature. Metal level is monitored by the machine program for processed control information and pour function.

Figure 25:
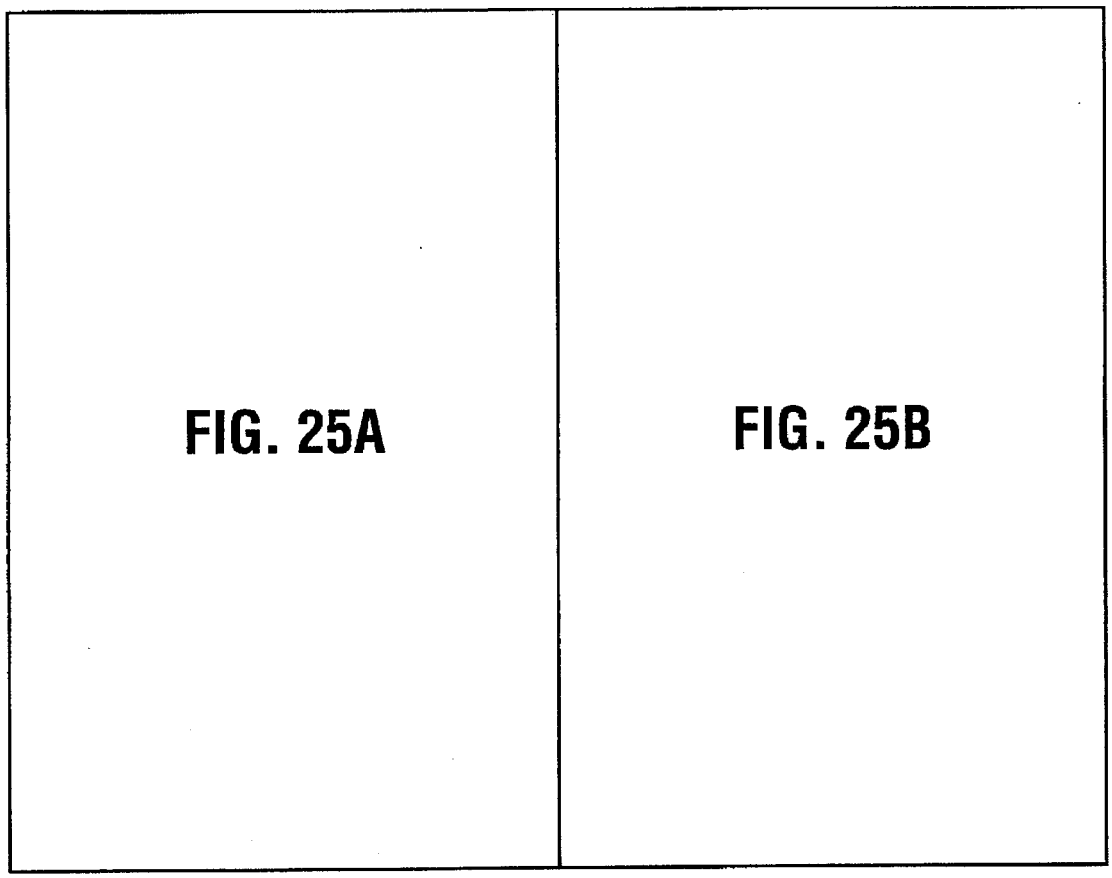
FIG. 25 is a block schematic of the magnesium melt system which includes the apparatus and the processor control.
Figure 25A:
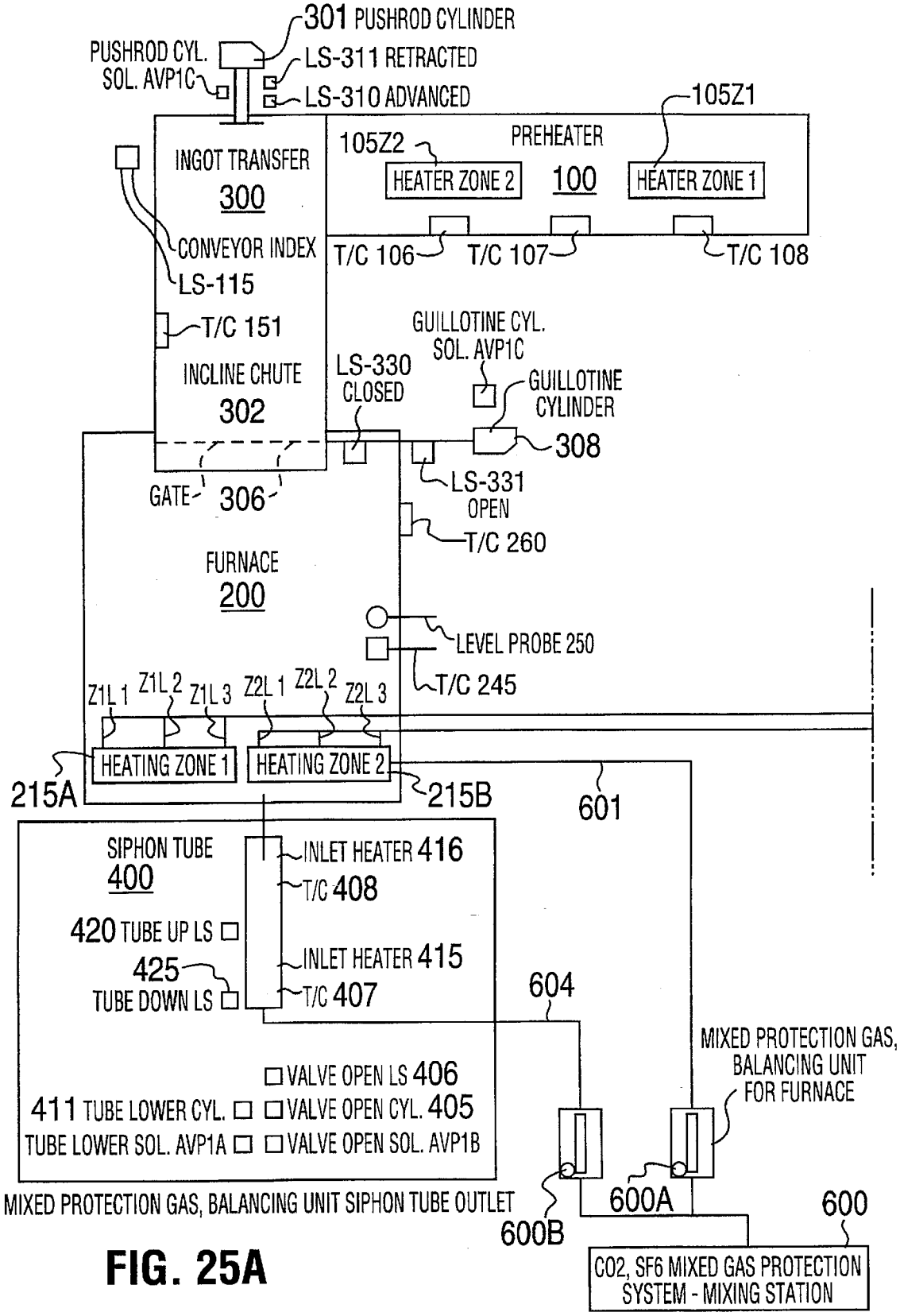
Figure 25B:
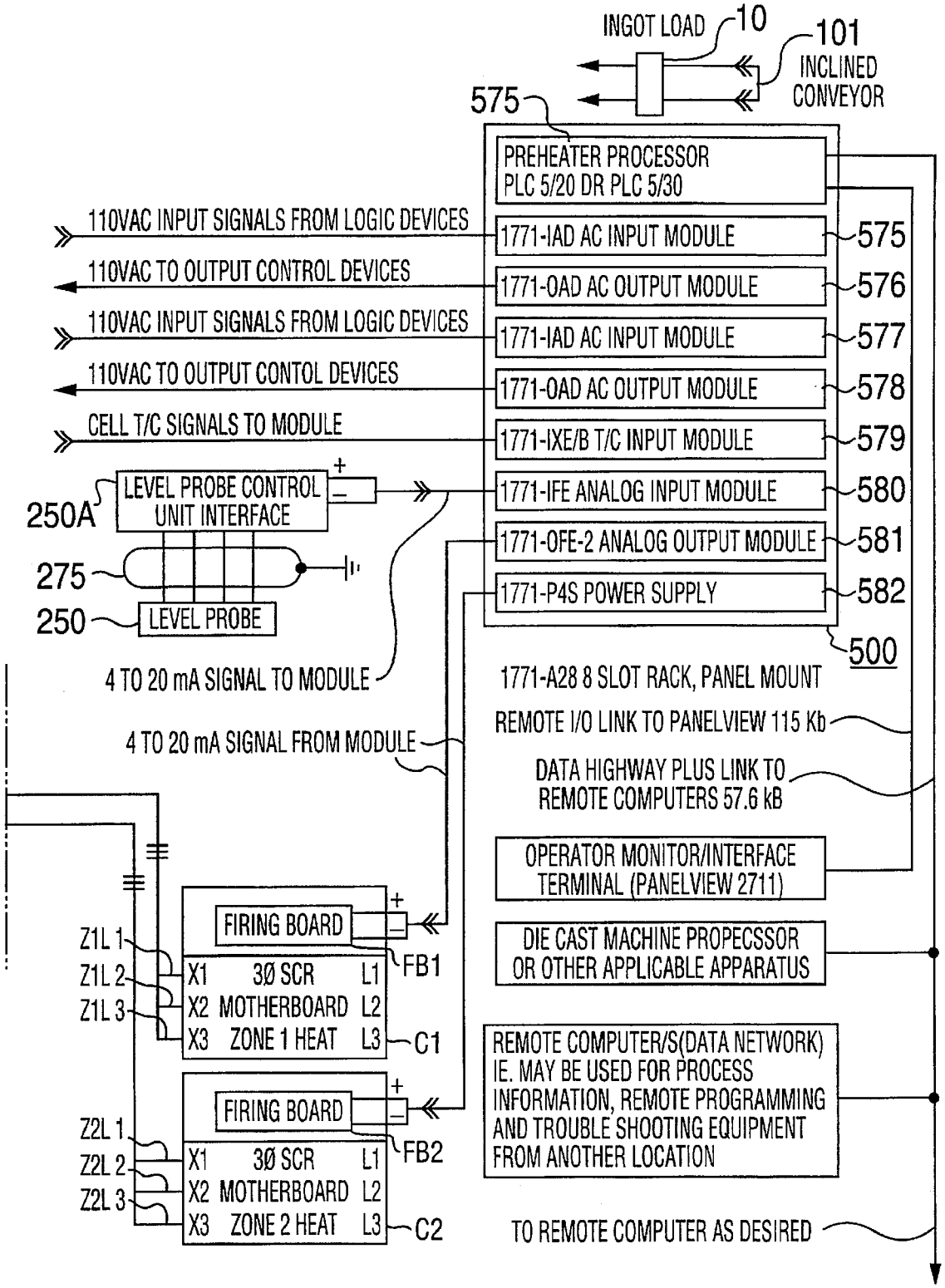
Figure 26:
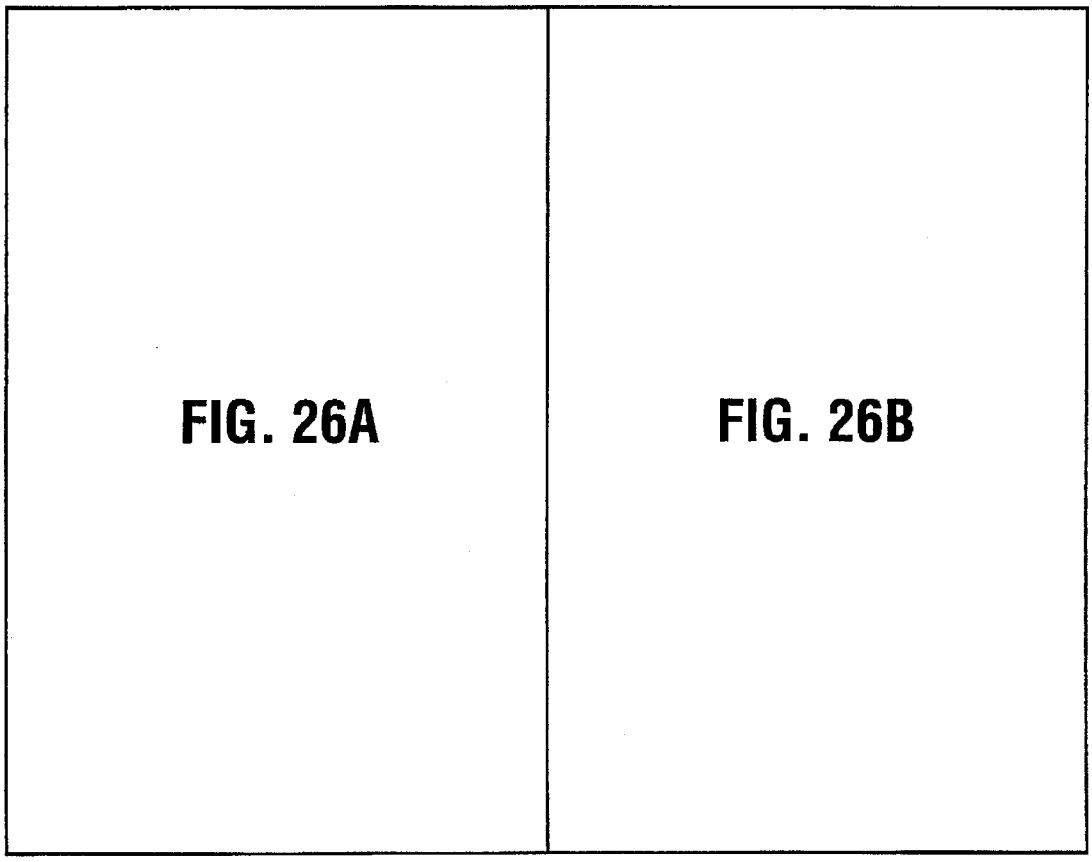
FIG. 26 is a detailed schematic of the furnace heat control system.
Figure 26A:
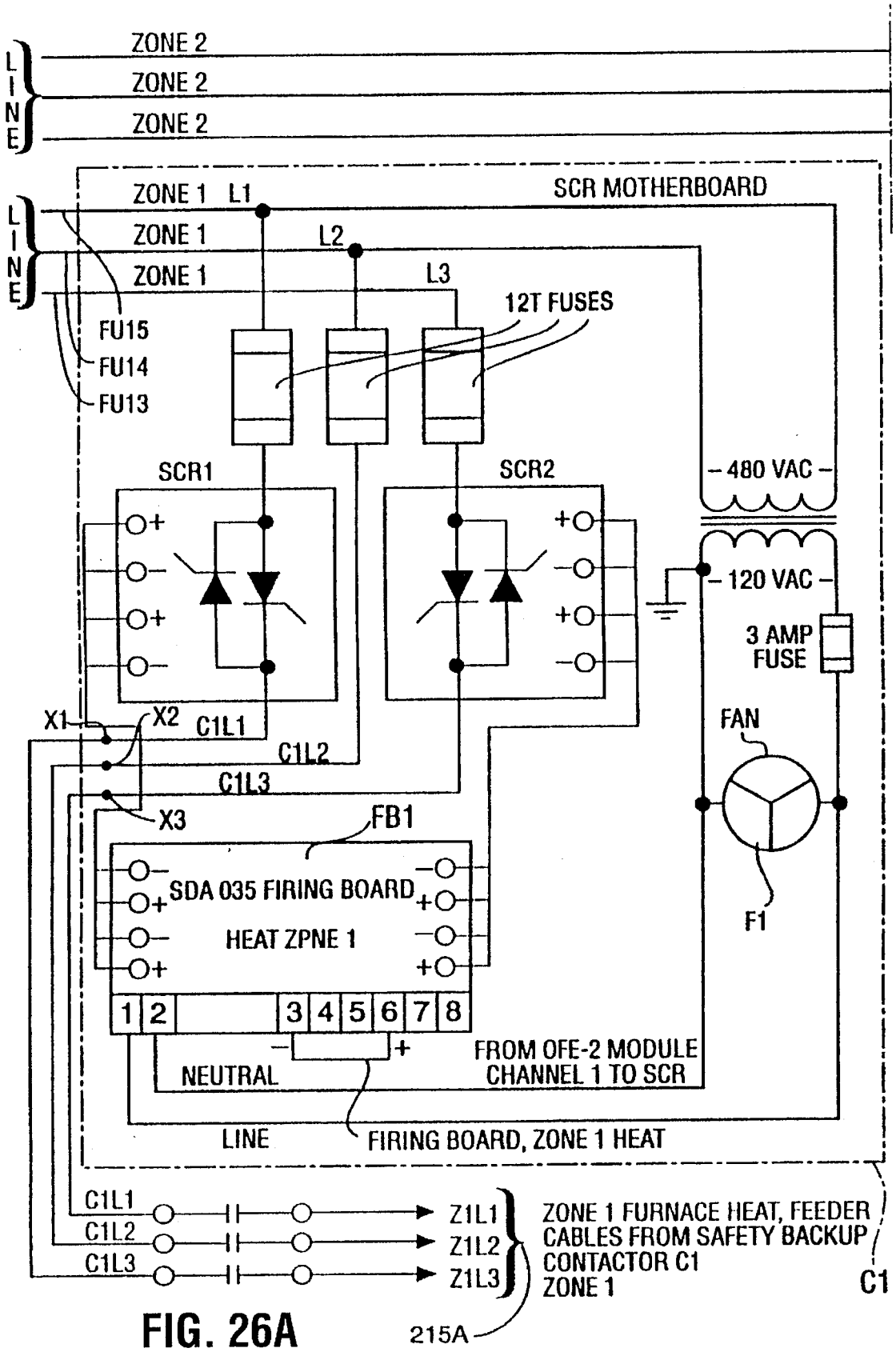
Figure 26B:
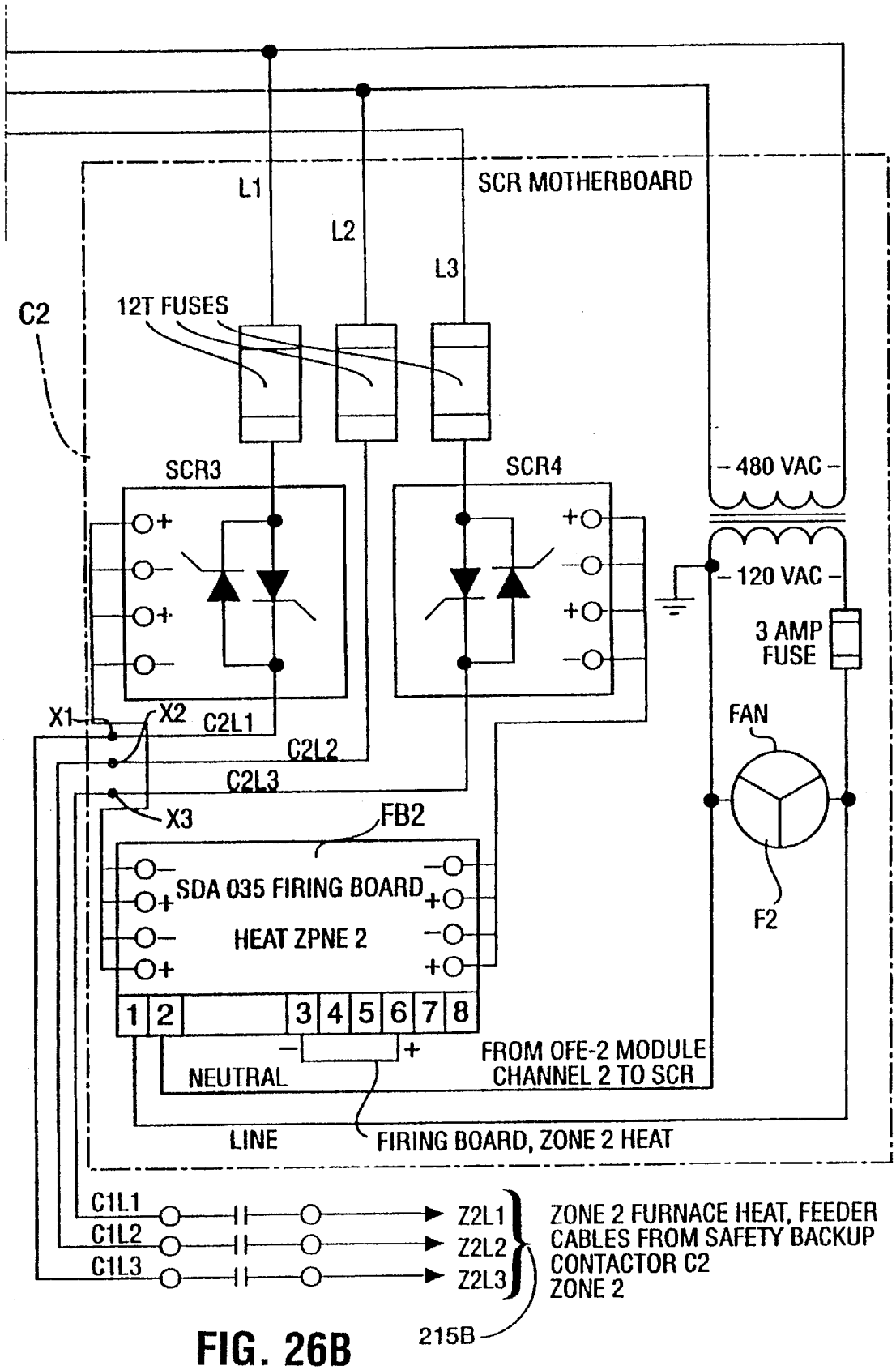

Referring to FIGS. 19, 25 and 26 the furnace heating elements 215 of the upper zone 215A and lower zone 215B are controlled by signals from an OFE2 module 581 of the PLC 574. The signals 4 to 20 mA from the module are sent to firing boards FB1 and FB2 of the respective mother boards C1 and C2. As seen from FIG. 26 firing board FB1 controls power to zone 1 (elements 215A) via SCR1 and SCR2. Similarly power for zone 2 heating is controlled by firing board FB2 via SCR3 and SCR4.

The SCR's are type 319 (SDA-035) connected by way of a power distribution block to a 480 VAC 3 phase power supply through a 400 amp main switch PS1A. Cooling fans F1 and F2 are shown schematically in FIG. 26. The SCR's, type 319 (SDA 035) are available from Elkon Inc. of Dorval P.Q.

Figure 24:
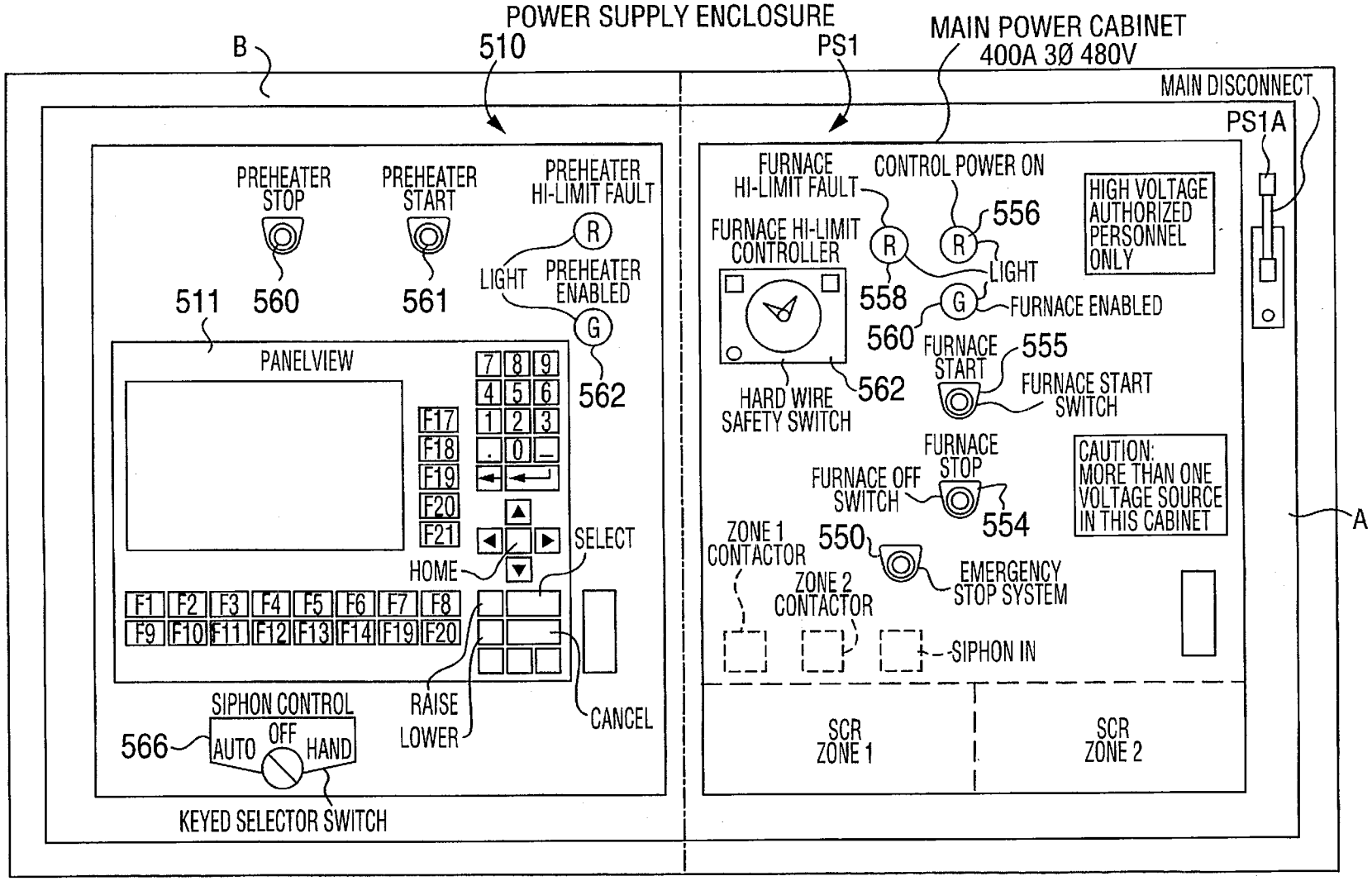
FIG. 24 is a front view of the power supply enclosure and operator panel view.

Referring to FIGS. 19 and 24, the latter being the power supply enclosure there is shown the main disconnect switch PS1A for the 480 VAC 400 amp 3 phase power supply to the furnace heater respective upper and lower zones 215A and 215B. Zones 1 and 2 are controlled by the SCR mother boards C1 and C2.

FIG. 20, a continuation of the schematic of FIG. 19 shows an emergency stop switch 550, a hi-limit controller 552 with contacts 552A and 552B and a furnace off or stop switch 554. The hi-limit controller 552 receives signals from the furnace outer shell T/C 260. There are light indicators 556 for main power on, furnace hi-limit fault 558 and furnace enable 560. Mounted in the cabinet are the mother boards C1 and C2.

Figure 23:
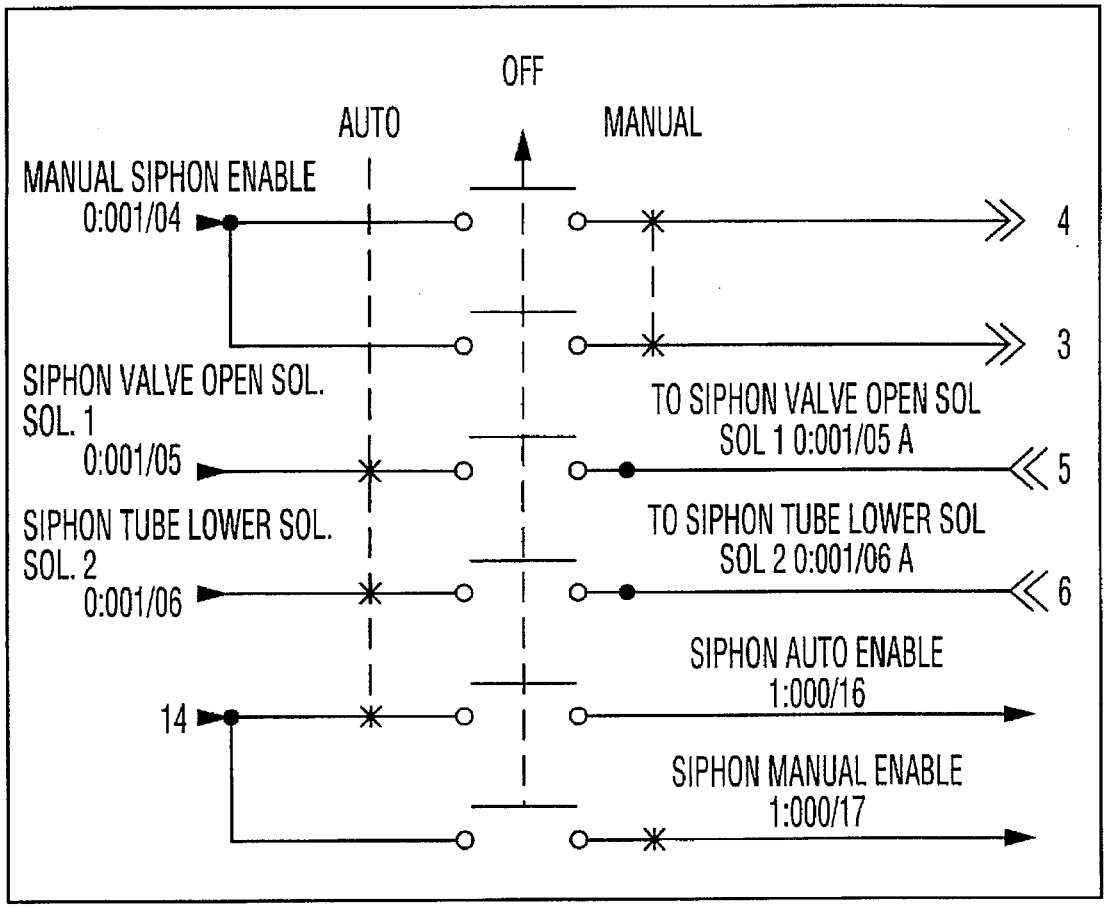
FIG. 23 is an electrical schematic showing further details.

FIG. 21, a continuation of the furnace electrical schematic FIG. 20, shows the preheater start switch 561 and preheater stop switch 562 and preheater indicator enable light 562 located on-power supply cabinet PS1 (FIG. 24). There is a keyed selector switch 566 and the electrical schematic for the same as shown in FIG. 23.

Figure 22:
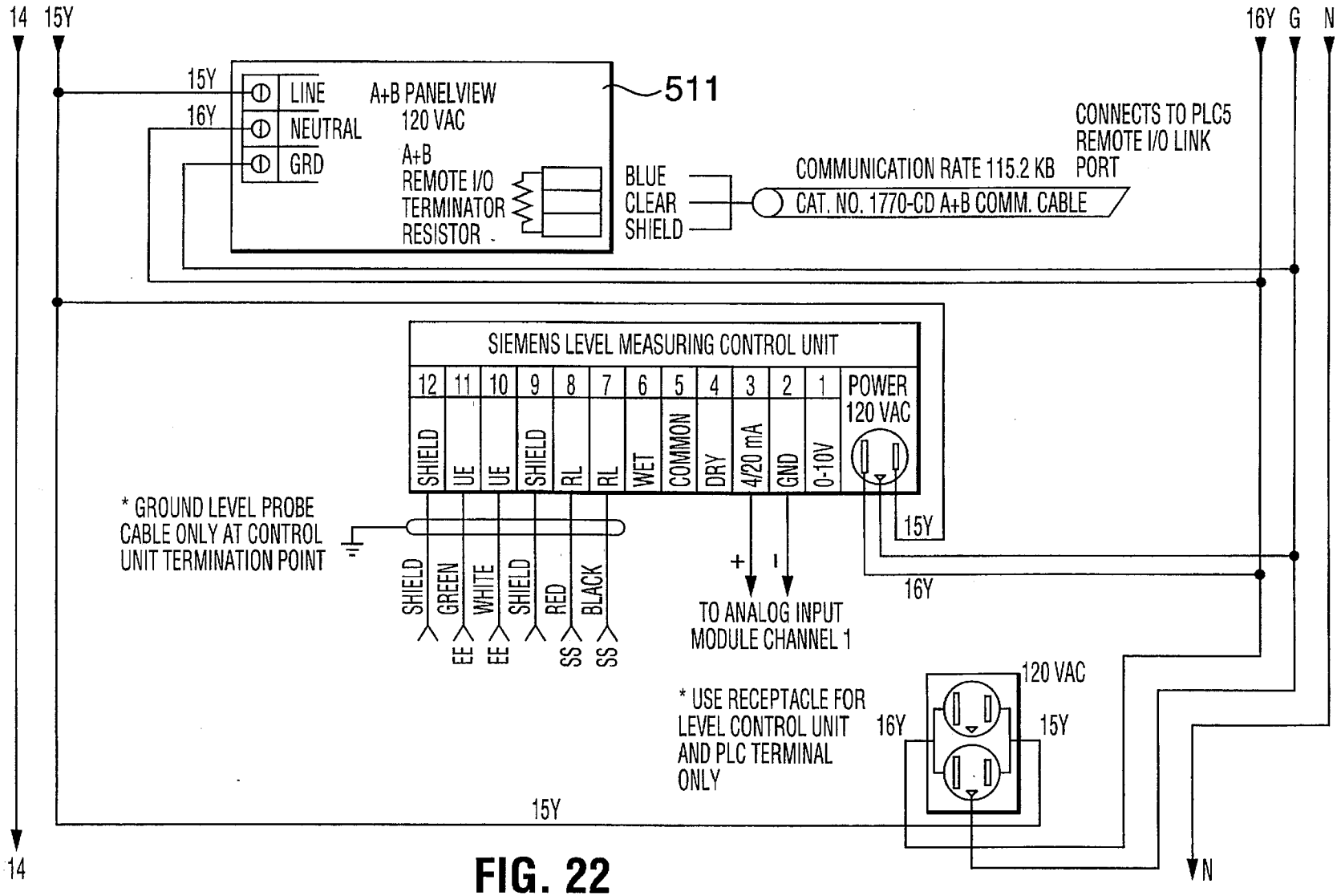
FIG. 22 is a continuation of the schematic of FIG. 21.

The operator processor designated panel view 511 is shown located on the power supply enclosure in FIG. 24 and FIG. 22 is a partial schematic for the same.

A known format is used for determining Kw rating of the furnace. The molten bath of magnesium in the crucible acts as both a heat sink and heat source. Enough thermal energy must be stored in the melt to liquify an ingot to the bath temperature in a given period of time without dropping the bath temperature a specified amount. Acting as a heat sink, the bath can be used to control climbing temperature by injecting ingots.

Consideration when sizing a furnace must be given to:

(1) heat loss to atmosphere, when drossing (cleaning);

(2) conduction of heat out of the melt;

(3) effects of dross acting as an insulator on the crucible bottom;

(4) decrease in die cast machine cycle time;

(5) the use of the next larger size ingot (25 lbs.);

(6) changing to a magnesium ingot with different melt characteristics: some of the various ingots available are AZ91D, AM60B, or AS41XB.

Figure 27:
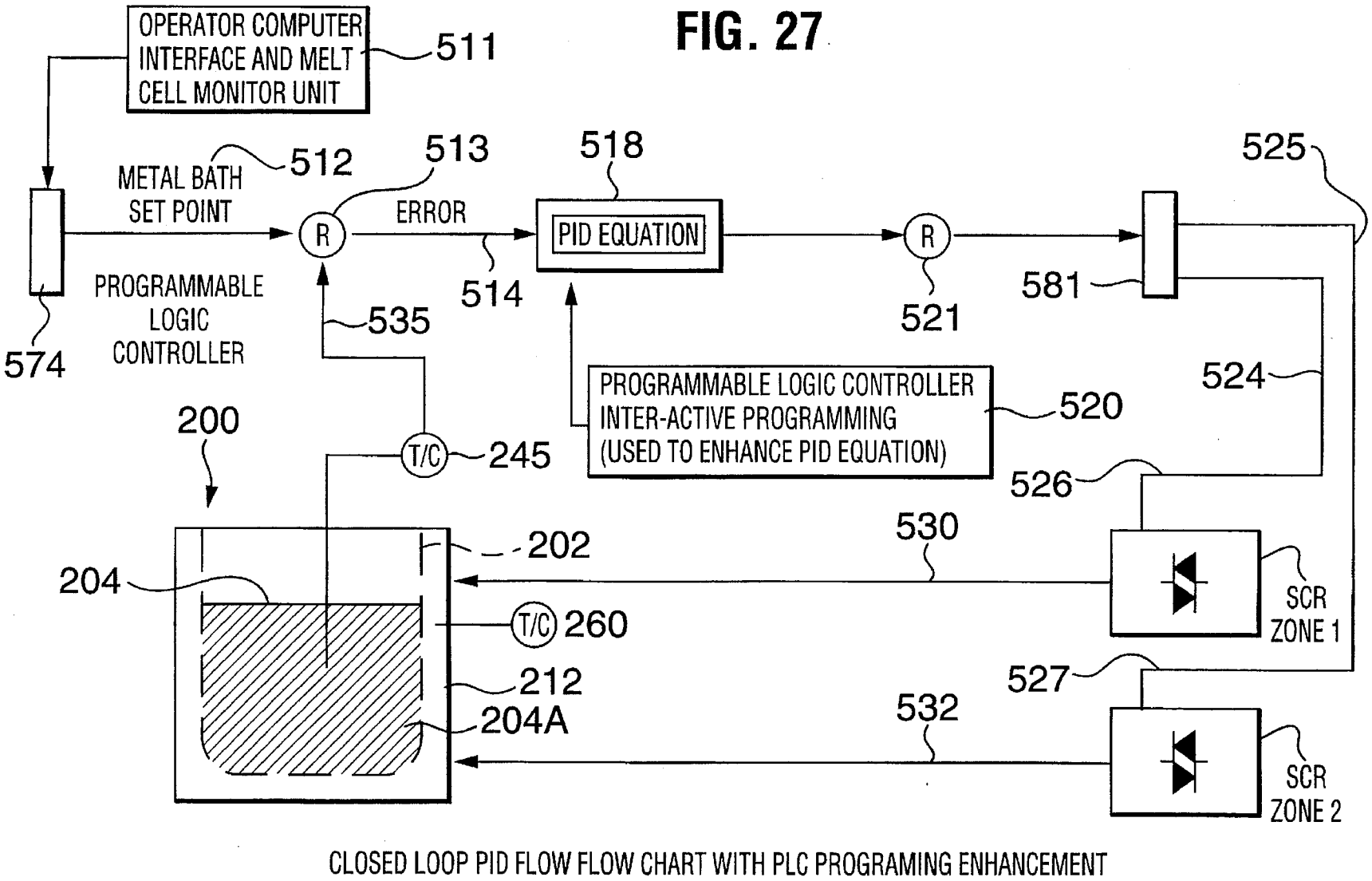
FIG. 27 is a block schematic flow diagram of the closed loop PID and PLC programming enhancement.
Figure 28A:
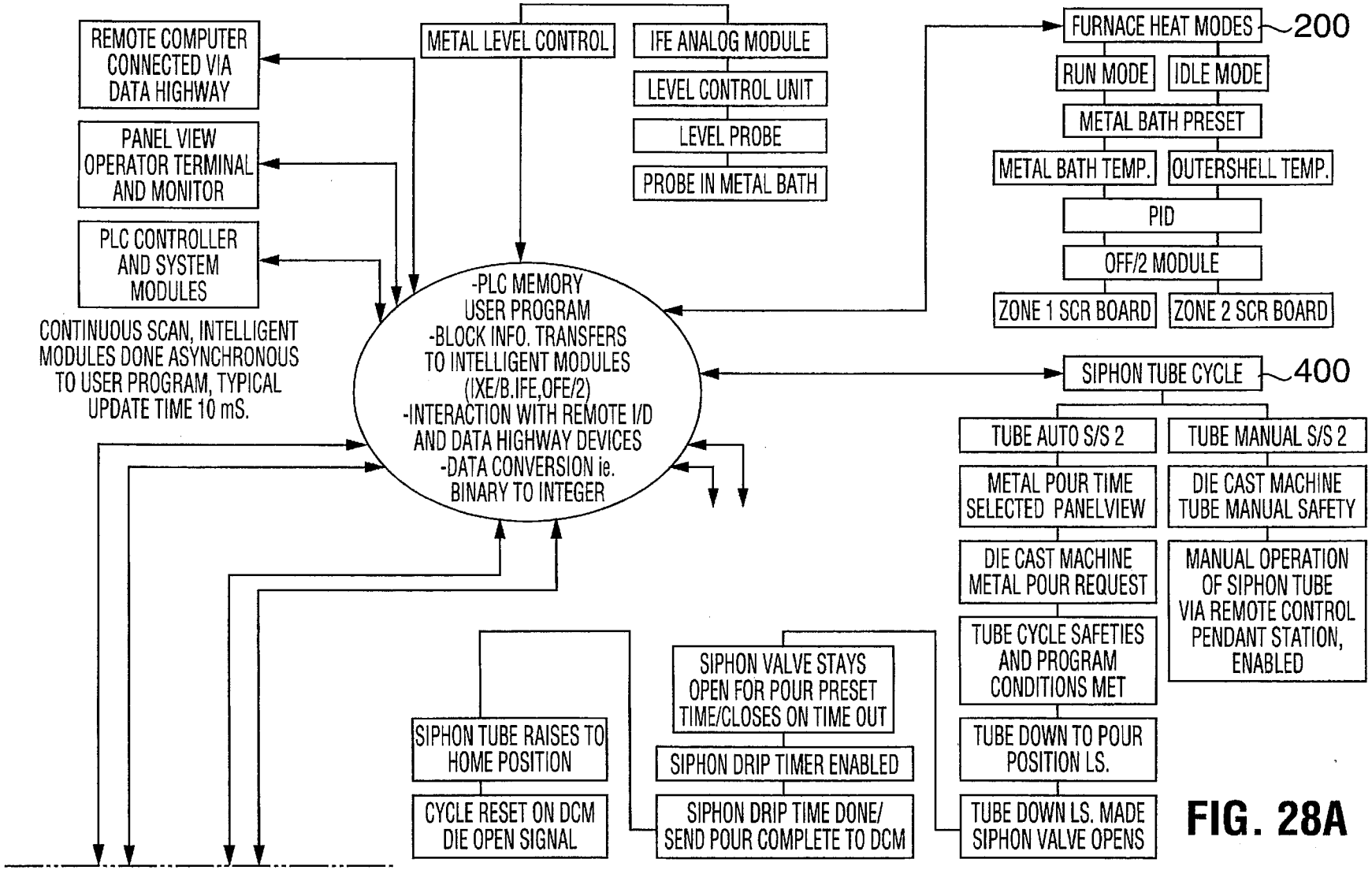
FIG. 28 is a block flow diagram of the melt process for the present system.
Figure 28B:
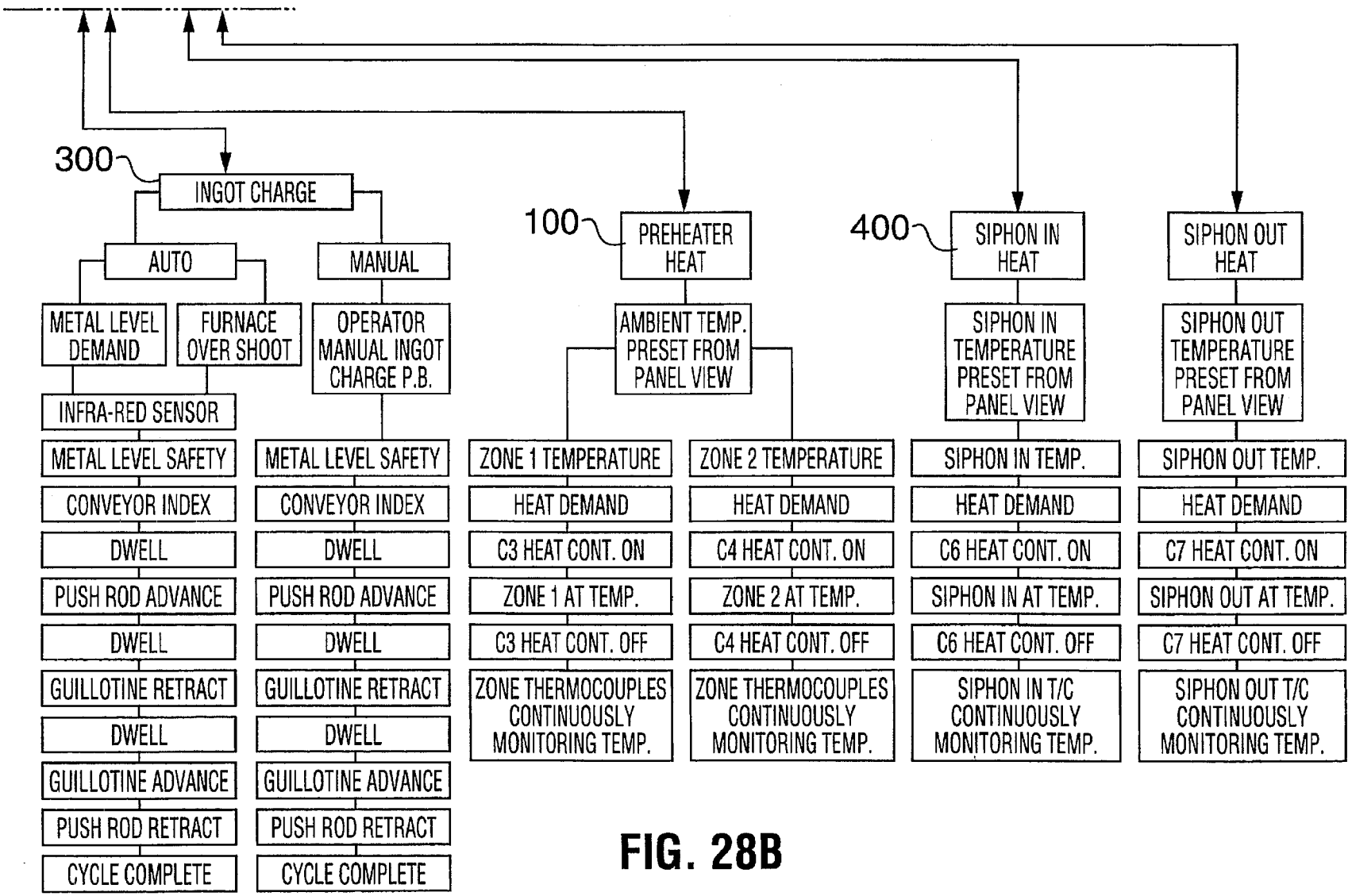

For the furnace heat control reference may be had to FIG. 27 which is a flow chart illustrating a closed loop PID with program PLC enhancement. Interactive programming controls the metal bath melt process by sending output signals to the two zone firing boards FB1 and FB2. The greater the error between the set point and the process variable input, the greater the output signals and vice versa. Additional values (feed forward or bias) can be added to the control output as an offset (interactive PLC programming is also used with this value and others in the PID equation). The goal of the PID and the interactive factors introduced by the PLC programming is to maintain the metal bath temperature as close as possible to the desired set point.

Referring to FIG. 27, 512 designates the metal bath set point entered by an operator via panel view 511 to PLC program. 513 designates metal bath set point and metal bath temperature descaled in PLC program for move to PID instruction. 514 designates move the above with accompanying errors determined by PLC programming logic. Diagrammatically illustrated is the furnace 200 with the metal bath temperature thermocouple 245 and the furnace outer shell temperature thermocouple 260. The furnace outer shell 212 has a known area. The metal bath in the furnace is designated 204. Reference 518 designates the PID equation. Reference 520 designates introduce PLC programming, with reference to furnace mode selected as well as other items to be described in the explanation of how the closed loop PID function is used in the program. Reference 521 refers to the biasing value controlled by the PLC program (reference explanation).

581 is an OFE/2 module of the PLC used to output the four to twenty milli amp control signals to the SCR firing boards FB1 and FB2. References 524 and 525 are respectively channels 1 and 2 from OFE/2 module 581 to respective zones 1 and 2 SCR firing boards FB1 and FB2. Reference 526 designates a 4 to 20 mA signal to zone 1 SCR firing board (gating signal) and reference 527 designates a 4 to 20 mA signal to zone 2 SCR firing board (gating signal).

References 530 and 532 designate respectively firing board power to respective zones 1 and 2 of the furnace. Reference 535 designates the metal bath temperature to IXE/B thermocouple module 579 and includes the outer shell furnace temperature as measured by thermocouple 260.

A programmable logic controller is designated 574 and the operator console panel view is designated 511.

Furnace operation modes

1. Furnace Run Mode

This mode is selected by the operator via the panel view 511 (F3):

metal bath selected set point (F1) is entered by the operator using the panel view function keys. The PLC program is designed to accept only a valid preset, the maximum value for example 1292° F. (700° C.).

the PLC program uses the metal bath set point, the metal bath temperature from the metal bath T/C 245 and the functions related to, and including the PID instruction to deliver a 4 to 20 mA output from the OFE/2 module 522 to control the power level sent from each zone firing board to its heat zone (215A, 215B) in the furnace.

There are two heat subroutines also used with the furnace run mode that are automatically controlled by the PLC and are put into effect when proper conditioning is found in the PLC program. Subroutine 1—Quick Heat—This routine becomes active for a set time period and moves a specified feed forward value into the PID calculation when the furnace mode is first selected and also when the die cast machine is first placed in the auto mode.

Subroutine 2—Feed forward Dwell

This routine becomes active for a set time period and moves a specified feed forward value into the PID calculation only when an auto ingot charge to the metal bath is going to take place. This routine is used to introduce additional heat into the furnace to offset the metal bath temperature drop before the ingot is actually charged, this additional heat is absorbed by the ingot through the metal bath with the heat actually coming from the furnace outer shell.

2. Furnace Idle Routine

This mode is selected by the operator using the panel view 511:

metal bath set point is entered and has the same conditioning as the furnace routine. The idle routine differs in that the outer shell thermocouple 260 is monitored for the active temperature. By doing this the metal bath temperature and the furnace outer shell temperature reach equilibrium, and only enough power is used to keep the metal bath at or slightly below the lower deadband, the program automatically switches to using the metal bath temperature reading to move temperature back up to set point. This procedure is a cost savings as the need for precise temperature is not necessary for weekend or down time periods.

Furnace Safeties Include (1) hardwire hi-limit safety controller;

(2) two safety control relays, one for each zone control safety back up contactor;

(3) Two, 100 AMP 3 phase safety contactors, one for each SCR firing board;

(4) PLC program monitors both the metal bath thermocouple and the furnace out shell thermocouple for the following:

(a) hi-limit conditions;

(b) broken or shorted thermocouple;

(c) valid data;

(d) temperatures within safety ranges.

The above items drop out PLC logic to the main back up contactors and void logic for firing signals to the SCR firing boards.

Furnace Logic and Control Programming (1) Enter valid metal bath preset;

(2) Ensure valid preset in program;

(3) Move bath preset value to panel view 511 display;

(4) Move metal bath temperature T/C 245 to panel view;

(5) Move furnace outer shell temperature T/C 260 to panel view;

(6) Data valid check metal bath PLC program;

(7) Data valid check outer shell PLC program;

(8) Metal bath hi-limit check PLC program;

(9) Outer shell hi-limit check PLC program;

(10) Metal bath temperature to decimal format PLC program;

(11) Outer shell temperature T/C 260 to decimal format PLC program;

(12) Metal bath preset to decimal format PLC program;

(13) Metal bath temperature checked for hi/low temperature PLC program;

(14) Metal bath deadband upper limit PLC program;

(15) Metal bath deadband lower limit PLC program;

(16) Metal bath high temperature warning PLC program;

(17) Metal bath low temperature warning PLC program;

(18) Furnace metal data valid check PLC program;

(19) PID base timer (continual recycle) 10 mS time base;

(20) Metal bath T/C 245 move for PID;

(21) Outer shell T/C 260 move for PID;

(22) Furnace run selected on store;

(23) Furnace idle selected on store;

(24) Metal bath temperature is over 1200° F.;

(25) Furnace run selected on store (Variable file for PID);

(26) Furnace idle selected on store (Variable file for PID);

(27) Descale metal bath T/C 245 value, outer shell T/C 260 value;

(28) Descale value multiplied by constant;

(29) Move set point to PID function;

(30) Feed forward dwell timer (auto ingot charge);

(31) Feed forward biasing program block;

(32) Quick start up timer (initial furnace start/DCM in auto one shot);

(33) Acceptable temperature range difference (set up for quick start dwell timer);

(34) FAL (File Arithmetic Logical) used to move 0–4095 value for each SCR channel to the module which will send the 4 to 20 mA signal to each board;

(35) Safety and conditioning logic for safety main back up contactors for SCR firing boards;

(36) PID analog output block transfer read (OFE/581) sends the 4 to 20 mA signals to boards;

(37) PID analog output block transfer write (OFE/581).

The control system 500, for the melt cell, preheater, ingot transfer and siphon tube is schematically illustrated in FIG. 26. The system includes a PLC 5/20 or PLC 5/30 processor 574 in an 8 slot rack with an integral PS4 power supply designated 582. Also resident in the rack are:

(1) 2—1771/IAD 120 VAC 16 point Input Modules designated respectively 575 and 577;

(2) 2—1771/OAD 120 VAC 16 point Output Modules designated respectively 576 and 578;

(3) 1—1771/IXE-B Thermocouple Module designated 579;

(4) 1—1771/IFE Analog Input Module designated 580 and;

(5) 1—1771/OFE-2 Analog Output Module designated 581.

The control system includes the panel view operator terminal 511 which is connected via an I/O link to the PLC 574 and interactive therewith, allowing operator control by assigned function keys, access to display menus that monitor temperature conditions, set point displays, fault conditions and allowing the operator to monitor cycles in progress for both the ingot request cycle and the ladle pour request cycle.

Level control of the molten magnesium is done by use of the level probe 250 which sends two separate signals to the level control unit 250A which are then converted to a 4–20 mA output signal which is taken to the 1771-IFE Module 580 for use in the PLC 574.

Preheating of the magnesium ingots is done using two zones 105Z1, 105Z2 of radiant heat. Each bank of heat is made up of three 480V 1 phase 10.2 kw radiant heating panels. A total of six, 480V 1 phase 10.2 kw radiant heating panels provides an intermittent load of 61.2 kw of preheater heat. Thermocouples 106, 107, 108 monitor temperatures in the preheater and output signals to the thermocouple module 579 which interacts with the PLC 574 to control the temperature to a preselected value.

Magnesium melt is accomplished by using two 3 phase 100 Amp 480 VAC SCR Firing Boards FB1 and FB2 which are zero cross fired and controlled by logic in the PLC 574 program. There are two zones 251A, 251B of elements in the furnace which are 480 VAC, 3 phase, 62.5 kw, 75.2 Amps. The PLC program design is set up so that only the amount of power required to achieve and maintain the metal bath set point is used to allow for major energy savings compared to other furnaces on the market. Zero cross firing of the 3 phase SCR's provides for the most efficient and maximum control while eliminating RFI as well. The three phase is Wye configured as seen from FIG. 19 for each of zones 1 and 2. Each zone is controlled by 2 SCR's i.e. two of the three legs of the Wye connection. Further details are shown in the schematic designated FIG. 26.

Devices associated with the furnace include:

(a) hardwire hi-limit safety control unit 552 for furnace with a push to test red lense pilot lamp labelled Hi-Limit Fault 558. Back up safety hi-limit relays CR2 and CR2A used to ensure the 100 Amp SCR contactors drop out if there ever was a PLC failure;

(b) 240 VAC white lense pilot lamp 556 to indicate 240 VAC power is on/no control fuses blown;

(c) furnace start push button 555 (green);

(d) furnace stop push button 554 (red);

(e) furnace enabled pilot lamp 560/green lense push to test;

(f) system emergency stop push button 550, red mushroom head. Pressing this button will drop out the melt cell as well as the die cast machine. It should only be used in an emergency.

Other Devices Include (a) a fault alarm buzzer which gives a signal for major faults and an alternate signal for system warnings;

(b) a fault light beacon mounted on the control panel preheater platform;

(c) a 3 phase 480 VAC motor safety disconnect is located above the drive motor to allow for lock out procedure. The motor safety also has safety interlock contacts used in the PLC program and as a hardwire safety.

A fault light beacon mounted on the control panel preheater platform becomes active on a fault condition. The audible alarm signals are delayed for two minutes after the fault beacon becomes active to allow operator time to clear a fault before activation of audible alarm.

Associated with the preheater are:

(a) preheater hi-limit fault, push to test pilot lamp with red lense;

(b) preheater enabled pilot lamp, push to test with green lense;

(c) preheater start push button (green);

(d) preheater stop push button (red);

(e) three position keyed selector switch for the siphon tube control, auto-off-manual. The key may only be removed in auto position.

Some considerations with respect to the control system:

(a) all contactors and relays are surge governed by MOV's to protect sensitive electronic components;

(b) to protect these electronic components, installed is an Islatrol Mod. IC+115, 120 VAC, 15 Amp, 60 Hz unit.

This unit protects against line surges, transient voltages and as a filter for RFI noise that exists where welding units are used;

(c) both the furnace and the preheater are safety interlocked with the DCM. If the emergency stop is pressed at the DCM, both the furnace and the preheater will drop out.

(d) all thermocouples, metal level probe and temperature presets are monitored by the PLC to be within specified high and low limits whether the data is valid and for High/low limit fault conditions. Set point values are also clamped not to exceed a certain value;

(e) interface between the magnesium melt cell and the die cast machine is accomplished through hardwire dry contact closure. Loss of a signal during a ladle pour operation voids the metal pour and will necessitate reset of the pour logic at the melt cell after fault has been cleared. At no time should the hardwire closure be bypassed as this may lead to possible hazardous conditions, either with the die cast machine or the melt cell.

The PLC processor 574 is linked with the DCM processor 500A and if desired as shown in FIG. 26 an optional remote computer 500B. The remote computer 500B provides process information as well as programming and trouble shooting from a remote location.

The panel view operator console 511 is an interactive unit linked to the PLC 574 via a remote I/O link. This allows for information concerning temperature displays, metal level, operator set points and presets relating to temperature and time which is used for the amount of pour time requested by the operator.

Figure 29:
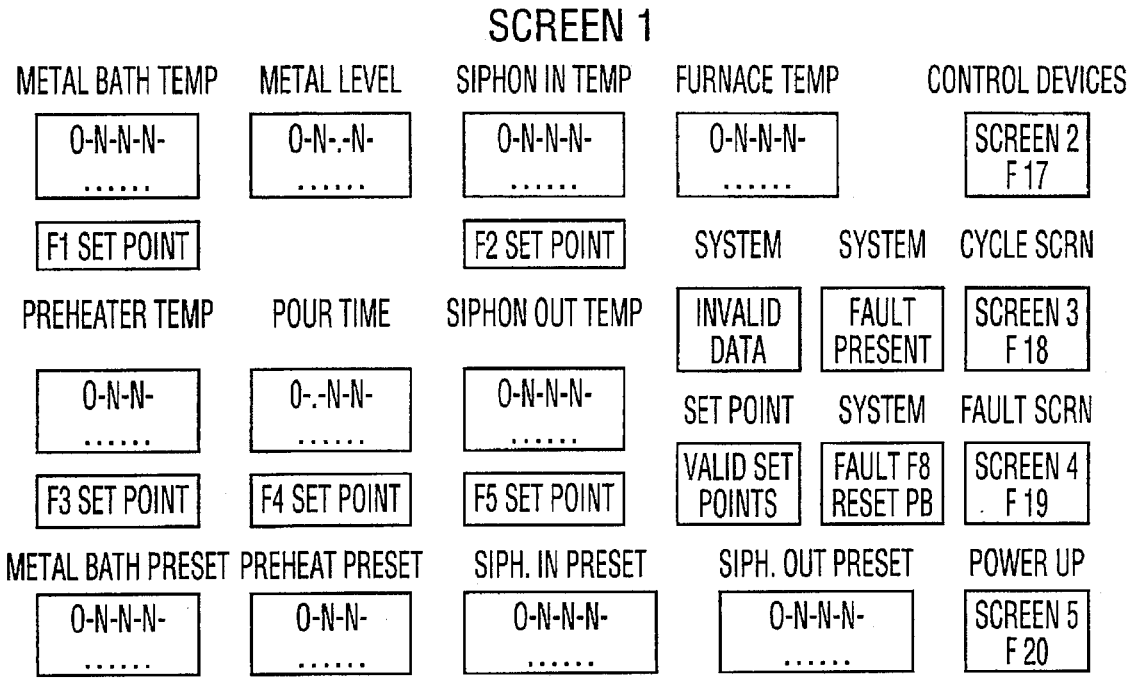
FIG. 29 is the panel view operator processor screen for temperature set point entry for all functions requiring a temperature preset, and metal pour preset display of entered preset value and the display of actual temperature and metal pour value.

Excluding the hardwire safety devices previously mentioned, all control of the melt cell unit is done through the panel view operator terminal 511. There are four different screens available to the operator, each screen having a different function and accessible by the menu function key designated on the display for the desired menu. The screens 1, 2, 3 and 4 are as follows:

Screen 1—Main Screen—FIG. 29

Temperatures, metal level, pour time displays (actual), displays of the set point or preset, selected for each function. Set point function keys used to access the numeric key pad to enter a new value. There are also three indicators which indicate system conditions, which are: (a) system data (valid/invalid); (b) set point (valid/invalid); (c) system (faults/no faults). There is also a fault reset function key designated as well as the function keys to access the other menus.

Screen 2—Control Screen—FIG. 30

The control screen is made up of all the devices and indicators necessary to run the melt cell in an auto mode or to perform certain functions in a manual mode. The control screen also has indicators for system faults and system alarm condition. There are function keys assigned to this screen to both reset a cleared fault condition as well as a 5 minute silence alarm function key which will also reset the alarm if it has been cleared. If not cleared, after 5 minutes, the alarm will sound again. If the alarm has been silenced, the indicator will flash and show this message "ALARM SILENCED". This screen also has three function keys assigned to menu selection to allow the operator to go to any desired menu.

Screen 3—Cycle Screen Menu—FIG. 31

The cycle screen menu is made up of three state indicators which react to the state of the device being monitored. There are two independent logic cycles and both are shown with a brief description of each adjacent to the indicator stack. Also on the cycle screen there is a system fault indicator and three function keys assigned to screen menus to allow the operator to move to any other menu.

NOTE, Fault reset cannot be achieved from this menu.

Screen 4—Fault Screen Menu—FIG. 32

This menu is intended to give specific recognition of individual fault conditions and as an excellent diagnostic trouble shooting tool to decrease any down time due to a fault condition. Also on this screen are a system fault indicator, system alarm indicator and reset function keys for both. There are also three function keys assigned to allow the operator access to the other menus.

A further screen not shown is a Power Up menu. This screen is the first screen that will come up on power up of the magnesium melt cell. To move from the power up screen, it is necessary to input a security code (5 digit) which will allow one to use the menu bar to move to the menu for view.

By way of example application settings (running system) may be as follows:

| K Type Thermocouples Used For Temperature Measurement | Set Point | Low Limit | High Limit | Preset Clamped |
|---|---|---|---|---|
| Furnace Outershell T/C 260 Part Low Hi Limit | 1590° F. | — | 1590° F. | Yes Safety Do No adjust |
| Furnace Outershell PLC 5/20 | 1540° F. | — | 1540° F. | 1540° F. -In PLC- |
| Metal Bath T/C 245 | 1292° F. | 1202° F. | 1382° F. | 1280° F. -In PLC- |
| Preheater T/C 106, 107, 108 | 425° F. | 200° F. | 600° F. | 500° F. -In PLC- |
| Siphon Inlet T/C 408 | 1256° F. | 1150° F. | 1380° F. | 1330° F. -In PLC- |
| Siphon Outlet T/C 407 | 1256° F. | 1150° F. | 1380° F. | 1330° F. -In PLC- |
| Metal Pour Time | Part Depen-dant | 1.0 seconds | 3.5 seconds | Less than 3.5 seconds -In PLC- |
| Metal Level 250 | 84% | 72% | 92% | Varies slightly on an ingot charge-In PLC- |
| Normal metal level range between 81% to 86% | | | | |

NOTE:
(1) Low and high limit values are fault conditions for the temperature devices when the set point in the column is being used.
(2) Pour time range is valid from zero to five seconds but no longer.
(3) Metal level values shown are valid.
(4) Set point values for process temperatures are shown as a guide or point to establish your own process temperatures required, which will vary from part to part and die to die.

The main screen (FIG. 29) displays are as follows:

Metal bath temperature display—Degree F (4 digit);

Metal Level Display—% (3 digit);

Siphon Inlet temperature Display Degree F (4 digit);

Furnace Outershell Temperature Display—Degree F (4 digit);

Preheater Ambient Temperature Display—Degree F (3 digit);

Pour Time Display—Seconds (3 digit);

Siphon Outlet Temperature Display—Degree F (4 digit);
Metal Bath Operator Preset Display F (4 digit);
Preheater Operator Preset Display (3 digit);
Siphon Inlet Operator Preset Display (3 digit);
Siphon Outlet Operator Preset Display (4 digit).

Set Point:

Function Keys
Metal Bath Set Point F1 Function Key
Siphon Inlet Set Point F2 Function Key
Preheater Set Point F3 Function Key
Pour Time Set Point F4 Function Key
Siphon Outlet Set Point F5 Function Key To enter a new set point or preset:

(1) Choose the function set point key for the desired process set point or preset value that requires updating.

(2) Press the function set point key and two things will happen: (a) the representation of the function key on the screen will change from black lettering on a white background to gold lettering on a blue background, and (b) an area at the top of the screen will appear in yellow, this area is called the scratch pad.

(3) Use the numeric key pad to enter a new value into the scratch pad. When this is done, press enter. This allows logic in the PLC program to determine whether the value entered is valid or not.

(4) A valid preset or set point entered is acknowledged by the PLC and will result in this new value being displayed in the appropriate preset window. The function key representation on the screen will revert to black lettering on a white background and the value that was entered is now the PLC working value. At this point, press cancel to remove the scratch pad from the screen.

(5) An invalid value entered will result in a message across the bottom of the screen in red and flashing which says "NO HANDSHAKE". Also all zeros will appear in that process preset display and the function key representation will stay gold lettering on a blue background. To clear the fault, press F8 function key and then re-enter a valid value for that particular process.

The cycle screen (FIG. 31) monitors both the request and the pour request cycles by using multi-state indicators with tent messages to allow the operator to be able to monitor these cycles and also as a trouble shooting aid to pin point quickly a fault source in either cycle. This screen monitors the appropriate devices in both auto mode cell operation as well as in an operator driven manual mode select.

Sequence of events on pour requests are:

(1) Die cast machine requests a ladle pour (amount of metal determined by pour timer preset selected on man screen). (Minimum pour 1 second/3.5 seconds maximum pour value).

(2) All logic safety conditions for the die cast machine and the melt cell are valid.

(3) Metal bath level is in the 72% to 92% range (desired level is between 81% to 86%);

Metal bath temperature is in the 1292° F. to 1382° F. range;

Siphon tube temperature is in the 1256° F. to 1380° F. range;

Pour time preset is valid, between 1 second to 3.5 seconds;

Preheater ambient temperature has been above 200° F. (minimum value) for 2 minutes at least.

(4) All above conditions met, pour request will then initiate siphon cycle on.

(5) Siphon tube lowers to die cast machine shot sleeve pour hole.

(6) Siphon tube lowered LS425 becomes true when tube is in the pour position at DCM pour hole.

(7) Siphon valve opens making siphon valve LS406 true.

(8) Siphon valve will close after pour preset timer times out.

(9) Siphon valve closes LS406 no longer true.

(10) Siphon tube drip timer times out/shot release/to DCM.

(11) Siphon tube begins to leave DCM pour hole, LS425 siphon tube lowered no longer true.

(12) Shot release 2 is now sent to the DCM, this signal initiates die cast machine cycle shot.

(13) Siphon tube has risen to home position LS420 is made indicating tube home.

(14) Pour request is a latched condition in the PLC 574 program, it unlatches after a successful pour or when there is no longer a ladle request and the die cast machine toggles locked signal is no longer true;

Siphon cycle latched condition is monitored in many different ways in the PLC program to cancel the cycle if a fault occurs. Some of these are as follows:

(a) siphon tube cycle timer
(b) siphon watch dog timer
(c) valve fault timer
(d) metal level under range
(e) pour request from DCM no longer present
(f) emergency stop condition Ingot Charge Routine Auto Ingot Charge:

When all safety logic conditions are met, the melt cell will maintain a metal level of 85% plus or minus 2%. The minimum and maximum values for metal level are valid from 72% to 92%. An ingot charge may only take place when the preheater ambient temperature has been over 200° F. for at least five minutes. This is done to ensure that the ingot have had a minimum amount of time to heat up to help avoid shocking the metal in the pot and causing high outer shell temperature build up.

The preheater will also charge ingots at a times interval if the metal bath temperature is over the set point range by 10% but will only charge to a metal level of 92%.

With reference to the cycle screen—FIG. 31

Sequence of events (auto):

(1) Ingot request enabled.

(2) Ingot conveyor is checked for home position LS115.

(3) Push rod advances to LS310, charges ingot to chute.

(4) Time delay, then guillotine retracts to LS331, ingot slides into metal bath.

(5) Time delay, guillotine advances to home position LS330.

(6) PLC 574 logic checks the cycle okay.

(7) Ingot conveyor indexes one position to present next ingot to the charge ingot position.

Referring to the control screen—FIG. 30, all of the control devices needed to operate the magnesium melt cell are contained on this screen.

The exceptions to this are:

(1) Associated with the furnace hardwired start and stop for the furnace control and a system emergency stop mushroom head push button (the emergency stop will drop out power to the melt cell and the die cast machine); and (2) associated with the panel view hardwired start and stop push buttons for the preheater control. Also, a keyed selector switch for selecting the siphon tube control Auto/Off/Manual.

A remote pendant on a twenty foot cable may be used for manual control of the siphon tube, a selector switch for raising or lowering the tube, and a push button for opening and closing the siphon tube valve. There is also an emergency stop push button that will if used, drop out the control circuit for the preheater only, which will in turn close the siphon valve and raise the siphon tube to the home position. Manual siphon control is only used for set up purposes and must meet safety precautions established in the PLC program before the siphon tube control manual selected indicator hi-lites indicating manual tube control enabled.

Control devices peripheral to the panel view control screen include:

(1) The manual siphon tube control pendant which has already been discussed earlier in this section.

(2) A motor safety disconnect mounted on the top platform of the preheater melt cell to be used when working on the conveyor unit. This device also incorporates an auxiliary contact unit that monitors as well as mechanically opens the control circuit to the motor conveyor contactor. Disconnect switch open is indicated on screen four (fault screen—FIG. 32).

(3) Air supply shut off which is part of the air filter, regulator, lubricator unit.

(4) An alarm annunciator mounted on the main control cabinet (left hand side when facing the electrical control main cabinet). The annunciator used for system fault and system invalid data. There are two different audio signals.

(a) Priority System Faults (i.e. metal level high, preheater hi-limit, metal bath hi-limit, outershell furnace temp hi-limit, etc.). The alarm is continuous and annunciator will sound without stop.

(b) Priority System Cycle Faults (i.e. conveyor faulted, guillotine cycle fault, siphon tube cycle fault, etc.). The alarm will sound for 45 seconds on, 30 seconds off.

(c) Alarm annunciator may be silenced by pressing Push/Alarm Silence Function Key P.B. F8 on the control screen. This will silence the alarm for five minutes. If fault cleared before time out, the alarm will not sound again. If fault not cleared, the alarm will sound again, etc.

(d) Remote fault beacon signal mounted on top of preheater control cabinet on platform to signal selected fault conditions.

It is the operator's responsibility to ensure all safety procedures are followed before, during, and while the magnesium melt cell is in operation in either a manual cycle routine or in the auto run mode. The following is a list of checks that should be made before operation:

(1) Ensure the main supply switch is turned on.

(2) White power ON pilot lamp must be lighted to ensure control voltages are present.

(3) Ensure both the furnace Hi-Limit Fault and the preheater Fault Pilot Lamps are OFF (these pilot lamps are push to test type and should be checked by operation at the beginning of every shift or as set out by the purchaser).

(4) Ensure that the $CO_2SF6$ protection gas mixture is active and acceptable (set out by the purchaser).

(5) Ensure the air is turned ON to the magnesium melt cell (minimum 90 PSI required).

(6) Ensure the motor safety disconnect is in the upright position (ON).

(7) Ensure thermocouple wiring to the metal bath, siphon tube inlet, siphon tube outlet and the level probe are in good repair. Ensure all thermocouple jacks are firmly seated in their appropriate receptacles.

(8) Visually inspect the 240 VAC 1 phase cables going to the siphon tube connection box mounted on the tube. At this time, check the valve open/closed limit switch (LS3) for mounting tightness and that the activator arm is also tight.

(9) With appropriate safety apparel check both metal bath thermocouple and the level probe for dross build up on them. Both must be dross free as possible for accuracy. Caution must be taken with both devices as they are easily broken if not treated with care. Also, after these units are set up, if moved it is imperative they be replaced to the height they were set up for.

(10) Start the furnace and then start the preheater. It is a good practice to operate the emergency stop on the cabinet to ensure that the E-Stop string is intact. When operated, the furnace, preheater and die cast machine will stop. Restart the devices and continue with the start up routine.

11. On the panel view operator terminal, using the screen select buttons, do a visual check to ensure all menus are accessible.

12. At this point, the power on pilot lamp (white), furnace enabled lamp, and preheater enabled lamp should all be on. On the panel view operator terminal, go to the main screen and select the presets desired for the application temperatures and pour preset.

Temperature and pour preset are retentive and when set will not need to be re-entered when the cell or preheater is turned off.

On the control screen, certain devices are also retentive and care must be taken to de-select or push off when no longer required or desired. These items on the control screen are labelled as PUSH ON/OFF.

Manual Ingot Conveyor Load (1) Ensure all normal start up conditions are met.

(2) Use conveyor cycle selector to select manual conveyor.

(3) Ensure (a) ladle select is off; (b) auto charge is off.

(4) Conveyor mode indicator should show—MANUAL-selected.

(5) Press load ingot conveyor, one shot on PB (6) This will cause the ingot conveyor to index one position (with no ingot charge sequence taking place).

(7) To repeat process, repeat step 5.

This routine allows the set up operator to load the ingot conveyor to a comfortable height and then advance the conveyor to a position where loading ingots can be continued. The operator is not overloaded, surplus ingots will be dropped onto the upper platform if this happens.

Auto Cycle Mode Set Up (1) Ensure all normal start conditions are met.

(2) Furnace enabled on indicator is on.

(3) Preheater enabled on indicator is on.

(4) Siphon tube control, auto selected indicator is on (Key S/S 1 must be turned to auto).

(5) Furnace run mode select (F3) must be on.

(6) Ladle select on mode (F5) must be on.

(7) Auto charge selected on mode (F13) must be (8) Conveyor cycle selector must have auto cycle conveyor on SELECTED (it will be in reverse video). Conveyor mode indicator will show AUTO SELECTED.

In auto running mode, all cycles are controlled by the magnesium melt cell PLC 574 and in conjunction with the die cast machine. Siphon tube cycles, ingot charges and conveyor movement take place when required. Personnel working in close proximity to the cell need to be aware of the fact that they must be extremely careful when the cell is running in auto mode with the die cast machine.

Manual Ingot Charge (1) Ensure all normal start up conditions are met.

(2) Use conveyor selector to select manual conveyor.

(3) Ensure (a) ladle select is off; (b) auto charge is off.

(4) Conveyor mode indicator should show—MANUAL-selected.

(5) Press manual ingot charge, one shot on, PB. F6.

(6) Push rod will charge ingot into chute.

(7) Guillotine will open after time delay.

(8) Ingot charges to pot, guillotine closes after delay.

(9) Push rod retracts to home position.

(10) Conveyor will index one position to place an ingot in the charge position for next cycle.

(11) To repeat process, repeat step 5.

This routine is useful to recharge the pot after changing from one ingot alloy to another when the metal level was lowered considerably. Monitor the metal level bath display when using this routine to ensure against overfill condition.

Manual Conveyor Home (1) Ensure all normal start up conditions are met.

(2) Use conveyor selector to select manual conveyor.

(3) Ensure (a) ladle select is off; (b) auto charge is off.

(4) Conveyor mode indicator should show—MANUAL-selected.

(5) Press conveyor home, one shot on, PB. F10.

(6) Conveyor will advance until the conveyor home LS115 is made, then the conveyor stops.

This routine is only available when, if for some reason, the conveyor when indexing never made it to the home position or if LS115 has gone out of adjustment. Indicator message blocks on the control screen show the conveyor mode, cycle and status of the conveyor at all times. Fault screen would also show a fault condition if the conveyor was not in the position when program logic says it should be.

Manual Siphon Control Mode (1) Ensure all normal start up conditions are met.

(2) Preheater control ON (preheater enabled).

(3) Siphon Tube manual enable S/S2 ON.

(4) Die closed signal from DCM true.

(5) Die open signal from lockmat protection is false.

(6) Die open signal from DCM is false.

(7) DCM in auto/or semi auto signal is false.

(8) Shot rod fully returned at DCM is true.

(9) When these conditions are met, the function siphon tube manual enable will be true.

This mode is used for checking:

(1) Operation of the siphon tube raise/lower.

(2) Valve open/close to check for proper seating of the valve.

(3) To ensure guide bars allow for smooth raising and lowering of the siphon tube.

(4) To check proper indications from the siphon devices, LS425 siphon tube down; LS420 siphon tube raised; and the siphon valve open/closed LS406.

(5) Used also for lining the siphon tube to the DCM pour hole and checking appropriate clearances.

This mode is not intended, nor programmed for manual shot capacity. It is intended to be used only as an aid for setting up a tube for operation and as an aid for trouble shooting problems with the siphon tube and its peripheral devices.

A manually controlled shot is controlled by the DCM logic and is treated by the appropriate logic in the melt cell processor as such.

A program can be readily varied, provided and/or redesigned by those skilled in the art to provide the previously described sequences or the other process sequences as may be desired dependent upon the metal and/or employment of the molten form thereof.

In the foregoing melt system the computer control system is provided with signals from the various sections as follows:

Preheater and conveyor

Temperature sensors 106, 107, 108 conveyor index limit switch 115 and 151 motor safety switch 116;

Ingot transfer

Push rod cylinder unit 301 advance proximity sensor 310;

Push rod cylinder unit 301 retract proximity sensor 311;

Gate cylinder 308 advance proximity sensor 330 (gate closed);

Gate cylinder 308 retract proximity sensor 331 (gate closed).

Furnace

Metal bath temperature sensor 245;

Furnace casing temperature sensor 260;

Metal level sensor 250.

Siphon Tube

Temperature sensor inlet 408;

Temperature sensor outlet 407;

Tube lower (pour) proximity sensor 425;

Tube raised proximity sensor 420;

Pour valve limit switch 406.

This provides a system operable with small variations from preset values, i.e. metal bath ±8° C. as one example with N 1/16 inch variation in metal level.

A fewer number of sensors can provide an operable system where wider variations from set values could be tolerated.

For example a single temperature sensor could be used in the preheater to control the temperature therein and permit ingot charging when the ingot is deemed to have reached a suitable temperature. The furnace perhaps could have signals only from sensors responsive to metal bath temperature and molten metal level. The siphon tube for example could perhaps have only one temperature sensor and the position proximity sensors.

In both the sophisticated system and sample system all signals from the sensors are processed and utilized by the processor to control the system at all times.

Trouble Shooting Tips (1) The panel view has been set up to make locating a fault as easy and as quick as possible by using the control, cycle and fault screen. In most cases, the fault itself will be indicated and the associated text tells what the condition is.

(2) An intermittent fault might best be found using the cycle screen and watching the cycle develop. In more than 90% of all indicated fault conditions, the fault will latch an associated latched store in the program to latch the fault indicator so even if the condition clears itself, you will still know what took place.

(3) For improper or faulted temperature devices, the thermocouple wiring is always a good place to start as it is very susceptible to magnesium being splashed on it or resting against hot surfaces.

(4) In case of level control faults; check cable, dross build up on the level probe or damage to the probe itself.

(5) In auto mode, no siphon cycle yet no faults showing; ensure all safety conditions that come from the die cast machine are true. If not, the siphon tube will not cycle. Does screen 2 (control screen) show a ladle pour request?

(6) Furnace temperature is too low; check that the metal bath preset is set so that the furnace should be on. Look at the SCR firing boards and see if they are firing. If they are, the leds on the control boards should be coming on and then going off. If need be, check the 100 amp line fuses to the board and the SCR fuses on the board itself. Other things to check—conductor connections to the elements, resistance leg to leg of the elements themselves.

(7) Furnace comes on but the preheater won't; ensure the remote siphon control pendant emergency stop button hasn't been pressed.

A thorough start up routine is not only good for a safe, smooth production run but it is also when a number of potential problems can be spotted before they become a down time factor, i.e. melted insulation on thermocouple wiring, loose proximity sensors, air leaks or motor/conveyor fittings requiring lubrication.

The overall life of a furnace is dependent on several factors. It would be impossible to list all areas of concern. However, there are a few procedures that can improve the overall life. For greater heating element life and module longevity, the following is recommended.

Initial Heat-Up—Ceramic Fiber

Pyro-Bloc ceramic fiber modules contain a small amount of lubricant, (less than ½% by weight). This is added during production and enhances the handleability of the fiber. In most applications this does not present any concerns.

For the initial heat-up open the furnace to the ambient air and slowly elevate to the maximum heating element use limit. This will eliminate a majority of the lubricant from the ceramic fiber. The organic material will start to carburize at 250° F. and will be totally burned out at 600° F. This is especially wise in cases where the furnace is tightly enclosed, an atmosphere is introduced, or in a slight vacuum. This process can be accomplished in approximately seven to ten hours, (steady state or equilibrium may vary depending on the material thickness and the operating conditions). Outside venting is advisable in a small building.

Initial Heat-Up—Heating Elements

The life of a resistance heating element depends on a continuous presence of a dense oxide layer completely coating the element surface. Corrosion results from the interference with this formation and replenishment of the oxide layer by the presence of specific compounds in the atmosphere. The greater the interference, the shorter the element life. The effect of the corrosive compounds is often temperature dependent.

Pre-oxidized elements provide a protective oxide coating, ensuring a longer life. It is recommended that the element be re-oxidized after 250 service hours (held at service temperature for 5–10 hours in an oxygen-containing atmosphere).

Heat-up rates for refractories (castables, IFB, etc.) require additional time.

The use of circulating fans should be discontinued until after the heat-up procedure is completed.

Special precautions are required for electrically heated ceramic fiber lined furnaces operating with an endothermic atmosphere. Periodic carbon burn out procedures are required to eliminate carbon build up. Carbon precipitates from the atmosphere at temperatures below 1400° F. and may build up with the lining where the thermal gradient drops below this temperature. Carbon build up may not be apparent on the fiber surface; therefore, it is critical that the burn out procedure be followed. Carbon within the lining may cause premature failure of the elements and element supports through electrical shorting and arcing. To remove the carbon from the furnace lining, the furnace should be heated to 1800° F. or above. An air atmosphere should be in the furnace chamber. Once at temperature, the furnace should be opened slightly, allowing air to infiltrate. The carbon will burn as long as the temperature is above its ignition point and there is adequate oxygen.

A surface coating of Unikote M (trade-mark) is recommended to improve the lining integrity during burn out. The coating should be applied after the element supports are installed. For ease of application, spraying of the coating is recommended.

Rod type heating elements are preferred as they are superior to ribbon elements in an endothermic atmosphere. The carburization of the thin cross section of a ribbon element occurs much more quickly than through the thicker rod type elements.

Proximity sensors 310, 311, 420, 425, 330 and 331 are activated by a magnetized selected area on the push rod and activation is thus dependent upon the extended or retracted position of the push rod.

I claim:

1. A metal melt system comprising:

(a) An electric furnace with a crucible therein for holding a supply of molten metal and including molten metal level and temperature sensors on said furnace that provide output signals representative of the temperature and level of the molten metal in the crucible;

(b) an electrically heated preheater for heating metal ingots to a set temperature and including a temperature sensor on the preheater providing an output signal representative of the temperature in the preheater;

(c) an ingot transfer means for transferring a selected ingot from said preheater into said furnace including actuators for effecting the transfer and sensors providing output signals representative of the state of operation of said actuators and functions performed;

(d) means for withdrawing molten metal from said crucible; and (e) programmable logic controller means receiving signals from said sensors and in response thereto, in comparison with set values, controlling power to the preheater and furnace to maintain within selected limits temperatures set therefor and controlling feeding of ingots to said furnace as required to maintain the molten metal in the furnace within a selected range of a set level.

2. A melt system as defined in claim 1 wherein said furnace has a first upper zone of heating elements and a second lower zone of heating elements, said zones of heating elements being independent of one another and wherein said programmable logic controller means provides output signals to firing boards of silicone controlled rectifiers to supply power as required to maintain the molten metal within a selected deviation from a set temperature.

3. A melt system as defined in claim 2 wherein said heating elements in each zone are in a three phase Wye configuration.

4. A melt system as defined in claim 3 wherein said programmable logic controller means includes an analog output module and wherein signals therefor are within a selected range representative of power requirements for the heating elements to maintain said set molten metal temperature.

5. A melt system as defined in claim 4 wherein said furnace has an outer shell and sensor means providing an output signal to said programmable logic controller means representative of the temperature of said outer shell.

6. A melt system as defined in claim 5 wherein said furnace uses a closed loop proportional integral derivative enhanced in a program of said programmable logic controller means.

7. A melt system as defined in claim 1 wherein said furnace has a first upper zone of heating elements and a second zone lower zone of heating elements, wherein said heating elements in each zone are in a three phase Wye configuration and wherein said zones are independent of one another with each zone controlled by its own three phase zero cross fired silicon controlled rectifier gated to allow only the amount of power required to retain the molten metal at a desired set point.

8. A melt system as defined in claim 7 wherein said furnace has a base, side walls projecting upwardly from said base and extending around a selected area and a top wall supported by said side walls, said crucible being suspended from said top wall and wherein the heating elements in each of said zones extend around said crucible.

9. A melt system as defined in claim 1 wherein said furnace molten metal temperature sensor comprises a thermocouple mounted on the furnace and wherein each of said thermocouple and said metal level sensor have a probe projecting into the crucible so as to be partially immersed in a molten bath therein during operation.

10. A melt system as defined in claim 9 wherein said crucible has a removable lid and wherein said probes are each mounted on said lid and project downwardly therefrom, said probes being spaced apart laterally from one another.

11. A melt system as defined in claim 8 wherein said furnace walls are insulated with plyo-block insulation.

12. A melt system as defined in claim 11 wherein said heating elements are overbend nickel chromel.

13. A melt system as defined in claim 1 wherein said means for withdrawing molten metal from said crucible comprises a siphon tube having a suction end projecting into molten metal, during use, in said crucible and a discharge end spaced from said furnace, means movably mounting said siphon tube on said furnace, means for moving said siphon tube discharge end from one to the other of a raised non pour position and a lowered pour position, said moving means being activated by signals from said programmable logic controller means and sensor means providing signals to said programmable logic controller means responsive to the siphon tube position.

14. A melt system as defined in claim 13 including electric resistance heating means along at least selected portions of said siphon tube and temperature sensor means providing signals to said programmable logic controller means representative of the temperature of molten metal in the siphon tube.

15. A melt system as defined in claim 14 wherein said temperature sensor means comprises a first thermocouple at an inlet end portion of said siphon tube and a second thermocouple adjacent the discharge end and wherein said siphon tube heating means comprises a first resistance heating along an inlet portion of said siphon tube and a second resistance heating section along a discharge end portion of said siphon tube and wherein power to said heating elements is controlled by signals from said programmable logic controller means to maintain the molten metal in the siphon tube within a selected range of a set temperature.

16. A melt system as defined in claim 15 wherein said furnace crucible has a removable lid mounted thereon and wherein said siphon tube is adjustably movably mounted on said lid.

17. A melt system as defined in claim 16 wherein said lid has a thermocouple mounted thereon with a probe projecting into said crucible providing said molten metal temperature sensing means and wherein such probe and said siphon tube suction end terminate at about the same distance down from said lid whereby the temperature is measured at the same depth in the molten metal as the liquid metal is drawn from during use of the siphon tube in its pour position.

18. Improvements in magnesium die casting in which ingots of magnesium are melted and transferred from a molten bath of magnesium by a siphon tube to the shot hole of a die casting machine comprising providing a computer controlled integrated magnesium melt system in which temperatures of the magnesium are maintained within selected limits of set values, said magnesium melt system including:

(a) an ingot preheater means having electric resistance heating elements for heating ingots therein and at least one preheater temperature sensing means providing output signals representative of the temperature of the preheated ingots;

(b) a furnace having a crucible for holding a molten bath of magnesium, electric resistance heating elements in said furnace for heating the crucible to melt the ingots and maintain the magnesium in a molten state, means for controlling power to said furnace heating elements, temperature sensing means providing output signals representative of the temperature of the molten magnesium;

(c) means for transferring preheated ingots from said preheater into the crucible of said furnace;

(d) a siphon tube mounted on said furnace for transferring molten magnesium from said crucible to the shot hole of the die casting machine; said siphon tube having at least one electric resistance heating element along a selected portion thereof and at least one temperature sensing means providing output signals representative of the temperature of molten magnesium in the tube; and (e) a programmable logic controller programmed with preset temperature values for preheated ingots, the molten magnesium in the furnace crucible and the molten magnesium in the siphon tube, and including means processing signals outputted by all said heat sensor means with respect to preset values and controlling power supplied to said heating elements to maintain the temperatures within a selected range of the preset values.

19. Improvements in magnesium die casting as defined in claim 18 wherein said furnace has a first upper zone of heating elements and a second lower zone of heating elements, said zones of heating elements being independent of one another and wherein said programmable logic controller provides output signals to firing boards of silicone controlled rectifiers to control the supply of power as required to said heating elements to maintain the molten metal within a selected deviation from a set temperature.

20. Improvements in magnesium die casting as defined in claim 19 wherein said heating elements in each zone are in a three phase Wye configuration.

21. Improvements in magnesium die casting as defined in claim 20 wherein said programmable logic controller includes an analog output module and wherein signals therefor are within a selected range representative of power requirements for the heating elements to maintain said set metal bath temperature.

22. Improvements in magnesium die casting as defined in claim 21 wherein said furnace has an outer shell and sensor means providing an output signal to said programmable logic controller representative of the temperature of said outer shell.

23. Improvements in magnesium die casting as defined in claim 22 wherein said furnace uses a closed loop proportional integral derivative enhanced in a program of said programmable logic controller.

24. Improvements in magnesium die casting as defined in claim 18 wherein said furnace has a first upper zone of heating elements and a second zone lower zone of heating elements each extending around said crucible, wherein said heating elements in each zone are in a three phase Wye configuration and wherein said zones are independent of one another with each zone controlled by its own three phase zero cross fired silicon controlled rectifier gated to allow only the amount of power required to retain the molten metal at a desired set point.

25. Improvements in magnesium die casting as defined in claim 24 wherein said furnace molten metal temperature sensor comprises a thermocouple mounted on the furnace and further including a metal level sensor mounted on said furnace, each of said thermocouple and said metal level sensor having a probe projecting downwardly into the crucible so as to be partially immersed in a molten bath therein during operation.

26. Improvements in magnesium die casting as defined in claim 18 wherein said siphon tube has a suction end projecting into molten metal, during use, in said crucible and a discharge end spaced from said furnace, means movably mounting said siphon tube on said furnace, means for moving said siphon tube discharge end from one to the other of a raised non pour position and a lowered pour position, said moving means being activated by signals from said programmable logic controller and sensor means providing signals to said programmable logic controller responsive to the siphon tube position.

27. Improvements in magnesium die casting as defined in claim 18 wherein said preheater includes conveyor means for moving ingots in sequence into said preheater and through the same to a discharge end thereof, temperature sensing means for sensing the temperature of an ingot at said discharge end and providing signals to said programmable logic controller representative of the temperature of such ingot and wherein operation of said conveyor, transfer of an ingot into the furnace and maintenance of selected temperatures is integrated to maintain a set level of molten magnesium in said crucible and delivery of a set quantity of molten magnesium to the die cast shot hole at a temperature within a selected range of a set temperature.

28. Improvements in magnesium die casting as defined in claim 27 wherein said molten metal is maintained within a temperature range of plus or minus 8° C.

29. A magnesium melt system for use with a die casting machine comprising a computer controlled integrated system including:

(a) an ingot preheater with conveyor means for moving ingots into and through the preheater to a discharge end thereof, said preheater having resistance heating elements;

(b) a melt furnace having resistance heating elements and a crucible for molten metal;

(c) an ingot transfer means including a drop chute having a gate therein selectively to release a preheated ingot for free fall into said crucible in said furnace;

(d) a siphon tube for transferring molten magnesium from said crucible to a shot hole of a die casting machine, said siphon tube having a resistance heating element on a selected portion thereof; and (e) programmable logic controller means integrating operations and controlling power requirements to said heating elements to maintain set temperatures for the magnesium at the respective locations, thermocouple temperature sensor means on each of said preheater, furnace and siphon tubes providing signals to said programmable logic controller means representative of actual temperatures, said programmable logic controller means processing said signals with respect to preset values and controlling power requirements to said elements to maintain said set temperatures within a selected range.

30. A magnesium metal melt system comprising:

(a) A furnace with a crucible therein for holding a supply of molten metal, electric resistance heating elements in said furnace arranged in a first upper heating zone and a second lower heating zone with each extending around said crucible, metal level and temperature sensors on said furnace that provide output signals representative of the temperature and level of the molten metal in the crucible;

(b) an ingot preheater chamber having an inlet end and a discharge end and an endless conveyor means for moving metal ingots in sequence into said preheater through said inlet end and through said preheater to said discharge end, electric resistance heating elements arranged in respective first and second heating zones from said inlet end to said discharge end, thermocouple temperature sensor means on the preheater providing output signals representative of the temperature in the preheater respective first and second zones;

(c) an ingot transfer means for transferring a selected ingot from said discharge end of the preheater into a closed drop chute, gate means in said drop chute, actuators for effecting the transfer and opening and closing said gate and sensors providing output signals representative of the state of operation of said actuators and functions performed;

(d) siphon tube means on said furnace for withdrawing molten metal from said crucible, said siphon tube including an inlet end heating element, an outlet end heating element and first and second thermocouples providing output signals representative of temperatures at said respective inlet and outlet; and (e) programmable logic controller means receiving signals from said sensors and in response thereto, in comparison with set values, controlling power to the preheater and furnace to maintain within selected limits temperatures set therefor and controlling feeding of ingots to said furnace as required to maintain the molten metal in the furnace within a selected range of a set level.

31. A metal melt furnace comprising:

(a) metal, high temperature insulated, walls extending around a selected area and base means extending across said selected area and including means supporting said walls;

(b) an insulated top wall supported by said side walls and having an opening therein;

(c) a crucible suspended from said top wall through said opening and extending downwardly terminating at a bottom end above said base means;

(d) a lid on said crucible and electric elements on each of said insulated walls comprising a first upper heating zone extending around said crucible and a second lower heating zone independent of said first zone and also extending around said crucible; and (e) means to proportionally and selectively control power to the respective zones.

32. A melt furnace as defined in claim 31 wherein said elements in each of said zones are in a three phase Wye configuration.

33. A melt furnace as defined in claim 32 including a first thermocouple mounted on said lid and having a probe projecting downwardly into said crucible, a second thermocouple temperature sensing means on a wall of said furnace, said first and second thermocouples providing signals responsive to internal and external temperatures of the furnace.

34. A melt furnace as defined in claim 33 wherein each said heating zone is supplied by its own 3 phase zero cross-fired silicon controlled rectifier having firing boards gated by a gating signal thereby providing said means to proportionally control power to the respective zones.

35. A melt furnace as defined in claim 34 wherein said gating signal varies in the range of 4 to 20 mA in proportion to the amount of heat required to maintain a set temperature for molten metal in said crucible during operation of the furnace.

36. A melt furnace as defined in claim 33 including a metal level detection means mounted on said lid and having a probe projecting therefrom downwardly into said crucible.

37. A melt furnace as defined in claim 36 including apertures in said lid for supplying a gas mixture into said crucible.

38. A melt furnace as defined in claim 34 including a siphon tube mounting plate on said lid and means for selectively adjustably positioning said plate.

39. An ingot preheater and transfer apparatus for a metal melt system comprising an enclosure having an inlet end and a discharge end, resistance heating elements in said enclosure arranged in a first heating zone adjacent said inlet end and a second zone extending therefrom toward said discharge end, an endless conveyor means for moving a plurality of ingots in sequence into said enclosure through said inlet means and through said enclosure to said discharge end, an enclosed drop chute extending downwardly from said discharge end, an ingot transfer device at said discharge end including means to transfer an ingot from said discharge end into said drop chute, gate means in said drop chute to respectively in a gate closed and gate open position retain and release an ingot in said chute and means to move said gate from one to the other of said positions.

40. An apparatus as defined in claim 39 including thermocouple sensor means mounted on said preheater to provide output signals representative of the temperature of ingots in said preheater.

41. An apparatus as defined in claim 40 including a further thermocouple heat sensor means and means for selectively moving the same into and out of contact with an ingot at said discharge end.

42. Apparatus for use in a magnesium metal melt system comprising:

(a) an electric furnace having a crucible for melting ingots of metal and holding a supply of such molten metal;

(b) an electrically heated ingot preheater;

(c) means for transferring heated ingots from said preheater into the furnace crucible;

(d) sensor means providing output signals representative of the temperature of the molten metal in the crucible, the level of the molten metal in the crucible, the temperature of metal ingots ready for transfer to the furnace and the state of operation of said ingot transfer means; and (e) programmable logic controller means receiving signals from said sensors and in response thereto, in comparison with set values, controlling power to the preheater and furnace to maintain within selected limits temperatures set therefor and controlling feeding of ingots to said furnace as required to maintain the molten metal in the furnace within a selected range of a set level and within a selected deviation from a set temperature.

43. Apparatus as defined in claim 42 wherein said ingot preheater comprises an enclosure providing a chamber for heating a plurality of ingots, said chamber having an ingot inlet end and spaced therefrom an ingot discharge end; said discharge end being disposed at an elevation higher than a predetermined free upper surface of molten metal in the crucible during normal operation of the system.

44. Apparatus as defined in claim 43 wherein said ingot transfer means includes an enclosed drop chute having a first ingot inlet end at said ingot discharge end of said preheater and a second ingot discharge end in said furnace at a position above said molten metal upper free surface and a controllably openable and closeable gate in said drop chute.

45. Apparatus for melting ingots of magnesium and provide a source of molten magnesium at a set temperature for delivery to a casting machine, said apparatus comprising:

(a) an electrically heated furnace having a crucible for holding a selected quantity of molten magnesium, said selected quantity having a free upper surface at a predetermined level, said crucible being closed at the top providing a closed space above said molten metal free upper surface;

(b) an ingot preheater comprising an electrically heated enclosure having an ingot inlet end and spaced therefrom an ingot outlet end, said ingot outlet end being disposed at an elevation higher than said predetermined level of molten magnesium in said furnace;

(c) ingot transfer means including an enclosed drop chute having a first ingot inlet end at said preheater discharge end and an outlet end opening into said crucible, a gate in said drop chute and means to open and close the same;

(d) sensor means providing output signals representative of the temperature of the molten metal in the crucible, the level of the molten metal in the crucible, the temperature of metal ingots ready for transfer to the furnace and the state of operation of said ingot transfer means; and (e) programmable logic controller means receiving signals from said sensors and in response thereto, in comparison with set values, controlling power to the preheater and furnace to maintain within selected limits temperatures set therefor and controlling feeding of ingots to said furnace as required to maintain the molten metal in the furnace within a selected range of a set level and within a selected deviation from a set temperature.

* * * * *